US010011474B2

(12) United States Patent
Bonner et al.

(10) Patent No.: US 10,011,474 B2
(45) Date of Patent: Jul. 3, 2018

(54) PORTABLE FLUID CONTAINER ASSEMBLY, FLUID CONNECTOR AND ATTACHMENT

(76) Inventors: Mark Bonner, Frenchtown, NJ (US); Dennis Goodenow, Garden Valley, CA (US); James Wedderburn, Moncton (CA)

( * ) Notice: Subject to any disclaimer, the term of this patent is extended or adjusted under 35 U.S.C. 154(b) by 694 days.

(21) Appl. No.: 14/004,774

(22) PCT Filed: Mar. 15, 2012

(86) PCT No.: PCT/CA2012/000237

§ 371 (c)(1),
(2), (4) Date: Nov. 19, 2013

(87) PCT Pub. No.: WO2012/122635

PCT Pub. Date: Sep. 20, 2012

(65) Prior Publication Data

US 2014/0076938 A1 Mar. 20, 2014

Related U.S. Application Data

(60) Provisional application No. 61/453,379, filed on Mar. 16, 2011, provisional application No. 61/475,441, filed on Apr. 14, 2011, provisional application No. 61/480,064, filed on Apr. 28, 2011, provisional application No. 61/505,807, filed on Jul. 8, 2011, provisional application No. 61/505,642, filed on Jul. 8, 2011.

(51) Int. Cl.

| | |
|---|---|
| ***B67D 7/42*** | (2010.01) |
| ***B67D 3/00*** | (2006.01) |
| ***B67D 7/00*** | (2010.01) |
| ***B67D 7/36*** | (2010.01) |
| ***B65D 21/02*** | (2006.01) |
| ***B65D 25/42*** | (2006.01) |
| ***B67D 7/04*** | (2010.01) |
| ***B67D 7/02*** | (2010.01) |

(52) U.S. Cl.

CPC ..... *B67D 3/0051* (2013.01); *B65D 21/0201* (2013.01); *B65D 25/42* (2013.01); *B67D 7/005* (2013.01); *B67D 7/0294* (2013.01); *B67D 7/04* (2013.01); *B67D 7/36* (2013.01); *B67D 7/42* (2013.01)

(58) Field of Classification Search

CPC .... B67D 7/005; B67D 3/0051; B67D 7/0294; B67D 7/04; B67D 7/36; B67D 7/42; B67D 7/50; B67D 7/44; F16N 3/04; B65D 21/0201; B65D 25/42

USPC ..... 222/472

See application file for complete search history.

(56) References Cited

U.S. PATENT DOCUMENTS 44,485 A * 9/1864 Overhiser ..... B65D 47/20 222/487

4,421,146 A * 12/1983 Bond ..... B65D 77/06 141/349

(Continued)

*Primary Examiner* — Patrick M Buechner

(57) ABSTRACT

An attachment for communication of fluid from a fluid source. The attachment may include at least one fluid passage permitting fluid flow through the body of the attachment, and at least one valve engaging portion in the body. The valve engaging portion may be configured to open a valve of the fluid source when the attachment is attached to the fluid source or when the attachment is moved towards the fluid source.

19 Claims, 85 Drawing Sheets

(56) References Cited

U.S. PATENT DOCUMENTS

| | | | | | |
|---|---|---|---|---|---|
| 4,862,918 | A * | 9/1989 | Schroeder | B67D 7/0294 | 137/614.19 |
| 5,123,441 | A * | 6/1992 | Hogue | B67D 7/0294 | 137/381 |
| 6,155,464 | A * | 12/2000 | Vachon | B67D 7/005 | 141/291 |
| 6,708,740 | B2 * | 3/2004 | Wessberg | F16L 29/04 | 137/614.04 |
| 2015/0001261 | A1 * | 1/2015 | Johnson | B67D 3/045 | 222/525 |

* cited by examiner

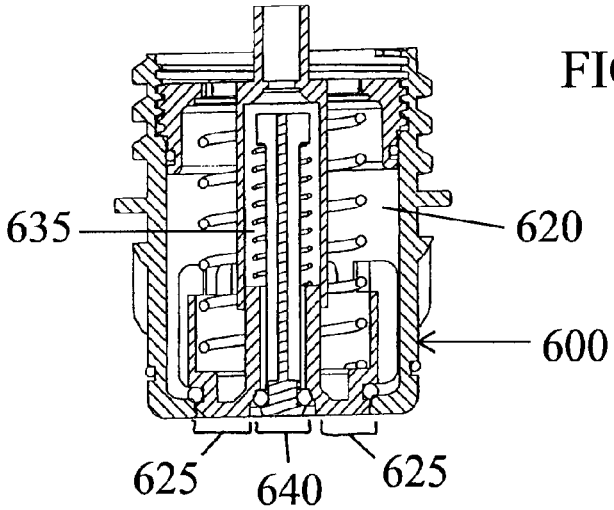
FIG. 70
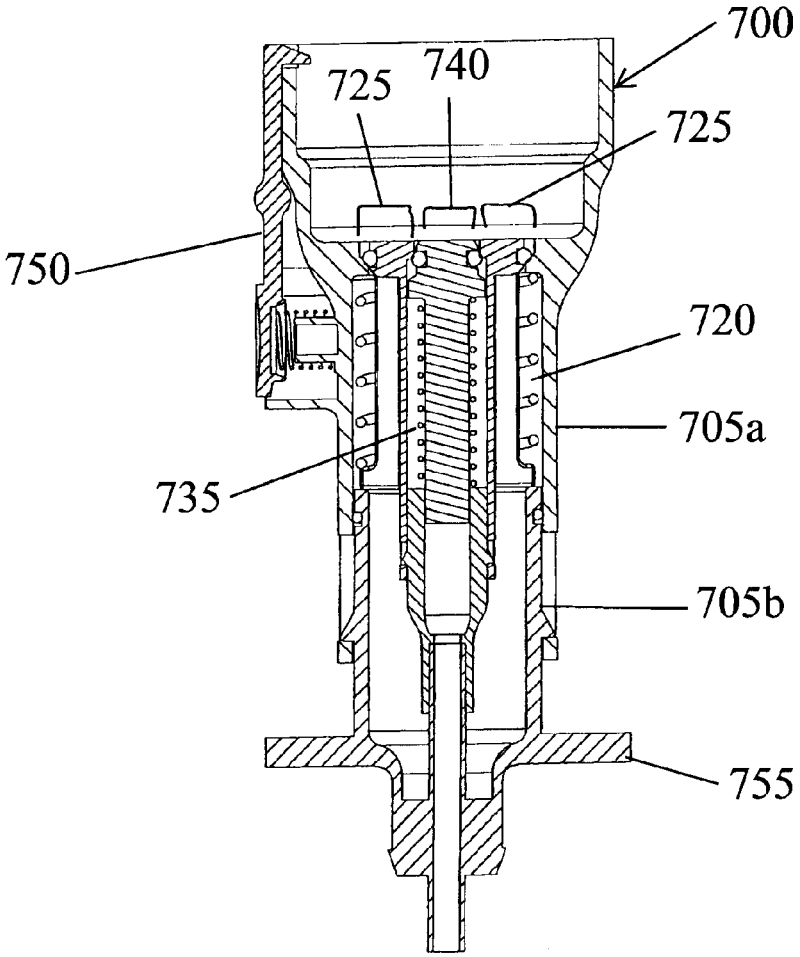

PORTABLE FLUID CONTAINER ASSEMBLY, FLUID CONNECTOR AND ATTACHMENT

CROSS-REFERENCE TO RELATED APPLICATIONS

The present application is a national stage entry from international patent application number PCT/CA2012/000237 filed on Mar. 15, 2012, the entirety of which is hereby incorporated by reference. The present disclosure claims priority from U.S. provisional patent application No. 61/453,379, filed Mar. 16, 2011; U.S. provisional patent application No. 61/475,441, filed Apr. 14, 2011; U.S. provisional patent application No. 61/505,807, filed Jul. 8, 2011; U.S. provisional patent application No. 61/480,064, filed Apr. 28, 2011; and U.S. provisional patent application No. 61/505,642, filed Jul. 8, 2011; the entireties of which are hereby incorporated by reference.

TECHNICAL FIELD

The present disclosure relates to portable fluid containers and container assemblies, in particular portable fluid containers and container assemblies suitable for containing and dispensing fluids, such as volatile fluids.

BACKGROUND

Portable fluid containers are often used in the consumer market to transport and dispense fluids. Such containers are typically blow molded and are typically provided with one or more handles for carrying and manipulating the containers. However, such containers may be unwieldy, especially when filled with liquid. The positioning and/or orientation of these handle(s) on the container may contribute to the unwieldiness of the container. The number of handle(s) provided is typically limited and the handle(s) are not typically ergonomically oriented, which may result in reduced control and an awkward dispensing process when a user attempts to maneuver the container using the handle(s).

It is also desirable to simplify the manufacture of such containers, in order to increase quality and reduce costs. These handle(s) are typically molded into the container material during the manufacturing (typically blow molding) process. The container quality may increase and the container cost may decrease if the handle(s) did not need to be formed in the blow molding process.

Conventional containers are typically provided with one opening for both receiving and dispensing fluids, but not separate openings for each.

Some fluid containers, which may be designed for certain types of fluids, may be subject to regulatory constraints. For examples, portable fuel containers may be regulated for safety and/or environmental concerns. Such regulations may require, for example, sturdy handles, proper coloring and/or features to reduce spilling of fluids. Conventional fuel containers have met such requirements by using a relatively simple container design. However, such products may be awkward, inconvenient and/or unwieldy to manually maneuver, making it difficult to manage and/or control the dispensing of fluids. Such containers may perform relatively poorly in various fuelling applications (e.g., pouring fuel into a tank), and when used by particular users that may lack manual strength and/or dexterity (e.g., older users).

Issues that may be improved upon include, for example, ergonomic container construction and operation, container storage, transportation convenience and stability, ease of use, pouring convenience, such as improved control on the dispensing activation and flow rate, among others.

SUMMARY

In some example aspects, the present disclosure provides an attachment for communication of fluid from a fluid source, the attachment may include: a body defining a receiving end for receiving fluid from the fluid source and a distal end for dispensing fluid from the attachment; a first fluid passage defined in the body permitting fluid flow through the body at least to the distal end; at least one valve engaging portion housed in the body; wherein the attachment comprises at least two telescoping portions, wherein motion of the telescoping portions relative to each other brings the at least one valve engaging portion towards the receiving end.

In some examples, the attachment may include a second fluid passage defined in the body permitting fluid flow through the body at least from the distal end.

In some examples, the at least one valve engaging portion may include at least one projection.

In some examples, the body may include the at least two telescoping portions, and motion of the telescoping portions relative to each other comprises shortening of the body.

In some examples, the attachment may include a connecting member for attaching the attachment to the fluid source.

In some examples, the body and the connecting member may include the at least two telescoping portions, and motion of the telescoping portions relative to each other comprises bringing the body closer to the fluid source.

In some examples, the distal end may be configured as a spout.

In some examples, the first fluid passage and the second fluid passage may be generally co-axial.

In some examples, the first fluid passage may be configured for liquid fluid flow and the second fluid passage may be configured for vapor fluid flow.

In some examples, motion of the telescoping portions relative to each other may be actuated by a cable. The cable may be connectable to a trigger remotely located from the attachment for actuating motion of the telescoping portions relative to each other.

In some examples, the attachment may include a removable dispenser member connected to the distal end for dispensing fluid from the attachment.

In some examples, the body may include a removable dispenser member defining the distal end.

In some examples, one of the at least two telescoping portions may include a removable dispenser member defining the distal end.

In some examples, the removable dispenser member may be configured as a spout tip.

In some examples, the attachment may include a protrusion extending from at least a portion of an outer surface of the body near the distal end, the protrusion being configured to come into close contact with an outer surface of a fluid destination when the distal end is inserted into an inlet of the fluid destination. The protrusion may include an extended surface.

In some examples, the motion of the telescoping portions relative to each other may be effected by engagement of the protrusion with an inlet opening of the fluid destination.

In some examples, motion of the telescoping portions relative to each other may be actuated by a cable, wherein the protrusion may be movable between an enabling position and a disabling position, and actuation by the cable may be enabled when the protrusion is in the enabling position and disabled when the protrusion is in the disabling position.

In some examples, when the protrusion comes into close contact with the outer surface of the fluid destination, the protrusion may be held in the enabling position.

In some example aspects, the present disclosure provides an attachment for communication of fluid from a fluid source, the attachment may include: a body defining a receiving end for receiving fluid from the fluid source and a distal end for dispensing fluid from the attachment; a first fluid passage defined in the body permitting fluid flow through the body at least to the distal end; at least one valve engaging portion housed in the body; wherein the at least one valve engaging portion is configured to engage a valve of the fluid source, and motion of the at least one valve engaging portion towards the fluid source causes the valve to open.

In some examples, the attachment may include a second fluid passage defined in the body permitting fluid flow through the body at least from the distal end.

In some examples, the at least one valve engaging portion may include at least one projection.

In some examples, the attachment may include a connecting member for attaching the attachment to the fluid source.

In some examples, motion of the body and the connecting member relative to each other may cause the motion of the at least one valve engaging portion towards the fluid source.

In some examples, the distal end may be configured as a spout.

In some examples, the first fluid passage and the second fluid passage may be generally co-axial.

In some examples, the first fluid passage may be configured for liquid fluid flow and the second fluid passage may be configured for vapor fluid flow.

In some examples, the attachment may include a removable dispenser member connected to the distal end for dispensing fluid from the attachment.

In some examples, the body may include a removable dispenser member defining the distal end.

In some examples, the removable dispenser member may be configured as a spout tip.

In some example aspects, the present disclosure provides a connection system that may include: a source connector that may include: a body defining an attachment end for attaching the source connector to a fluid source, and a connection end; a first fluid passage defined within the body permitting fluid flow at least between the attachment end and the connection end; and a first valve for controlling flow of the fluid through the first fluid passage, the first valve being biased towards a valve closed configuration in which fluid flow through the first fluid passage is inhibited; and any of the attachments described above; wherein the receiving end of the attachment and the connection end of the source connector are configured to mate with each other; wherein, when the attachment and the source connector are mated, the at least one valve engaging portion of the attachment engages the first valve of the connector; and wherein motion of the at least one valve engaging portion towards the attachment end causes the first valve to be reconfigured in a valve opened configuration, thereby permitting fluid communication between the first fluid passages of the respective attachment and source connector.

In some examples, the source connector may include: a second fluid passage defined within the body permitting fluid flow at least between the connection end and the attachment end; and a second valve for controlling flow of the fluid through the second fluid passage, the second valve being biased towards a valve closed configuration in which fluid flow through the second fluid passage is inhibited; and the attachment may include: a second fluid passage defined in the body permitting fluid flow through the body at least from the distal end; wherein motion of the at least one valve engaging portion towards the attachment end causes the second valve to be reconfigured to a valve opened configuration, thereby permitting fluid communication between the second fluid passages of the respective attachment and source connector.

In some examples, the first valve may be biased towards the connection end to define the valve closed configuration.

In some examples, the first valve may be biased towards the connection end to define the valve closed configuration of the first valve and the second valve is biased towards the attachment end to define the valve closed configuration of the second valve.

In some examples, the first valve and the second valve of the source connector may be moveable at least partially from their respective valve closed configurations to respective valve opened configurations by motion of the first valve towards the attachment end, the motion of the first valve being interconnected with motion of the second valve.

In some examples, motion of the first valve toward the attachment end simultaneously, nearly simultaneously or with some slight delay may unseat the second valve thereby moving the second valve to the valve opened configuration.

In some examples, the second valve may be seated against the first valve when both valves are in their respective valve closed configurations.

In some examples, for at least a portion of the motion of the first valve towards the attachment end, the second valve may be carried along by the first valve towards the attachment end before the second valve may be moved to the valve opened configuration.

In some examples, the first fluid passage and the second fluid passage of the connector may be generally co-axial, and the first fluid passage and the second fluid passage of the attachment may be correspondingly generally co-axial.

In some examples, the first fluid passages of the attachment and the connector may be configured for liquid fluid flow and the second fluid passages of the attachment and the connector may be configured for vapor fluid flow.

In some examples, the first valve and the second valve may be independently biased towards their respective valve closed configuration.

In some examples, the first and second valves may be biased toward their respective valve closed configurations by respective independent first and second biasing members.

In some examples, the first and second biasing members may include compression springs.

In some examples, the first valve may be biased toward the valve closed configuration by a first biasing member.

In some examples, the first biasing member may include a compression spring.

In some examples, the first valve, when in the valve closed configuration, may define a substantially planar surface.

In some examples, the first and second valves, when in their respective valve closed configurations, may define a substantially planar surface.

In some examples, the source connector may be configured as a container cap.

In some example aspects, the present disclosure provides a container assembly that may include: any of the systems described above; and a fluid container as the fluid source. The fluid container may be a manually portable fluid container.

In some example aspects, the present disclosure provides an attachment for communication of fluid from a fluid source, the attachment may include: a body defining an attachment end and a distal end; a first fluid passage defined in the body for permitting fluid flow through the body at least to the distal end; and at least one valve engaging portion disposed on said body, in accessible relation with respect to the receiving end of the body, for operatively engaging a valve of the fluid source.

In some examples, the body may include an attachment end portion defining the attachment end and a movable end portion telescopically engaged on said attachment end portion, and wherein said valve engaging portion is disposed on said movable end portion, such that motion of the movable end portion towards the attachment end of the body causes said valve engaging portion to move to a valve opening position for opening the valve of the fluid source.

In some examples, the attachment may include a second fluid passage defined in the body for permitting fluid flow through the body at least from the distal end.

In some example aspects, the present disclosure provides a connection system that may include: a source connector having a fluid passage and a source connecting portion for connecting the source connector to a fluid source; a valve mechanism for controlling flow of fluid through the fluid passage; and a fluid transfer attachment having a fluid passage; wherein said source connector has an attachment-receiving portion for receiving and/or retaining the fluid transfer attachment; and wherein said valve mechanism is opened when said fluid transfer attachment is received by said attachment-receiving portion, to enable fluid communication between the fluid passage of the source connector and the fluid passage of the fluid transfer attachment.

In some example aspects, the present disclosure may provide a connection system that may include: a source connector having a fluid passage and a source connecting portion for connecting the source connector to a fluid source; a valve mechanism for controlling flow of fluid through the fluid passage; and a fluid transfer attachment having a fluid passage; wherein said source connector has an attachment-receiving portion for receiving and/or retaining the fluid transfer attachment; and wherein, subsequent to said fluid transfer attachment being received by said attachment-receiving portion, said valve mechanism is opened when at least a portion of said fluid transfer attachment is moved to a valve opening position, to enable fluid communication between the fluid passage of the source connector and the fluid passage of the fluid transfer attachment.

In some examples, the fluid transfer attachment may include a mounting end portion for being received by the attachment-receiving portion, and a movable end portion telescopically engaged on said mounting end portion, and wherein motion of the movable end portion towards the source connector causes the fluid transfer attachment to move to the valve opening position.

In some examples, the fluid transfer attachment may be movably mounted on said source connector, and wherein moving the fluid transfer attachment to the valve opening position comprises motion of the fluid transfer attachment towards the source connector.

In some example aspects, the present disclosure provides a portable container assembly that may include: a container having at least a fluid outlet; a valve mechanism for controlling flow of fluid through the fluid outlet; and a fluid transfer attachment having a fluid passage; wherein said container has an attachment-receiving portion for receiving and/or retaining the fluid transfer attachment; and wherein said valve mechanism is opened when said fluid transfer attachment is received by said attachment-receiving portion, to enable fluid communication between the fluid passage of the fluid transfer attachment and the container.

In some example aspects, the present disclosure provides a portable container assembly that may include: a container having at least a fluid outlet; a valve mechanism for controlling flow of fluid through the fluid outlet; and a fluid transfer attachment having a fluid passage; wherein said container has an attachment-receiving portion for receiving and/or retaining the fluid transfer attachment; and wherein, subsequent to said fluid transfer attachment being received by said attachment-receiving portion, said valve mechanism is opened when at least a portion of said fluid transfer attachment is moved to a valve opening position, to enable fluid communication between the fluid passage of the fluid transfer attachment and the container.

In some example aspects, the present disclosure provides a portable container for use with a fluid transfer attachment, the fluid transfer attachment including a fluid passage, said portable container may include: a container having at least a fluid outlet; and a valve mechanism for controlling flow of fluid through the fluid outlet; wherein said container has an attachment-receiving portion for receiving and/or retaining the fluid transfer attachment, and wherein said valve mechanism is opened when said fluid transfer attachment is received by said attachment-receiving portion, to enable fluid communication between the fluid passage of the fluid transfer attachment and the container.

In some example aspects, the present disclosure provides a portable container for use with a fluid transfer attachment, the fluid transfer attachment including a fluid passage, said portable container may include: a container having at least a fluid outlet; and a valve mechanism for controlling flow of fluid through the fluid outlet; wherein said container has an attachment-receiving portion for receiving and/or retaining the fluid transfer attachment; and wherein, subsequent to said fluid transfer attachment being received by said attachment-receiving portion, said valve mechanism is opened when at least a portion of said fluid transfer attachment is moved to a valve opening position, to enable fluid communication between the fluid passage of the fluid transfer attachment and the container.

In some example aspects, the present disclosure provides a connection system that may include, in combination, and for use in conjunction with a container: a quick disconnect connector and a non-valved attachment for opening a valve of the quick disconnect connector.

In some examples, the quick disconnect connector may include a dry break connector.

In some examples, the present disclosure provides a portable container assembly that may include: a container having at least a fluid outlet; a valve mechanism operatively mounted with respect to said fluid outlet for controlling flow of the fluid through the fluid outlet; and a valve actuation mechanism operatively mounted on said container for actuating the valve mechanism, the valve actuation mechanism including a trigger mechanism disposed remotely from said fluid outlet.

In some examples, the trigger mechanism may be disposed at a base portion of said container assembly.

In some examples, the portable container assembly may include a first handle disposed at a base portion of said container assembly.

In some examples, the portable container assembly may include a second handle disposed at an upper portion of said container assembly.

In some example aspects, the present disclosure provides a portable container assembly that may include: a container having at least a fluid outlet; at least one handle connected to said container; a valve mechanism operatively mounted with respect to said fluid outlet for controlling flow of the fluid through the fluid outlet; and a fluid transfer attachment having a fluid passage for fluid communication with the fluid outlet of the container.

In some examples, a valve actuation mechanism may be operatively mounted on said container for actuating the valve mechanism and may include a trigger mechanism disposed remotely from said fluid outlet.

In some example aspects, the present disclosure provides a portable fluid transfer system for receiving a fluid source having a first valve mechanism at a fluid outlet, and dispensing fluid from a fluid source, said portable fluid transfer system may include: a housing; a pump having an inlet and an outlet and mounted on said housing; a second valve mechanism operatively mounted with respect to said inlet of said pump; and a fluid transfer attachment disposed on at least one of said housing and said second valve mechanism in fluid communication with the inlet of said pump, for receiving a cooperating portion of said fluid source; wherein said first valve mechanism and said second valve mechanism are opened when said fluid transfer attachment receives said cooperating portion of said fluid source.

In some example aspects, the present disclosure may provide a portable fluid transfer system for receiving a fluid source having a first valve mechanism at a fluid outlet, and dispensing fluid from a fluid source, said portable fluid transfer system may include: a housing; a pump having an inlet and an outlet and mounted on said housing; a second valve mechanism operatively mounted with respect to said inlet of said pump; and a fluid transfer attachment disposed on at least one of said housing and said second valve mechanism in fluid communication with the inlet of said pump, for receiving a cooperating portion of said fluid source; wherein in use, said cooperating portion of said fluid source is received by said fluid transfer attachment such that said first valve mechanism and said second valve mechanism are in fluid communication one with the other.

In some examples, the portable fluid transfer system may include a valve opening mechanism for selectively opening at least one of said first valve mechanism and said second valve mechanism. In some examples, a fluid transfer system may also be considered a fluid exchange system.

BRIEF DESCRIPTION OF THE DRAWINGS

Reference is made to the drawings, which show by way of example embodiments of the present disclosure, and in which:

FIGS. 70-72 are cross-sectional views of the connectors of FIG. 68 illustrating how they mate and operate together;

Throughout the appended drawings, like features are identified by like reference numerals.

DETAILED DESCRIPTION

Figure 1A:
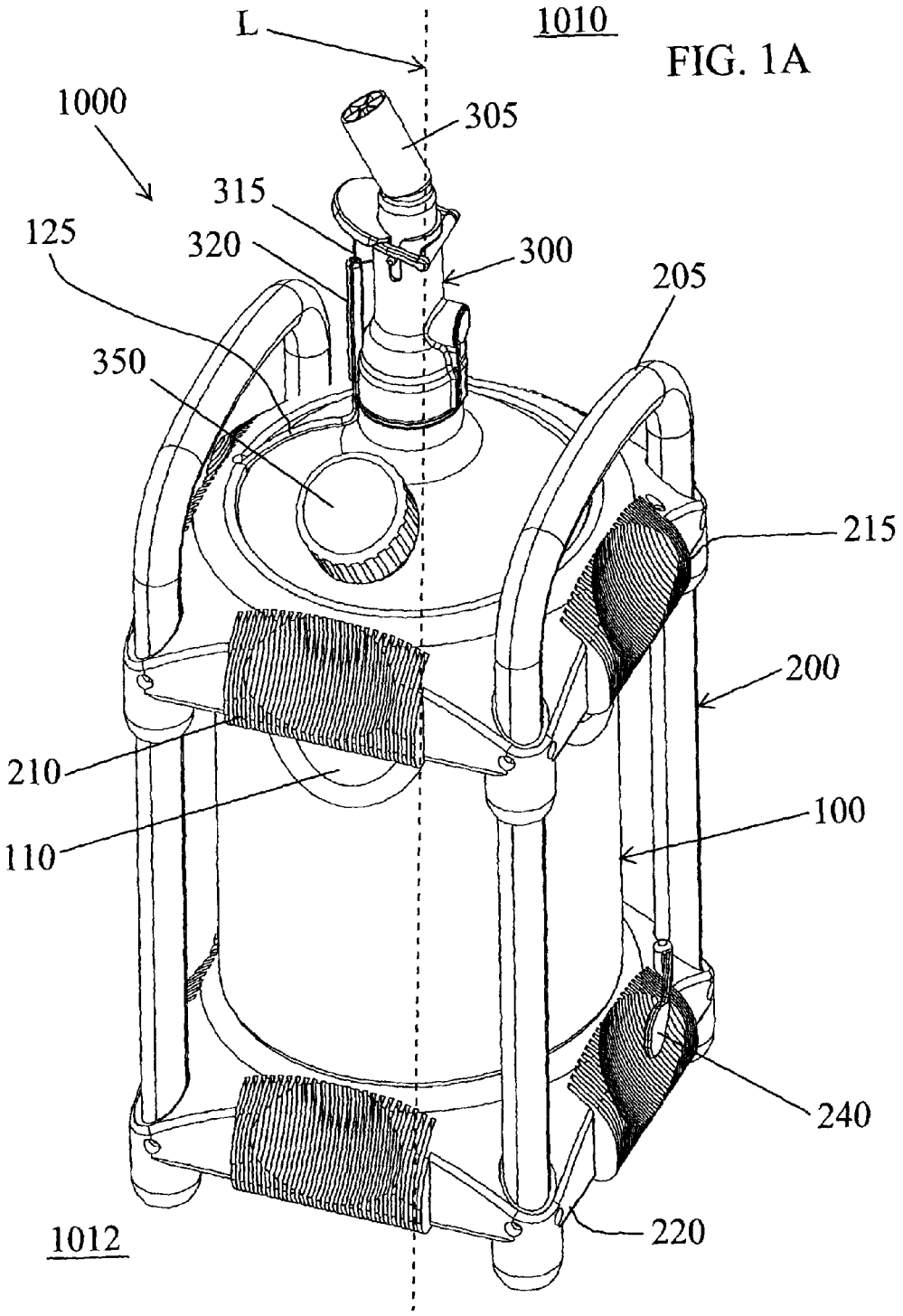
FIGS. 1A and 1B are isometric views of an example portable fluid container assembly.

The present disclosure describes examples of a portable fluid container assembly, a portable fluid container, and components thereof. Throughout this disclosure, it should be understood that many features described with respect to a container may also apply to a container assembly and vice versa.

The portable fluid container assembly may provide one or more of: a container with or without a permeation barrier treatment; an enclosure or frame attachable to the container or container assembly, where the enclosure or frame may include one or more handles (which may be conveniently located for a user to maneuver the container assembly), and where the enclosure or frame may provide features for joining two or more container assemblies together (e.g., for transport and/or added stability); a dispenser (e.g., an attachment, a fluid transfer attachment, a pouring spout or other suitable means), which may be an openable and closeable dispenser (e.g., having a removable cap or a controllable valve) which may provide passive vapor recovery features; at least one remotely-located trigger for controlling the flow rate of fluid from the container assembly (e.g., by controlling operation of the dispenser, such as by controlling opening and closing of a dispenser cap or valve) and to help prevent unintentional spillage; and a separate opening for filling the assembly.

This separate opening may be useful in avoiding the need to replace or remove a dispenser (e.g., a spout) from a shared filling/dispensing opening when switching between filling and dispensing use. This may help to reduce contamination of the user's hand with the contained liquid (e.g., fuel) from handling a dispenser and may also help to reduce the introduction of contamination into the container itself, which can occur when a dispenser is removed and replaced. For example, during the refueling process of a conventional container, a dispenser is typically removed from the opening in order to allow filling of the container, and the dispenser may be set down on a convenient but potentially dirty surface. The dispenser may pick up contaminants and when replaced on the container (e.g., in preparation for dispensing from the container), any contaminant (e.g., dirt) on the dispenser may be introduced into the container and may thus contaminant the fluid contained within.

In some examples, this separate opening may be designed to help accommodate conventional vapor recovery dispenser systems (e.g., when filling the container with a conventional vapor recovery nozzle, such as at a gas station).

In some examples, a portable fluid container assembly may include an inner body for retaining a fluid, the inner body defining at least one opening for at least one of receiving and dispensing fluid; an enclosure at least partially enclosing the inner body, the enclosure including at least one handle for manipulating the assembly; and a cover for closing the at least one opening of the inner body, the cover may include at least one of a dispenser for dispensing fluid and a valve mechanism for controlling and regulating the flow of fuel either to or from the assembly. In some examples, the dispenser may be a dispensing tube or tubes for directing the flow of fluid from the portable fluid container assembly. In some examples, the dispenser may include a valve mechanism for controlling, regulating and directing the flow of fuel from the container.

In some examples, a portable fluid container assembly may include an inner body for retaining a fluid, the inner body defining at least one opening for at least one of receiving and dispensing fluid; and an enclosure at least partially enclosing the inner body, the enclosure including at least one handle for manipulating the assembly. The portable fluid container assembly may include a cover for closing the at least one opening of the inner body, the cover including a dispenser for dispensing fluid.

In some examples, the cover may include at least one closeable cover opening for receiving fluid.

In some examples, the assembly may include a trigger for controlling fluid flow from the dispenser, the trigger being remotely located from the dispenser.

In some examples, the assembly may include at least one mating member, which may include at least one interlocking or registration/locating feature (e.g., a projection and complementary recess), on the enclosure for joining the assembly to at least one other assembly.

In some examples, the enclosure may include at least one window for viewing the inner body (e.g., to view the presence and/or level of any liquid contained inside and/or to view the color of the inner body).

In some examples, the assembly may include at least one wheel attached or attachable to the enclosure for transporting the assembly.

In some examples, the inner body may be blow-molded or rotation molded.

In some examples, such as where the inner body is blow-molded or rotation molded, the inner body may be formed without any handles. Such a configuration may simplify the manufacturing process. One or more handles for maneuvering the assembly may be provided by the enclosure.

In some examples, such as where the inner body is blow-molded or rotation molded, the inner body may have a curved base. Such a configuration may simplify the manufacturing process. The enclosure may provide a base for supporting inner body in an upright position when the assembly is upright.

In some examples, the enclosure may form a stackable surface for stacking the assembly with at least one other assembly. This may be useful where the inner body has rounded or irregular surface(s) that render the inner body difficult or impossible to stack with other inner bodies.

In some examples, the enclosure may be colored and the inner body may be uncolored. This may allow the inner body to be molded with a colorless material, which may simplify the manufacturing process and/or reduce manufacturing costs, while still complying with regulations requiring color identification of the assembly.

The present disclosure also describes methods of manufacture. In some examples, a method for manufacturing a portable fluid container assembly includes providing an inner body for retaining a fluid, the inner body being formed without any handles; and attaching an enclosure to the inner body, the enclosure at least partially enclosing the body and including at least one handle for manipulating the assembly.

In some examples, the inner body may be blow-molded or rotation molded.

In some examples, the enclosure may be snap-fitted or welded to the inner body.

In some examples, the present disclosure may provide a modular frame for a portable container, said modular frame comprising: a plurality of like frame members connectable one to another to form a full frame; wherein each frame member comprises a main body, a first connector and a second connector; and said first connector and said second connector are disposed in substantially opposed relation one from the other on said main body.

In some examples, each said frame member may be integrally formed as a single piece of material.

In some example aspects, the present disclosure may provide a modular frame for a portable container, said modular frame may include: a plurality of like frame members securable one to another to form a full frame; wherein each frame member comprises a main body; and wherein said plurality of like frame members are securable one to the other to form said full frame.

In some examples, each said frame member may be integrally formed as a single piece of material.

In some example aspects, the present disclosure may provide a cap for use with a portable container, said cap may include: a body; a first opening defined in said body; a valve mechanism for controlling flow of fluid through the first opening; a spout having a first fluid passage in fluid communication with said first fluid passageway; and a second opening defined in said body.

In some example aspects, the present disclosure provides a frame for use with a container of a portable container assembly, said frame may include: a main body having a longitudinal axis and defining an internal opening for receiving said container therein; at least one handle; at least one support portion at each longitudinal end of the main body; wherein the support portions at each longitudinal end of the main body provide support surfaces at each longitudinal end of the main body to enable stacking of a plurality of said portable container assemblies along the longitudinal axis.

In some example aspects, the present disclosure provides a frame for use with a container of a portable container assembly, said frame may include: a main body having a top end and a bottom end and defining an internal opening for receiving said container therein; at least one handle for permitting manual manipulation of said portable container assembly; at least one upwardly facing support portion; and at least one downwardly facing support engaging portion; wherein said at least one upwardly facing support portion and said at least one downwardly facing support engaging portion are horizontally aligned with one another, when each portable container of a plurality of stacked portable containers is vertically oriented, to permit stacking of a plurality of said portable container assemblies in top-to-bottom relation one on another.

In some example aspects, the present disclosure may provide a frame for use with a container of a portable container assembly, said frame may include; a main body having a lateral axis and defining an internal opening for receiving said container therein; at least one handle; at least one laterally facing support portion; and at least one laterally facing support engaging portion; wherein said at least one laterally facing support portion and said at least one laterally facing support engaging portion are aligned with one another, to enable stacking of a plurality of said portable container assemblies along the lateral axis.

In some example aspects, the present disclosure provides a frame for use with a container of a portable container assembly, said frame may include: a main body having a top end and a bottom end and defining an internal opening for receiving said container therein; at least one handle for permitting manual manipulation of said portable container assembly; at least one laterally facing support portion; and at least one laterally facing support engaging portion; wherein said at least one laterally facing support portion and said at least one laterally facing support engaging portion are horizontally aligned with one another, when each portable container of a plurality of stacked portable containers is horizontally oriented, to permit stacking of a plurality of said portable container assemblies in side-to-side relation one on another.

In some example aspects, there is provided a portable container assembly comprising: a container; a frame mounted to the container, and having a longitudinal axis; a stabilizing protrusion oriented to protrude generally transversely to the longitudinal axis of the frame; and a cooperating recess for receiving the stabilizing protrusion of an adjacent similar portable container assembly, to thereby stabilize the two portable container assemblies.

In some examples, the cooperating recess may receive the stabilizing protrusion of the adjacent portable container assembly in horizontally insertable relation.

In some examples, the stabilizing protrusion may include one or more mating, complementary or interlocking fingers or fins.

Examples of the present disclosure are now described with reference to the drawings.

Figure 1B:
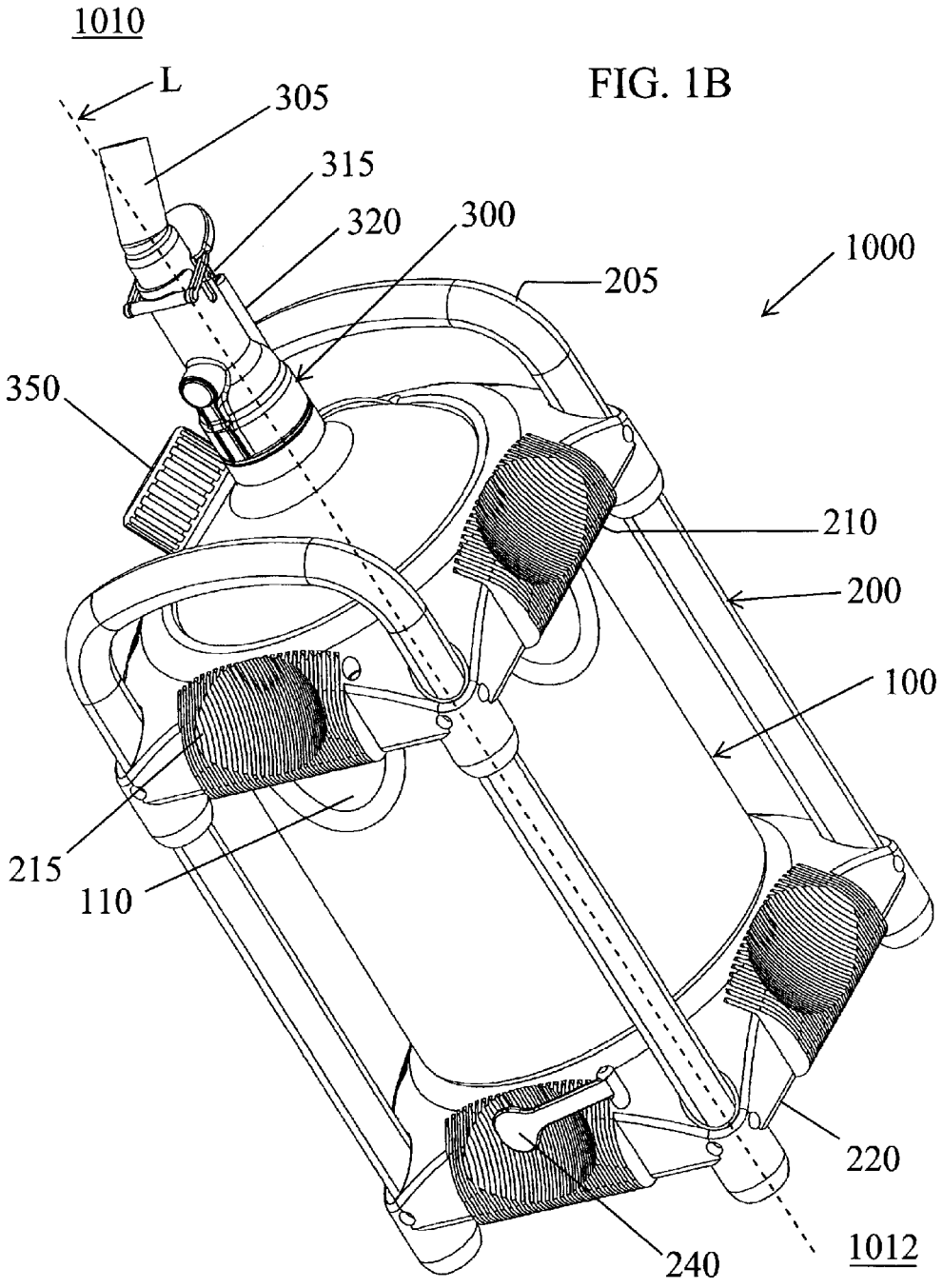

FIGS. 1A and 1B show an example of a portable fluid container assembly 1000 having a top end 1010 and a bottom end 1012 when the assembly 1000 is in an upright orientation, and defining a longitudinal axis "L". In this example, the portable fluid container assembly 1000 may include a container or an inner body 100 for containing a fluid and an outer frame or enclosure 200 at least partially enclosing the inner body 100.

Figure 2:
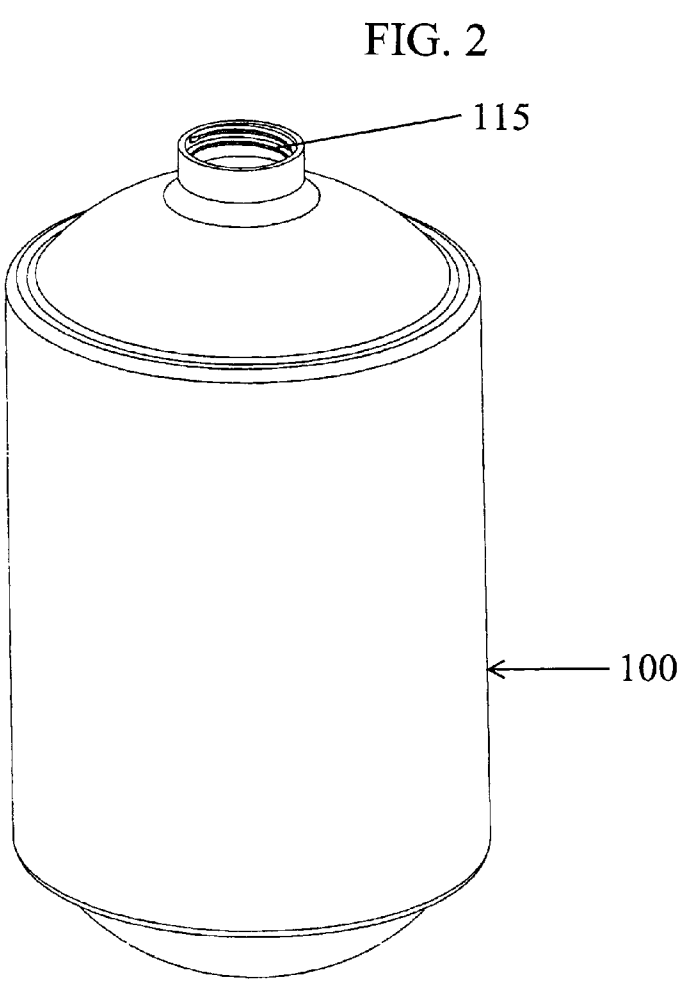
FIG. 2 is an isometric view of an example inner container suitable for the portable fluid container assembly of FIG. 1.
Figure 3:
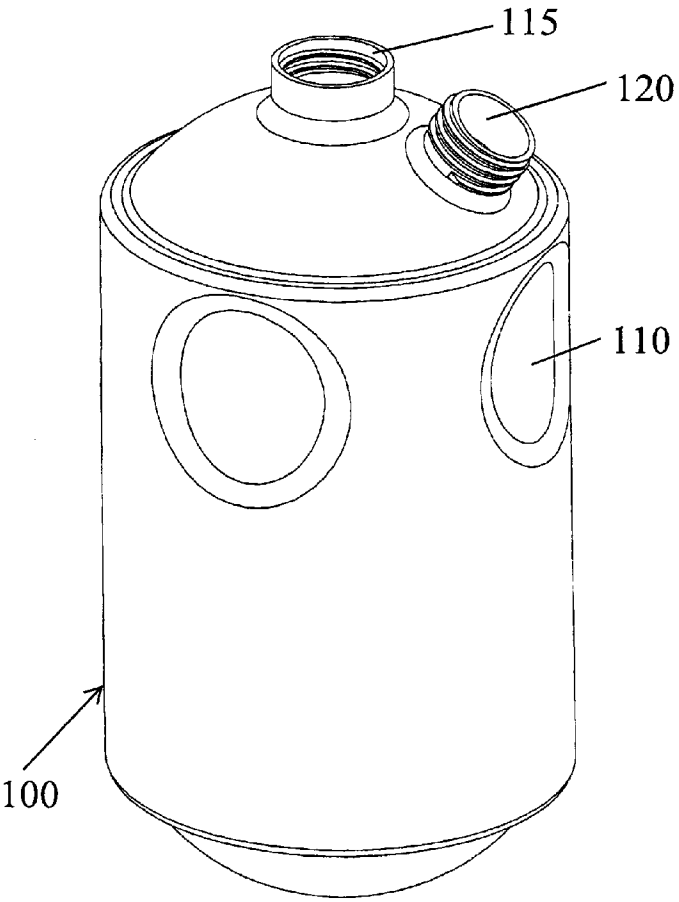
FIG. 3 is an isometric view of another example inner container suitable for the portable fluid container assembly of FIG. 2.

The inner body 100 may include one or more openings (not shown) for receiving and dispensing fluid. In some examples, the inner body 100 may include one or more indentations 110 to enable gripping by a user (for example, as shown in FIG. 3), while other examples may not include any indentations 110 (for example, as shown in FIG. 2). The inner body 100 may be made of any suitable material, for example a moldable plastic.

The inner body 100 may be a shape designed to avoid or decrease deformation of the inner body 100 as vapor pressure within the inner body 100 changes (e.g., increase or decrease of temperature may cause respective increase or decrease of vapor pressure, particularly where the fluid is a volatile fluid, such as a fuel). For example, the inner body 100 may have a cylindrical shape. In some examples, the inner body 100 may also include a rounded base. In some examples, the inner body 100 may include a concave or dished base, which may be convenient for a user's hand when tipping the assembly 1000, for dispensing fluid, for example. In some examples, the concave shape of the base may facilitate the stacking of container assemblies 1000 one on top of the other. For example, in two assemblies stacked one on top and one on the bottom, the concave shape of the base of the assembly 1000 on top may help to accommodate the cover or spout of the container assembly 1000 on the bottom.

The inner body 100 may be formed using, for example, molding processes such as blow-molding or rotational molding. The inner body 100 may be manufactured without handles, which may simplify the molding process and/or avoid wasted material during molding compared to conventional containers. The inner body 100 may be manufactured without concern that the inner body 100 has to support itself in an upright position, since the enclosure 200 may serve to support the inner body 100 in an upright position. Thus, the shape of the inner body 100 (e.g., a cylindrical shape with a rounded base) may be relatively easy to manufacture using, for example, blow-molding techniques.

Because the inner body 100 is provided with an enclosure 200, which may enclose all or a majority of the inner body 100, the inner body 100 may be manufactured with relatively few additives (e.g., pigments and/or UV protectors, according to safety regulations, for example), with the enclosure 200 instead providing any suitable color coding and/or UV protection, as appropriate, for example.

The enclosure 200 may include one or more members that at least partially surround the inner body 100 and that may form one or more handles 205 for the portable fluid container assembly 1000. The enclosure 200 may also include one or more grips 210 that may cooperate with one or more respective indentations 110 to allow a user's hand to grip the portable fluid container assembly 1000, for example to enable transport or manipulation of the assembly 1000. The frame or enclosure 200 may also interconnect so as to be rigidly connected via one or more mating members 215, to enable two or more assemblies 1000 to be joined. The mating member(s) 215 of the assembly 1000 may include fingers, fins or protrusions designed to interlock or mate with complementary finger(s), fin(s) or protrusion(s), and/or complementary recess(es) in another assembly 1000. It should be understood that the mating member(s) 215 need not exactly match or mate with a corresponding feature on the other assembly 1000. For example, the mating member(s) 215 may loosely fit with a recess or complementary mating member(s) 215 of the other assembly. The mating member(s) 215 may join two or more assemblies 1000 together loosely (e.g., enabling some sliding or shifting relative to each other), but not necessarily in fixed relation. The mating member(s) 215 may be provided on more than one side of the enclosure 200 to enable joining of assemblies 1000 in multiple directions.

Figure 4B:
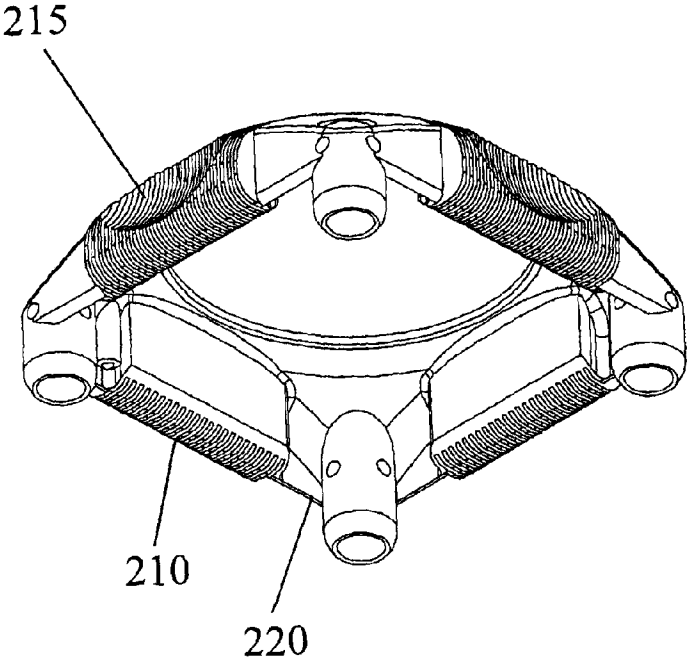
FIGS. 4A and 4B are an isometric views of an example of a portion of a frame suitable for the portable fluid container assembly of FIG. 1.
Figure 4A:
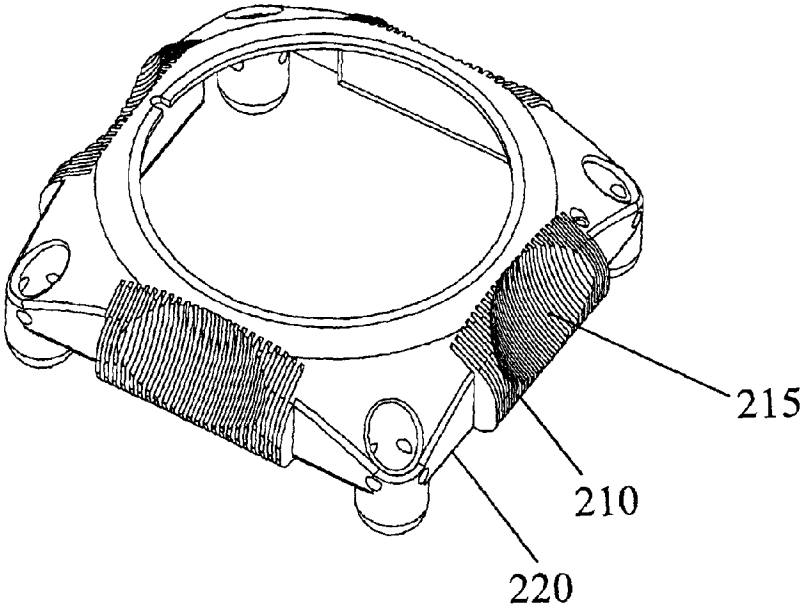
Figure 5:
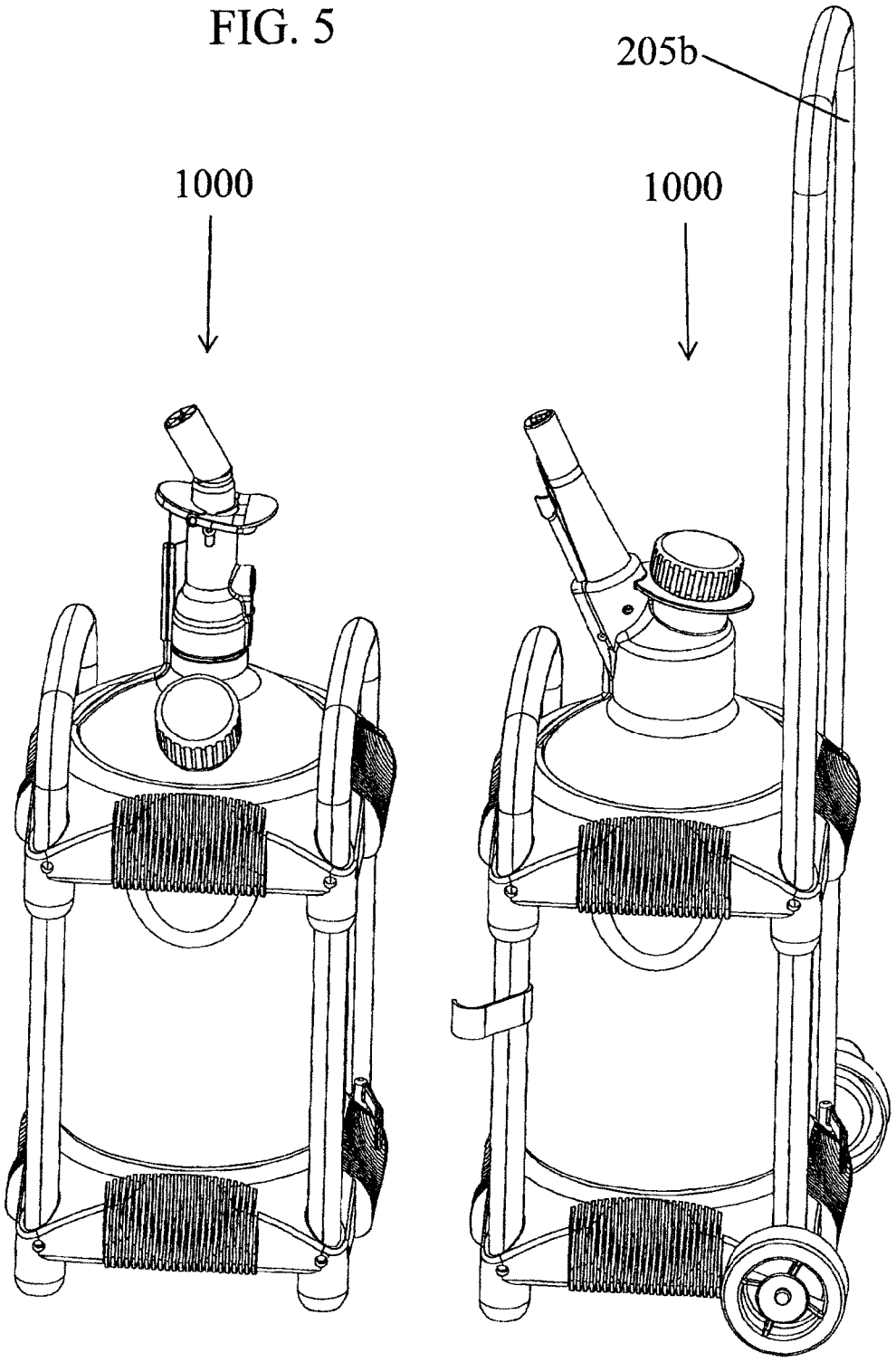
FIG. 5 illustrates two portable fluid container assemblies that may be coupled together.
Figure 6:
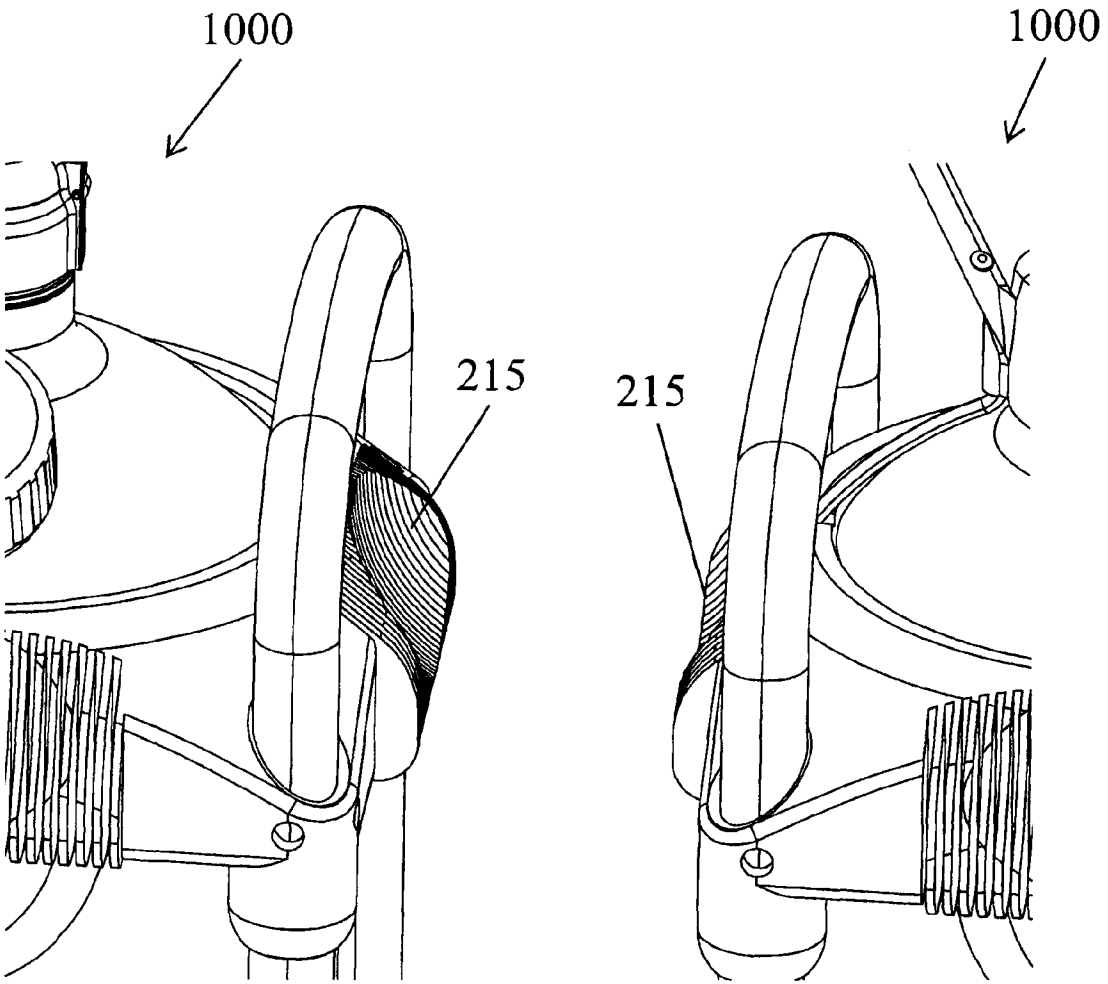
FIGS. 6 and 7 are detailed views of example mating members of two portable fluid container assemblies for coupling the assemblies together.
Figure 7:
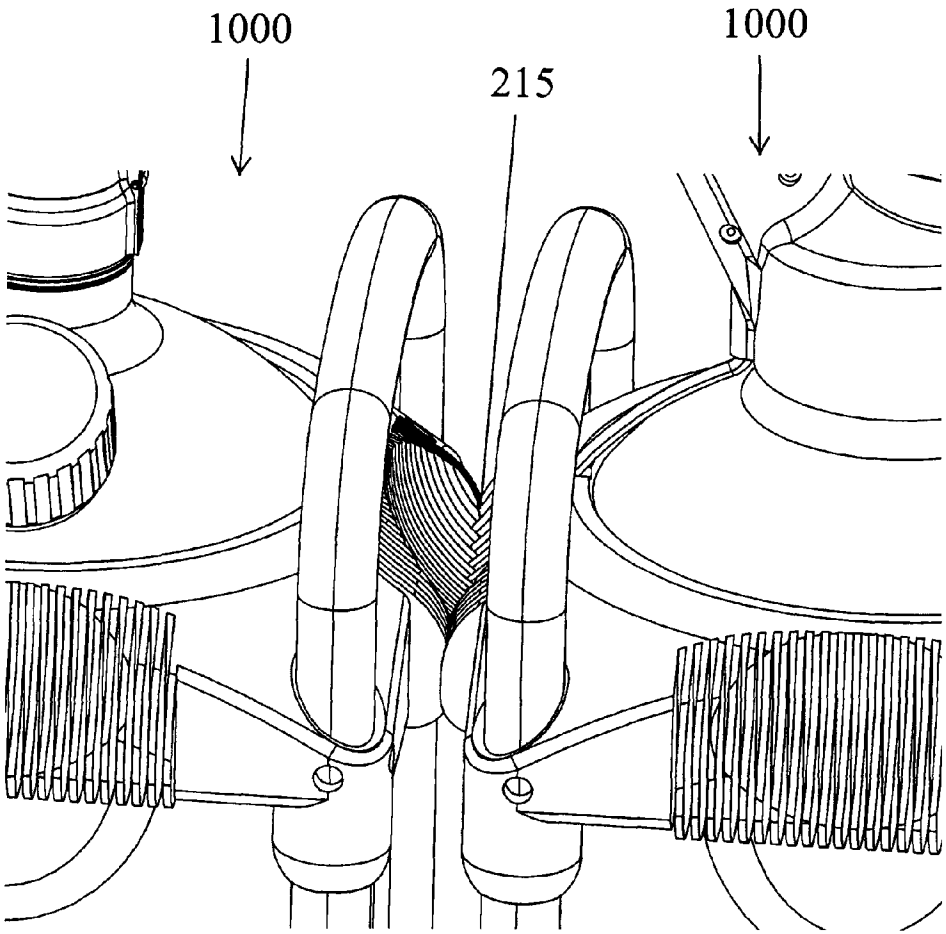
Figure 8:
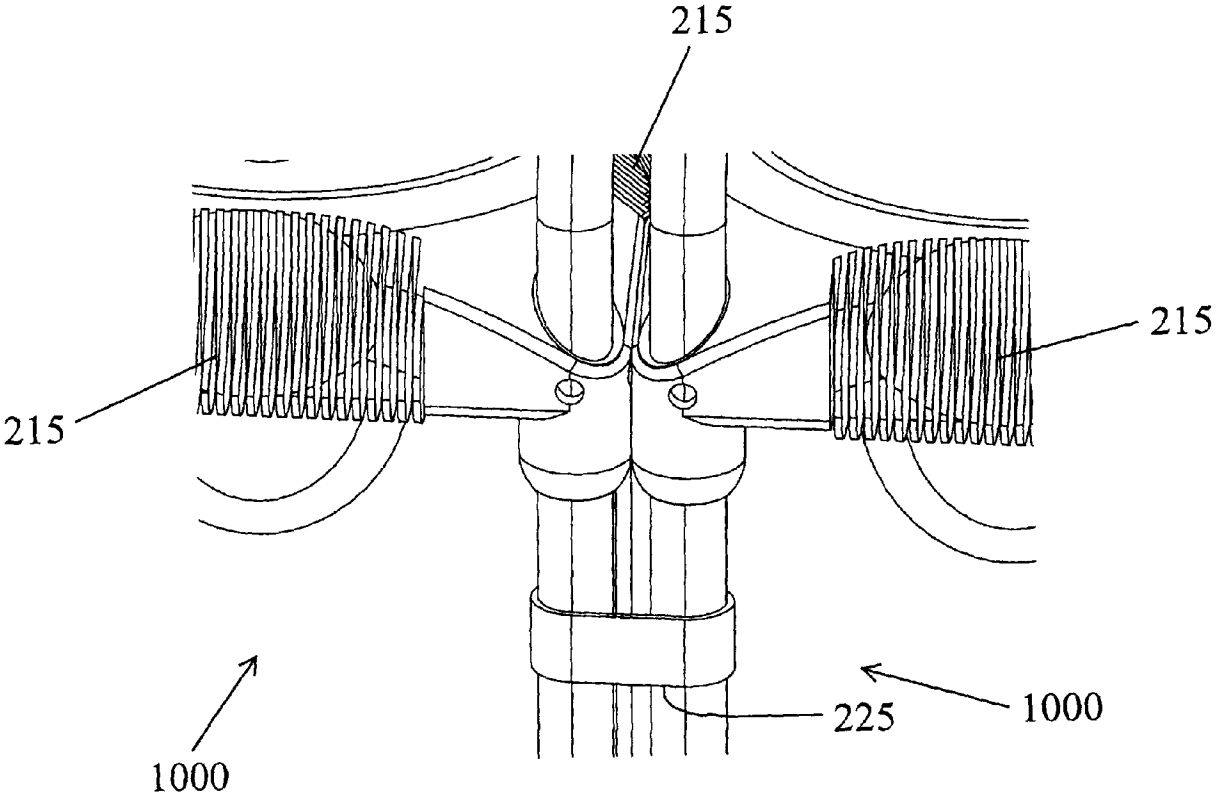
FIGS. 8 and 9 are detailed views of an example connector for coupling two portable fluid container assemblies together.
Figure 9:
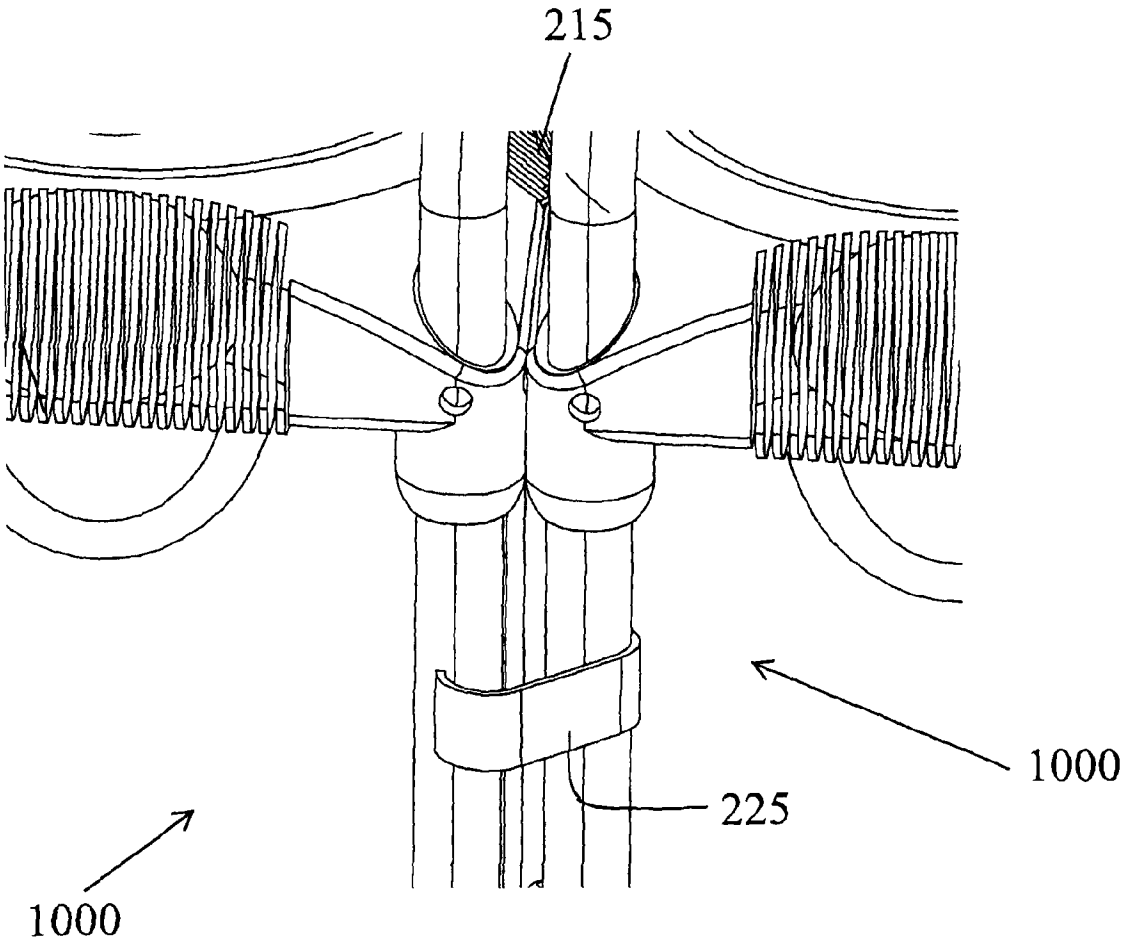

The enclosure 200 may be made of any suitable material, for example a metal (e.g., aluminum) or plastic material. The enclosure 200 may be manufactured as a single piece (integrally formed) or may be assembled from multiple components. For example, the enclosure 200 may include one or more frames 220 (for example, as shown in FIGS. 4A and 4B) that cooperate with one or more handles 205. The enclosure 200 may be assembled from such components at a manufacturer and may not be disassembled by a consumer, for example. In some examples, different frames 220 and handles 205 may be mixed and matched to suit different applications (e.g., different features, colors, materials, sizes, etc.).

The enclosure 200 may be designed to be fitted about the inner body 100 at a manufacturer and not to be removed by a consumer, for example to comply with safety regulations. In some examples, the enclosure 200 may be permanently attached to the inner body 100. For example, the enclosure 200 may be snap-fitted over the inner body 100, or the enclosure may be screwed or welded onto the inner body 100, as appropriate. Where appropriate, the enclosure 200 may include features to comply with safety regulations (e.g., warnings, manufacturer's information, color coding, etc.). For example, the inner body 100 may be manufactured without pigments (e.g., may be white) while the enclosure may be entirely or partially colored according to safety regulations (e.g., red to indicate gasoline is contained, yellow to indicate a diesel fluid is contained, or blue to indicate a kerosene fluid is contained).

Figure 30:
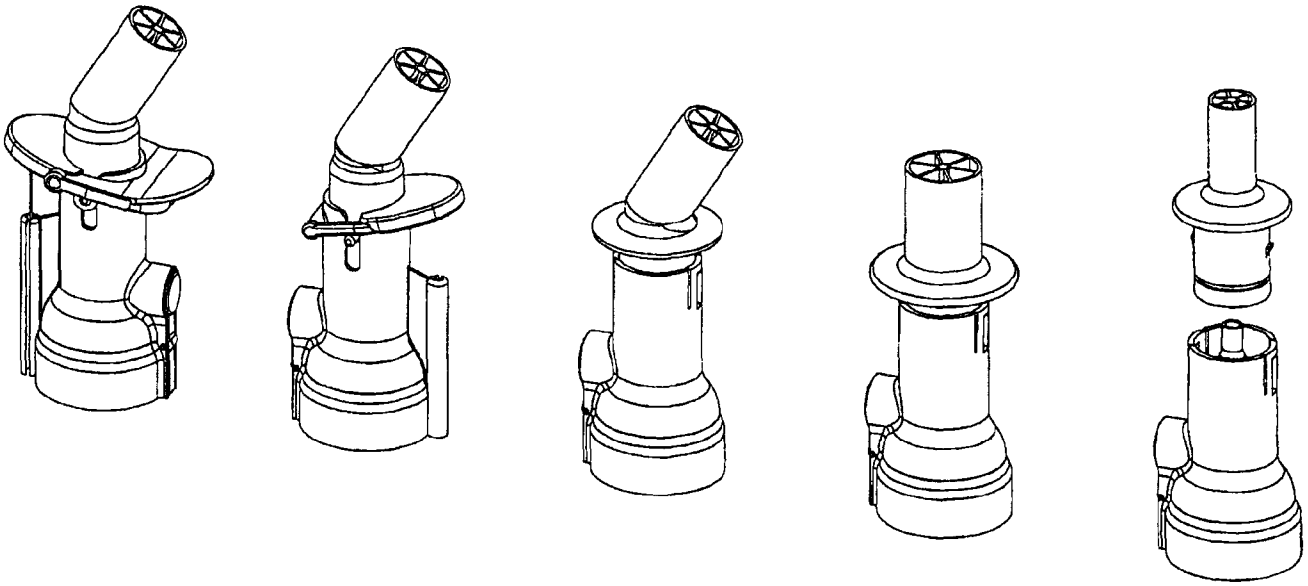
FIG. 30 are isometric view of examples of dispenser attachments that may be provided on the disclosed spouts.

The assembly 1000 may include a cover 300 for at least one opening 115 of the inner body 100. In the example of FIGS. 1A and 1B, the cover 300 may include a dispensing portion, such as a spout 305, which may include a variety of interchangeable spouts or spout tips, for example as shown in FIG. 30 and as described elsewhere in the present disclosure, for dispensing fluid from the container. The assembly 1000 may also include a second cover 350 for at least one other opening 120 of the inner body (see FIG. 3). The opening 120 may be designed to fit a conventional fluid dispenser, such as a conventional commercial fuel dispenser (e.g., as provided at a gas station). The use of two covers 300, 350 may be suitable where the inner body 100 has separate openings 115, 120 for separately receiving and dispensing fluid, for example as shown in FIG. 3. Where the inner body 100 includes a single opening 115 for both receiving and dispensing fluid, for example as shown in FIG. 2, a second cover 350 may not be needed.

Figure 13:
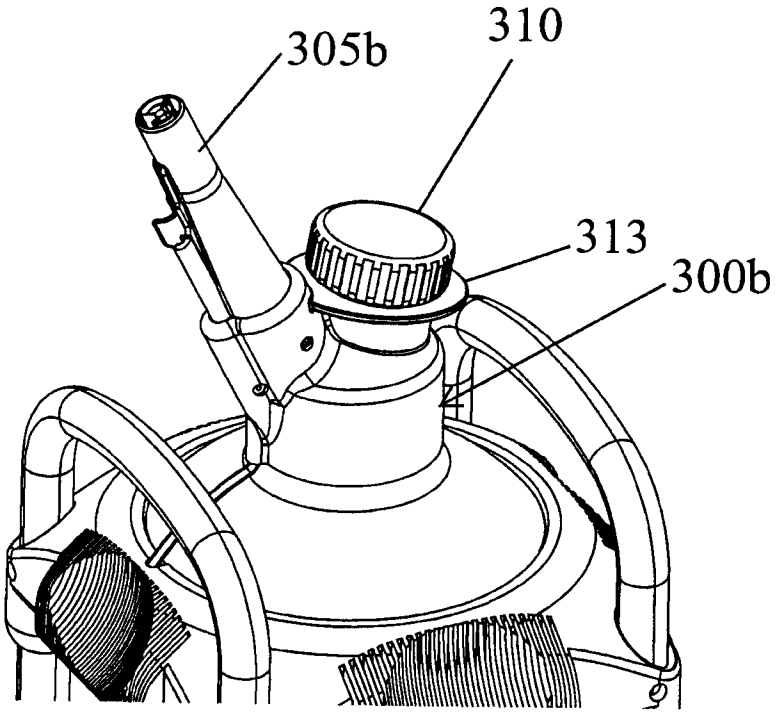
FIG. 13 is a detailed view of an example opening cover suitable for the portable fluid container assembly of FIG. 1.
Figure 14:
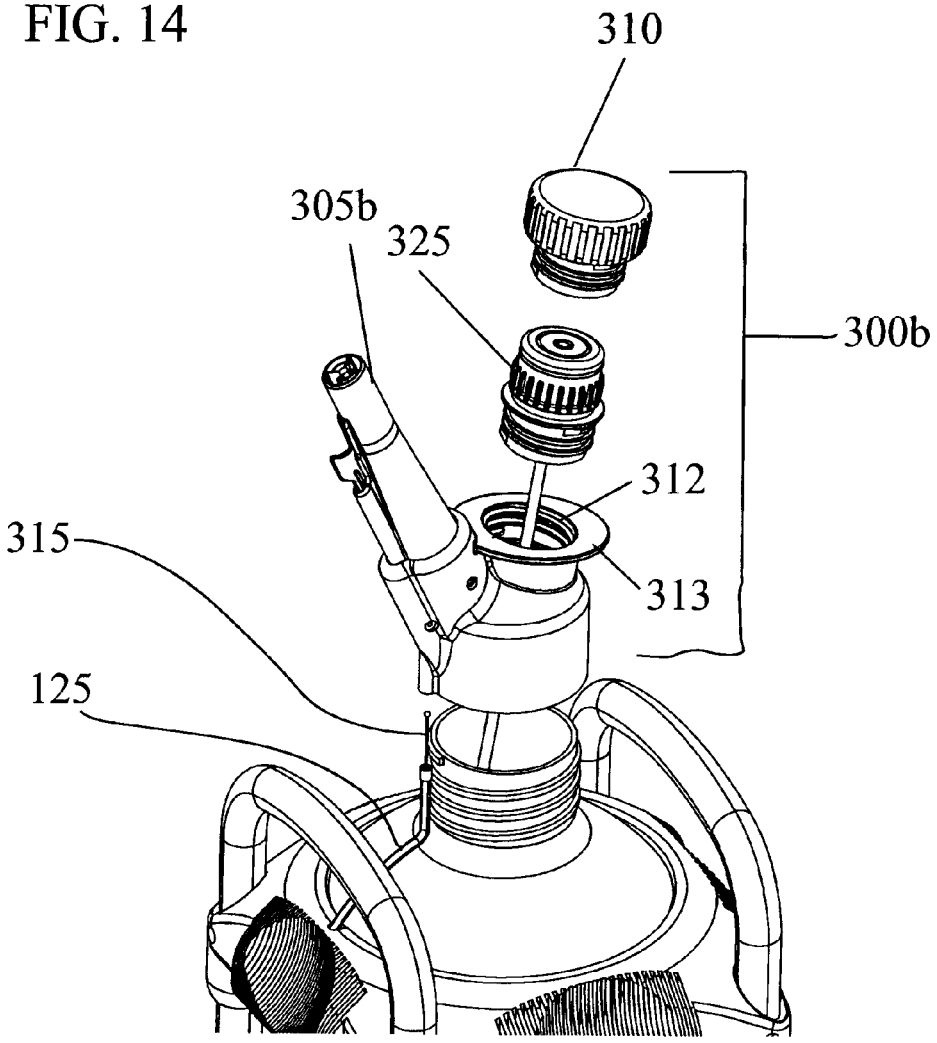
FIG. 14 is an exploded view of the opening cover of FIG. 13.
Figure 15B:
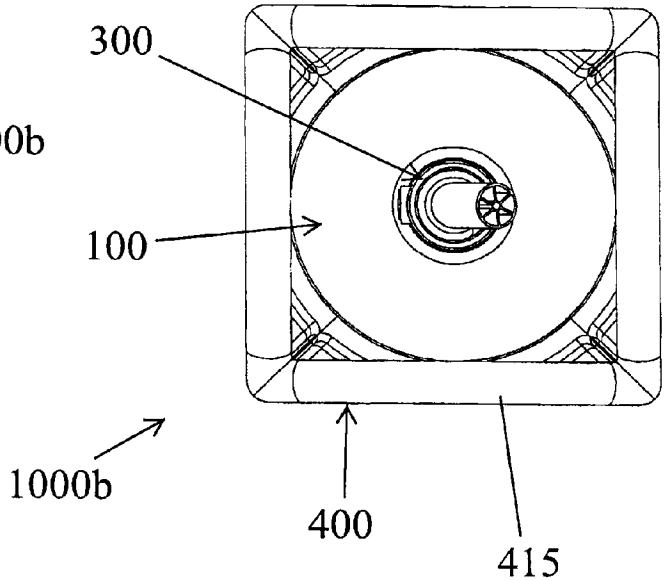
FIGS. 15A-15C are isometric views and a top view of another example portable fluid container assembly.
Figure 15A:
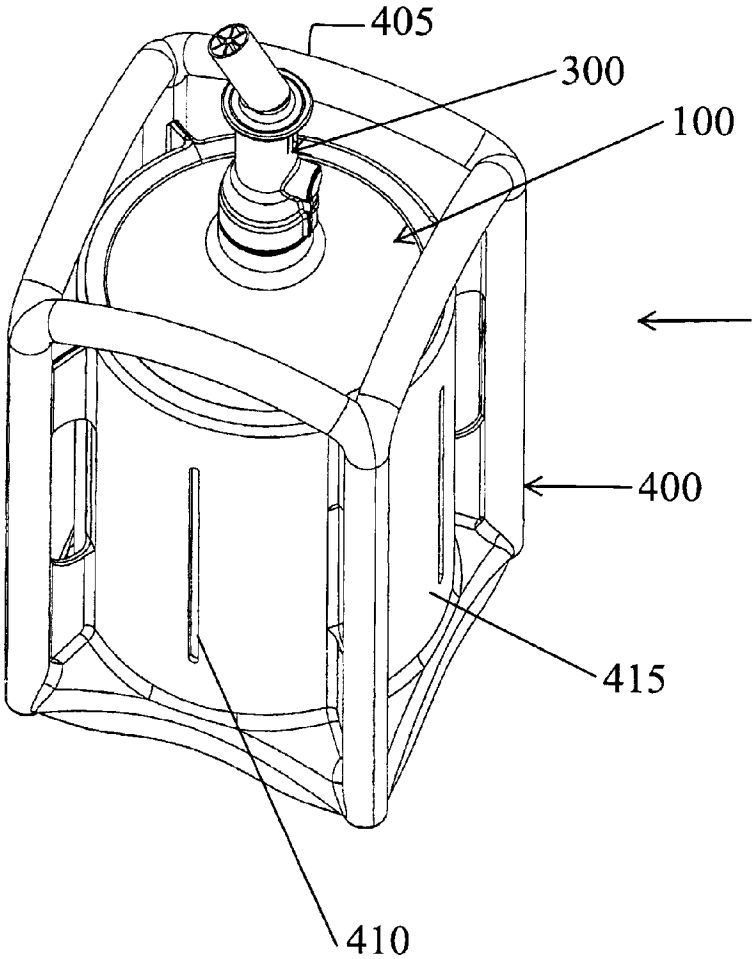
Figure 15C:
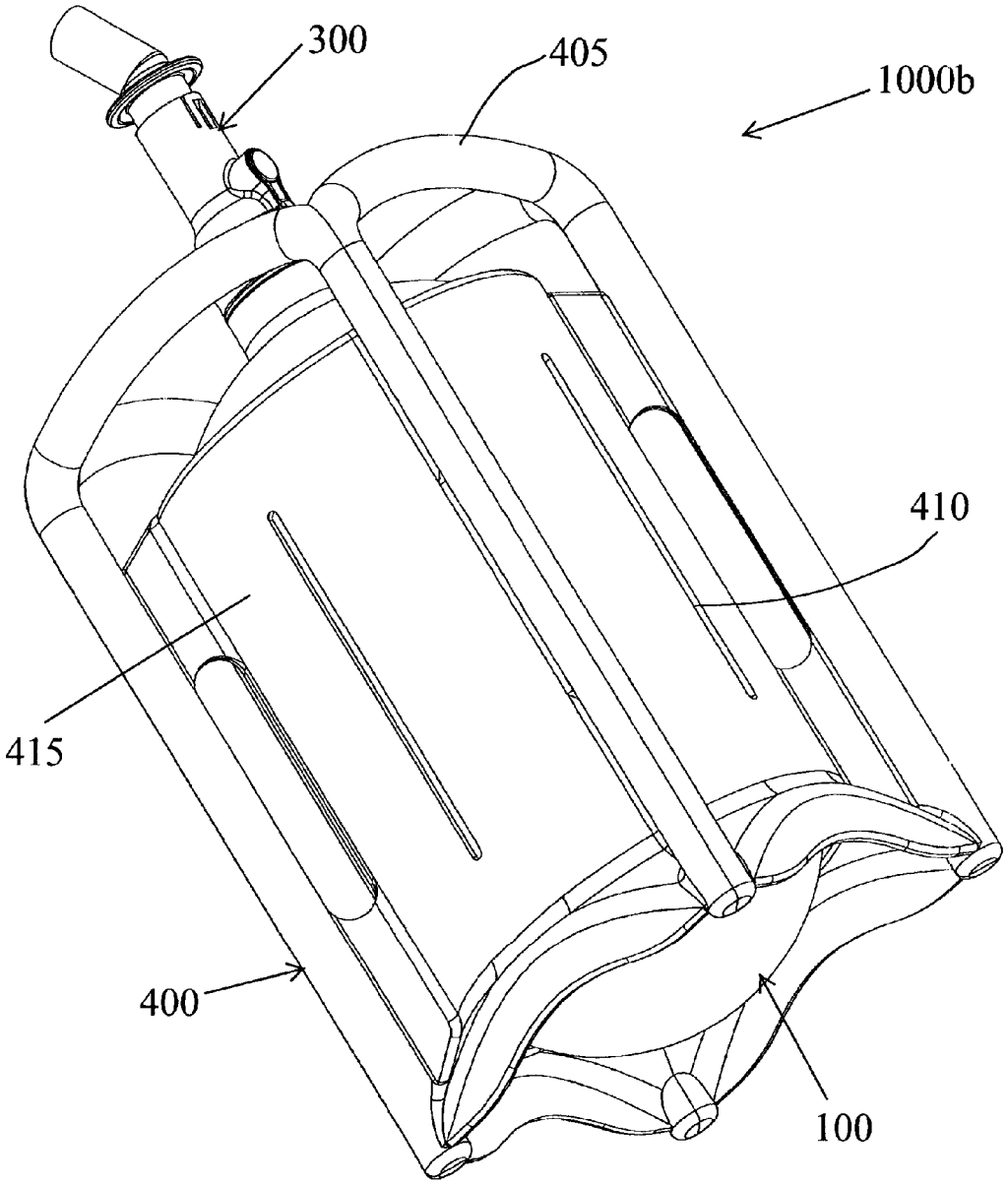
Figures 16, 17:
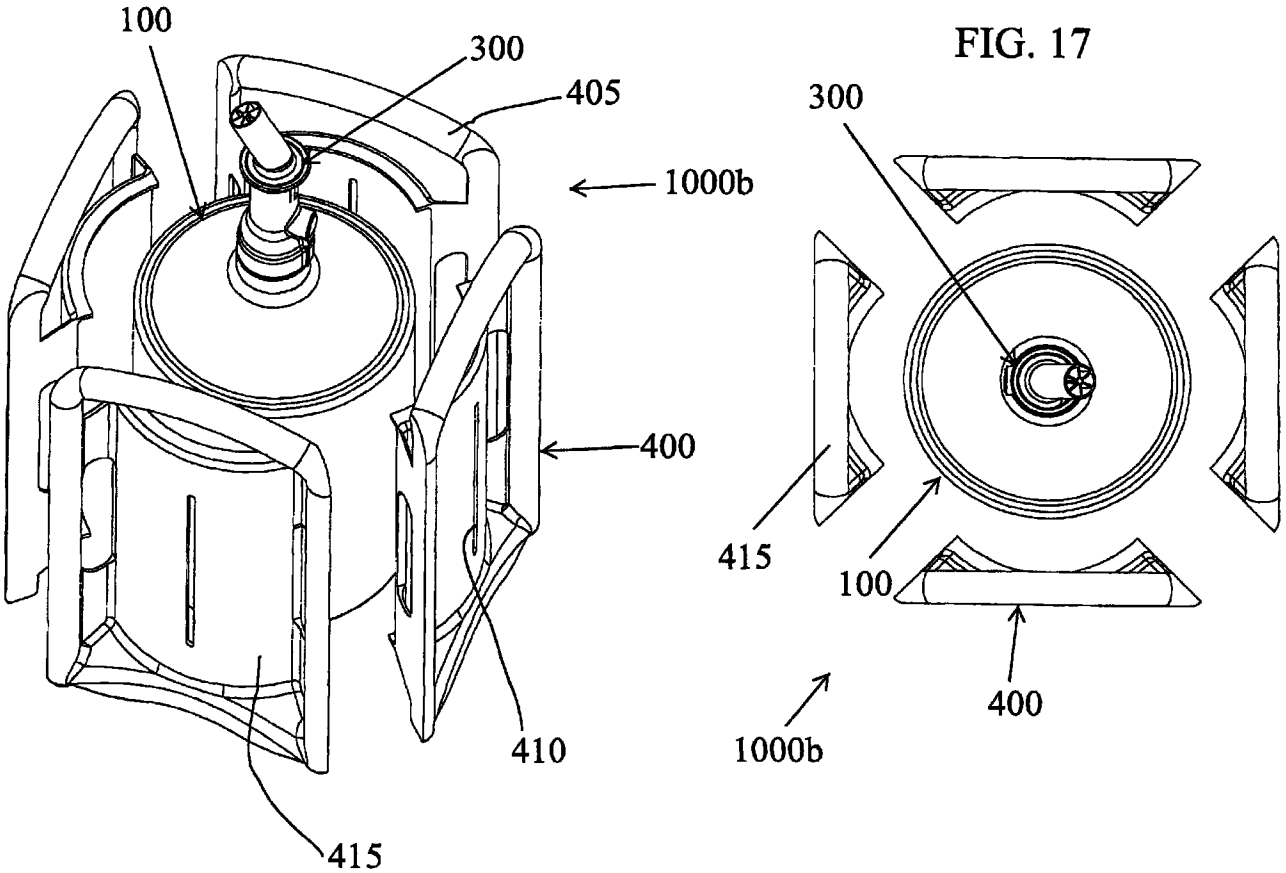
FIG. 16 is an isometric view of the portable fluid container assembly of FIGS. 15A-15C, unassembled.
FIG. 17 is a top view of the portable fluid container assembly of FIGS. 15A-15C, unassembled.
Figure 18:
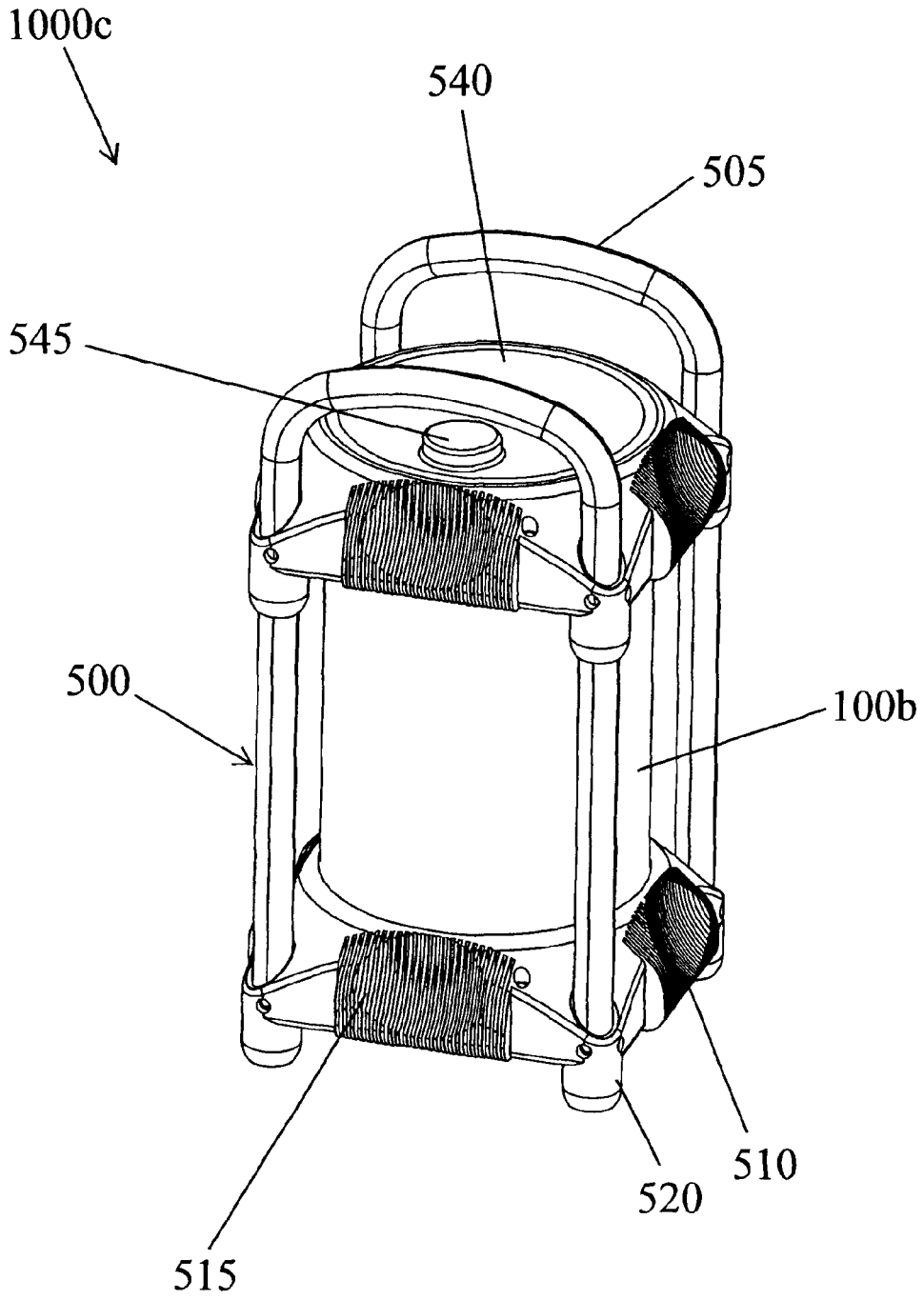
FIG. 18 is an isometric view of another example portable fluid container assembly.

FIGS. 13 and 14 illustrate another example cover 300*b*. The cover 300*b* may include a dispensing portion, such as a spout 305*b* similar to the spout 305, for dispensing fluid from the container. The cover 300*b* may also include a cap 310 which may be positionable over an opening 312 in the cover 300 to prevent fluid from escaping from the opening 312. By providing an opening 312 and a cap 310 on the cover 300*b*, a single cover 300*b* may be used where the inner body 100 includes a single opening 115 for both receiving and dispensing fluid, for example as shown in FIG. 2, while still providing the ability to both dispense fluid (e.g., through the spout 305*b*) and receive fluid (e.g., through the opening 312) without having to remove the spout or entire cover 300*b* which as discussed above may lead to contamination.

The opening 312 may be designed to fit a conventional fluid dispenser, such as a conventional commercial fuel dispenser (e.g., as provided at a gas station). In some examples, the cover 300*b* may include an extended flat surface 313 surrounding the opening 312. The flat surface 313 may complement or mate with the vapor recovery inlet of a conventional commercial fuel dispenser, in order to help provide a more effective recovery of vapor during the refueling process.

In some examples, the cover 300, 300*b* may be fixed over the opening 115 of the inner body 100, for example by a manufacturer, and may not be removable by a consumer. For example, the cover 300, 300*b* may be permanently fixed over the opening. In some examples, the cover 300, 300*b* may be removable (e.g., by a manufacturer) to be reused with multiple inner bodies 100, or to be replaced by other covers. In some examples, the cover 300, 300*b* may be removable by a consumer (e.g., the cover 300, 300*b* may be screwed onto the opening of the inner body 100).

The portable fluid container assembly 1000 may be designed to container different amounts of fluids, as suitable. For example, the inner body 100 may be designed to contain 4 gallons (about 15.14 L) or 2 gallons (about 7.57 L), similar to conventional portable fuel containers. The components of the enclosure 200 may be suitably compatible and/or the size of the enclosure 200 may be suitably adjusted to fit different sizes of inner bodies 100.

The portable fluid container assembly 1000 may be configured to allow two or more such assemblies 1000 to be fastened or joined together, which may facilitate transport of two or more assemblies 1000. FIGS. 5-9 illustrate an example of how such assemblies 1000 may be fastened together. As illustrated in greater detail in FIGS. 6 and 7, two or more assemblies 1000 may be brought together (e.g., side-by-side) by matching up respective mating member(s) 215. In this example, when brought together, the mating member(s) 215 include fingers that interleave with each other, preventing the assemblies 1000 from sliding sideways relative to each other. In some configurations, the mating member(s) 215 may also include features (e.g., a stop bar) that may prevent the assemblies 1000 from sliding vertically relative to each other. As illustrated in greater detail in FIGS. 8 and 9, a fastener 225 (e.g., a latch, a hook, a buckle, a snap, clamp or any other suitable fastener) may be provided on at least one of the assemblies 1000. The fastener 225 may enable the respective enclosures 200 of the assemblies 1000 to be held together, for example by fastening the respective handles 205 together. The fastener 225, together with the mating member(s) 215, may thus prevent relative motion between the assemblies 1000, and may enable the assemblies 1000 to be transported as one unit. Any other suitable means of interconnecting two or more assemblies to each other may be provided.

In some examples, the design of the mating member(s) 215 may be such that most or all of the weight of the assemblies 1000 is supported by the mating member(s) 215 and the frames 220, such that the fastener 225 may not be required to withstand much force. Such a design may be useful to avoid unintentional unfastening of the fastener 225. In some example, more than one fastener 225 may be used to help improve joining of the assemblies 1000.

Figure 10:
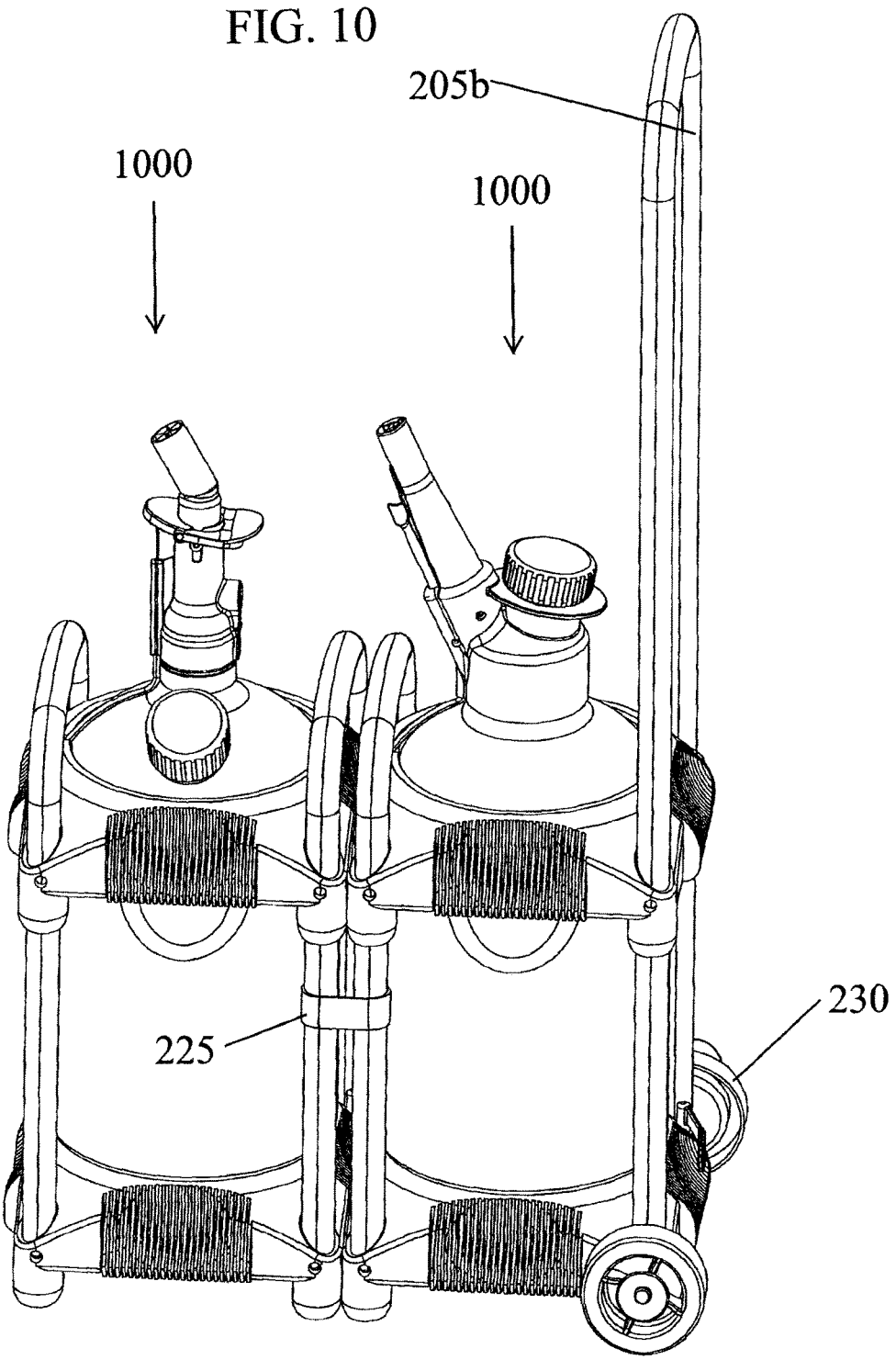
FIG. 10 is an isometric view of two coupled portable fluid container assemblies configured for transportation.

FIG. 10 shows an example of how one or more assemblies 1000 may be transported. In the example shown, two assemblies 1000 are interconnected (e.g., in the manner described above) in a fashion suitable for transport. In this example, an assembly 1000 may be fitted with an extendable handle 205*b* (e.g., a telescoping handle) or a longer handle to facilitate towing by a user. In this example, wheels 230 may be fitted on an assembly 1000 (e.g., using a connector 235) to facilitate towing of the assembly 1000. For example, a frame 220 of the enclosure 200 may include one or more recesses or holes for fitting wheels 230 (e.g., using a connector 235 that may be locked in place by, for example pressing a button 235*b*). Such wheels 230 may be relatively easily added or removed by a consumer. Two or more assemblies 1000 may be fastened together, which may enable two or more assemblies 1000 to be relatively easily transported together in the manner illustrated.

Figure 11:
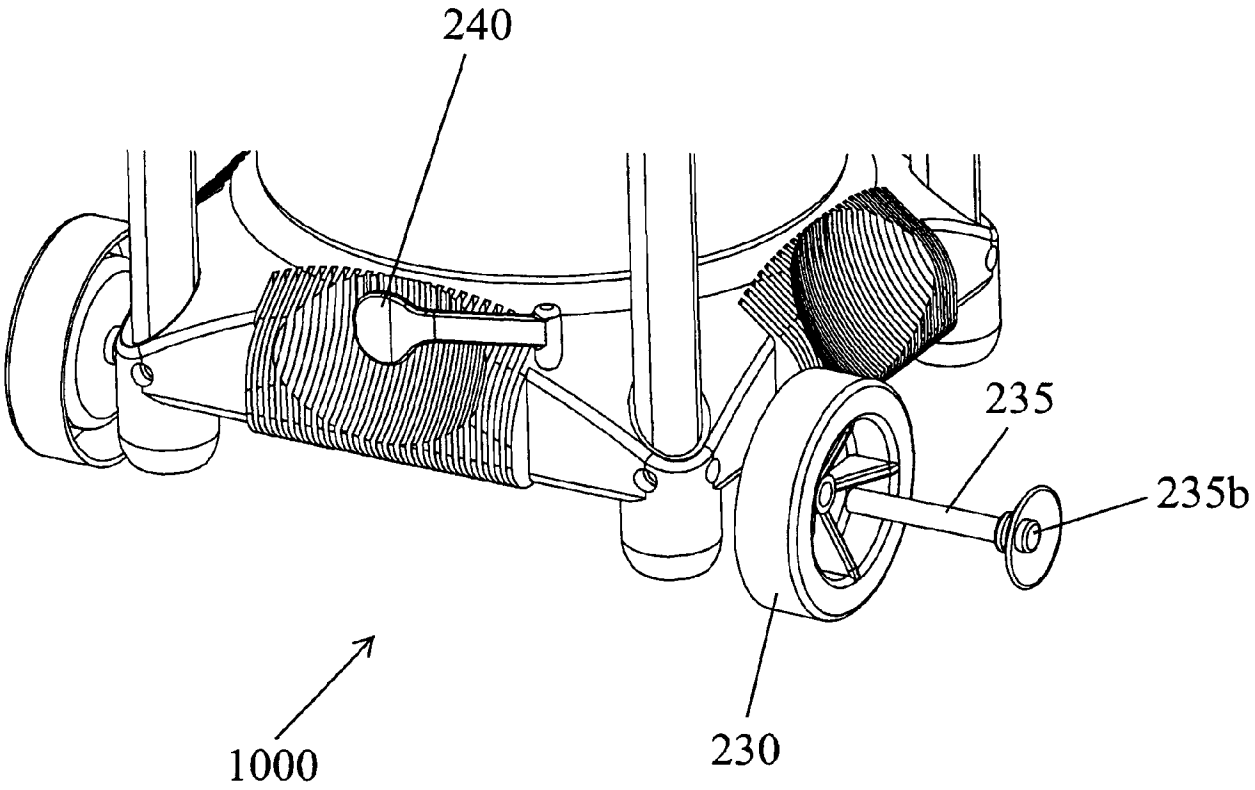
FIG. 11 is a detailed view of example rolling members attachable to the portable fluid container assembly of FIG. 1, illustrating placement of a remote trigger.
Figure 12:
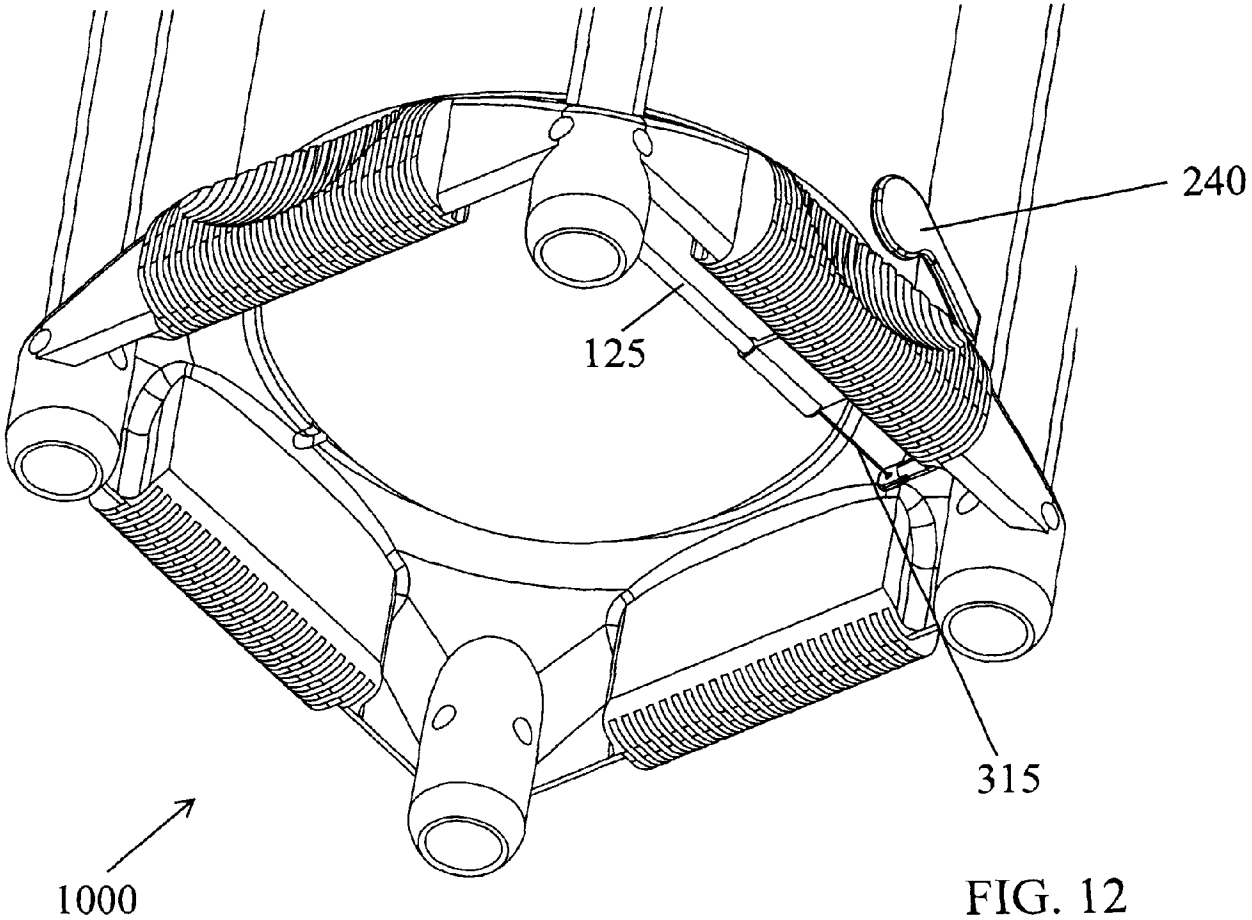
FIG. 12 is a detailed view of an example remote trigger suitable for the portable fluid container assembly of FIG. 1.

As shown more clearly in FIGS. 11 and 12, an assembly 1000 may also include a trigger 240 for controlling fluid flow from a dispenser, such as a spout 305, 305*b*. The trigger 240 may be located remotely from the spout 305, 305*b*, and may control a valve in the spout 305, 305*b* for controlling and regulating the flow from the spout 305, 305*b* via, for example, a cable 315 (see FIGS. 1A and 1B) that may run up the side of the assembly 1000 (e.g., via a cable guide 125 provided on the inner body 100 as shown in FIG. 12) from the trigger 240 to an openable and closable valve of the dispenser via a channel 320 in the cover 300, 300*b*, or any other suitable mechanism. In the example shown, the trigger 240 may be located near a base of the assembly 1000, for example adjacent the bottom end 1012 or at the base portion of the assembly 1000. Such a location may be easily accessible by a user's hand when a user upturns the assembly 1000 to pour fluid from the assembly 1000. The use of the remotely located trigger 240 may simplify the control of fluid flow (e.g., start of fluid flow, stop of fluid flow and/or flow rate) when dispensing fluid from the assembly 1000, and may prevent unintentional spilling of fluid when dispensing fluid from the assembly 1000. The trigger 240 may alternatively be located at any other suitable location on the container assembly (e.g., top, side or bottom). In some examples, there may be more than one trigger 240 provided, which may be useful in providing control of fluid flow from more than one hand position. For example, there may be one trigger 240 located near the base of the assembly 1000 (adjacent the bottom end 1012) and a second trigger 240 located near the top of the assembly 1000.

FIGS. 62-65 illustrate another example spout 305*c* that may be provided on the cover 300, 300*b*. In some examples, the spout 305 may be similar to the spout 305*b*. The example shown illustrates the spout 305*c* provided on the cover 300*b*, although the spout 305*c* may be also used on the cover 300. The spout 305*c* may be controlled using the trigger 240 via the cable 315 (not shown), as described above. Additionally or alternatively, the spout 305*c* may include a safety trigger 325. The safety trigger 325 may help to ensure that fluid is delivered only when the spout 305*c* is sufficiently inserted into an inlet of a fluid destination. The safety trigger 325 may be biased towards a liquid dispensing end, also referred to as a distal end 345, of the spout 305*c* in its unactuated position and may be actuated away from the distal end (e.g., when the spout 305*c* is inserted into the inlet of the fluid destination, the safety trigger 325 may be actuated by pressing against the outer surface of the fluid destination).

Figure 63:
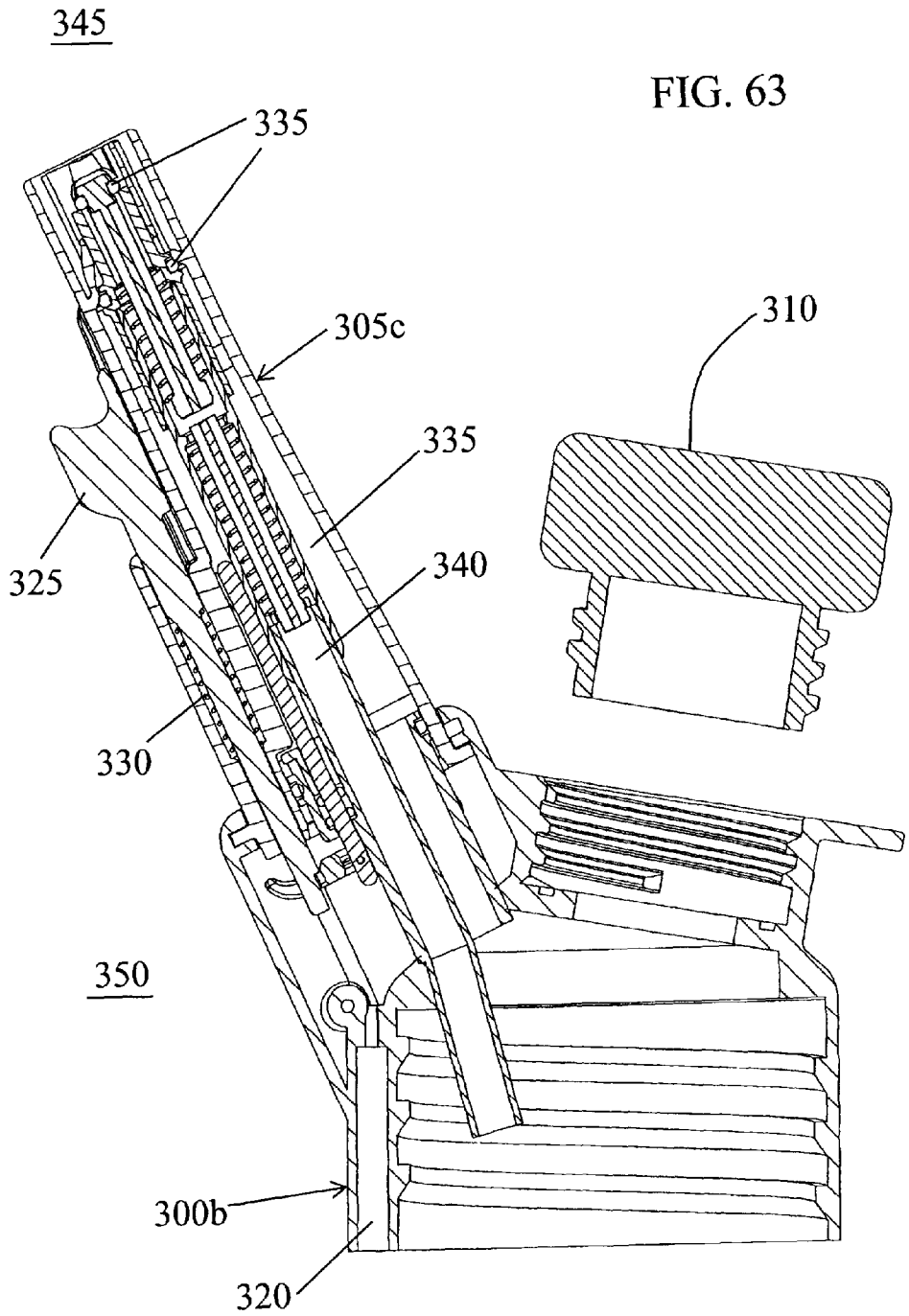
FIGS. 63 and 64 are a cross-sectional views of the spout of FIG. 62, showing an example of its operation.
Figure 64:
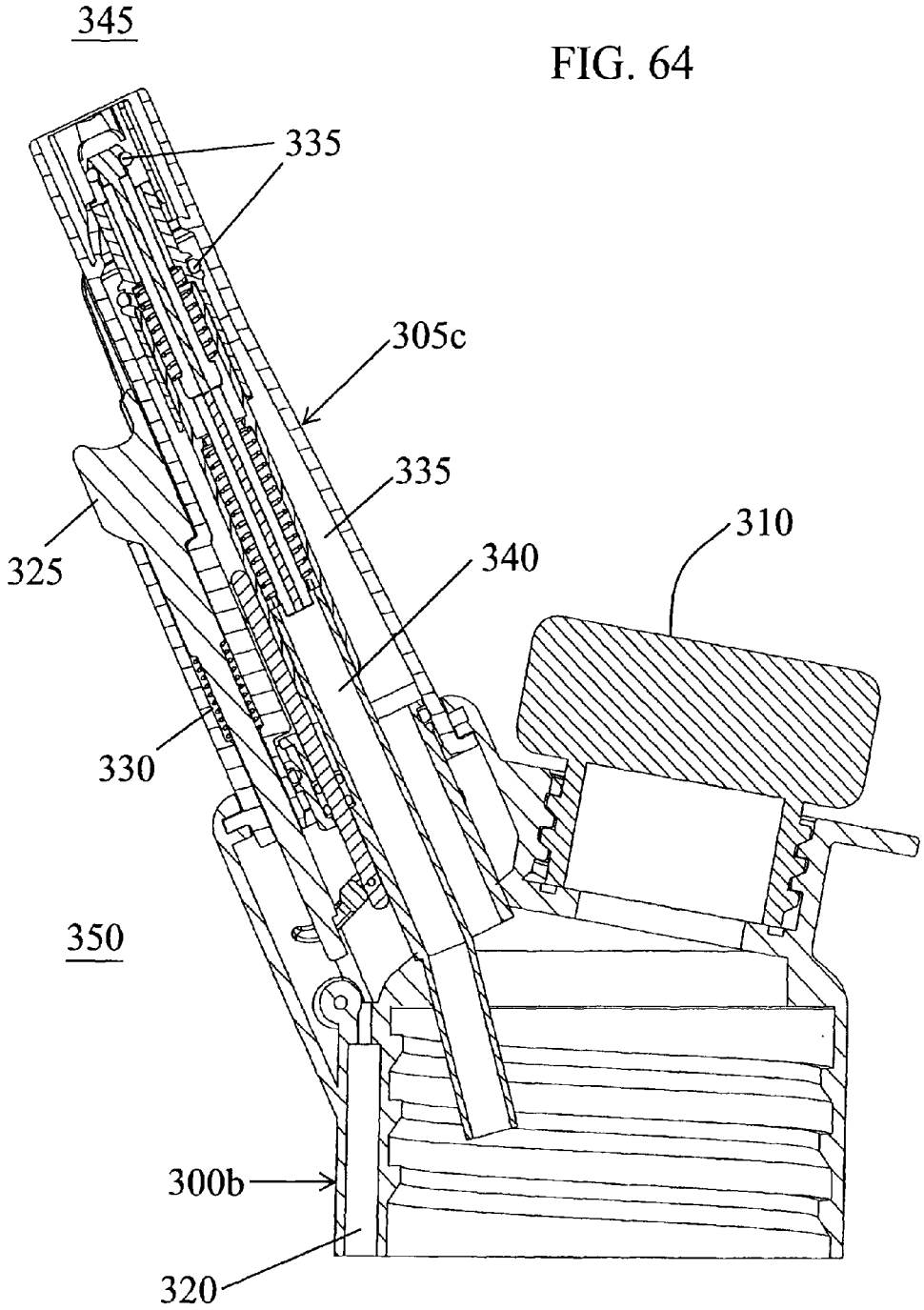

The safety trigger 325 in FIG. 63 is shown in the unactuated position, biased towards the distal end 345 of the spout 305*c* (e.g., by a biasing member, such as a compression spring 330); and the safety trigger 325 in FIG. 64 is shown in the actuated position, pulled or pushed away from the distal end of the spout 305*c*. The safety trigger 325 may be coupled to one or more valves 335 of the spout 305*c* that may be moveable to facilitate or inhibit flow of fluid through the spout 305*c*. In the example shown, there are two valves 335, each mediating fluid flow through a respective fluid conduit of the spout 305*c*. When the safety trigger 325 is in its unactuated position, the valve(s) 335 may be closed, to inhibit fluid flow through the spout 305*c*. When the safety trigger 325 is in its actuated position, the valve(s) 335 may be opened, to allow fluid flow through the spout 305*c*. Where the safety trigger 325 is provided in addition to the cable 315 and trigger 240, fluid flow through the spout 305*c* may be allowed when both the safety trigger 325 and the cable 315 are actuated. This may prevent unintentional fluid flow through the spout 305*c*, for example when the trigger 240 is actuated and the spout 305*c* is not properly inserted into the inlet of the fluid destination. Similarly, the safety trigger 325 may cause fluid flow to be stopped when the spout 305*c* is removed from the inlet of the fluid destination, even if the trigger 240 remains actuated, to avoid fluid loss.

The safety trigger 325 may also provide a depth-inhibiting feature. For example, the safety trigger 325 may be moved a fixed amount between its unactuated position to its actuated position, thereby limiting the depth to which the spout 305*c* may be inserted into the inlet of the fluid destination.

In the example of FIGS. 63 and 64, the spout 305*c* is a dual-conduit spout 305*c* and may include a first fluid passage 335 and a second fluid passage 340 for permitting fluid flow through the spout 305*c*. Each of the fluid passage 335, 340 may enable fluid communication between the distal end 345 and the attachment end of the spout 305*c*. Although the fluid passages 335, 340 have been described as enabling fluid communication between the distal end 345 and the attachment end, it should be understood that in operation fluid may not necessarily travel the entire distance from the distal end 345 to the attachment end. In the example shown, the second fluid passage 340 may be contained in the first fluid passage 335 and the two passages 335, 340 may be co-axial. However, it should be understood that other configurations may be possible including, for example, tangential, off-set or separate passages. In this example, the first fluid passage 335 may permit liquid fluid to flow to the distal end 345 while the second fluid passage 340 may be permit recovery of vapor from the distal end 345, to allow for vapor recovery during dispensing of a fluid, such as a volatile fluid (e.g., fuel).

Figure 65:
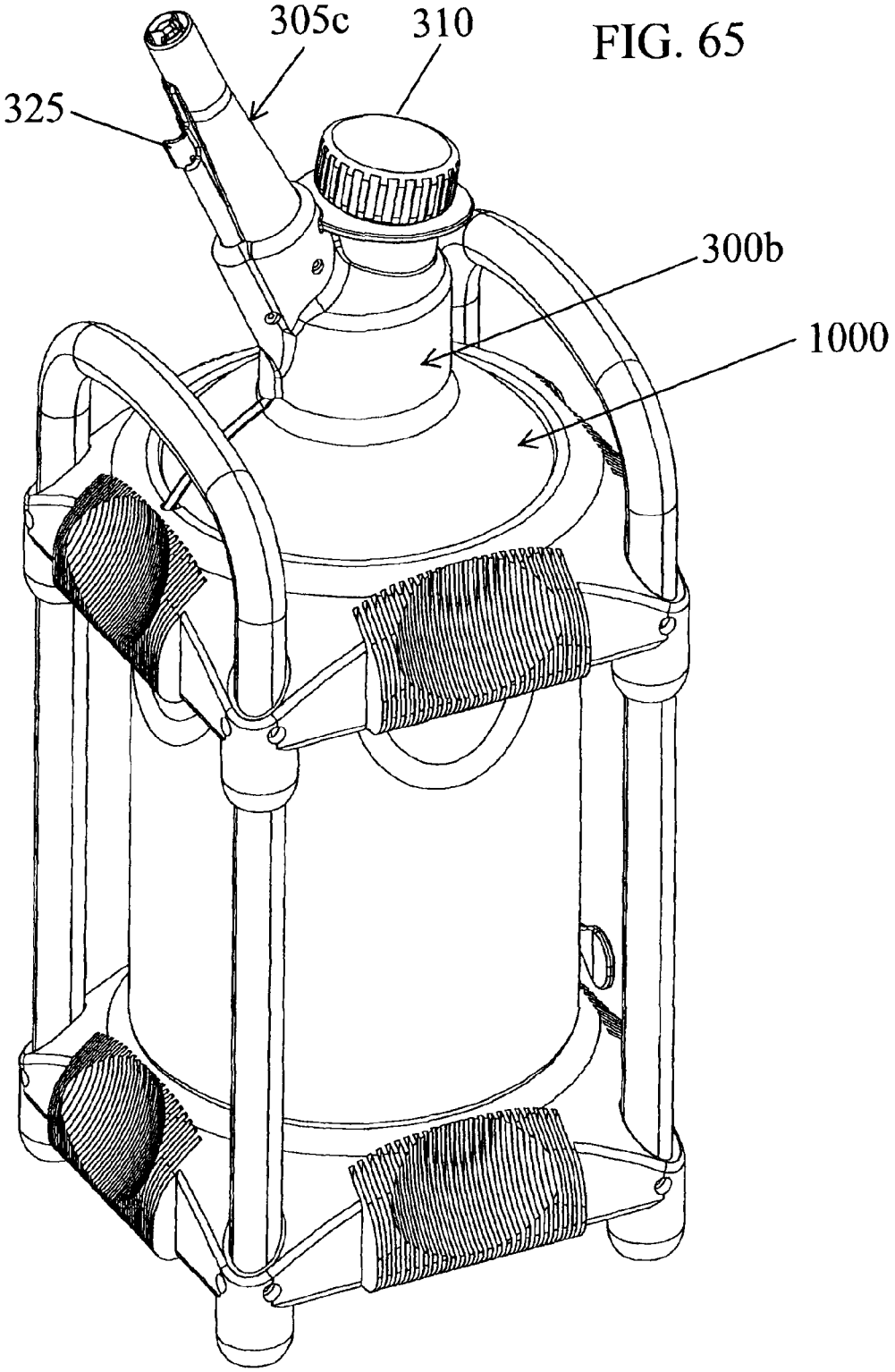
FIGS. 65-67 show the spout of FIG. 62 provided on variations of the disclosed covers and assemblies.

FIG. 65 shows an example of the spout 305*c* being provided on the cover 300*b* for the assembly 1000. It should be understood that the spout 305*c* may be provided in other configurations for any of the disclosed assemblies.

FIGS. 15A-17 illustrate another example portable fluid container assembly 1000*b* including an enclosure 400. The portable fluid container assembly 1000*b* may include an inner body 100 and a cover 300, 300*b*, such as that described above.

In this example, the enclosure 400 may be formed from panels 415. Although in FIGS. 15-17 four panels 415 are shown, it should be understood that less or more panels 415 may be used. Although the panels 415 are shown as forming a quadrilateral shape surrounding the inner body 100, it should be understood that the panels 415 may form any shape, regular or irregular, surrounding the inner body 100. It should be understood that although the panels 415 are shown as being substantially planar or slightly curved, the panels need not be substantially planar or slightly curved. Although the panels 415 are shown as being separate, in some examples two or more panels 415 may be joined together, for example in a fixed arrangement or hingedly attached to each other. As in the example described above, the enclosure 400 may be attached to the inner body 100 by a manufacturer and may not be removable by a consumer. The enclosure 400 may be permanently attached to the inner body 100 or may be removable (e.g., by a manufacturer) to be used with other inner bodies 100, or to be replaced with another enclosure. Where appropriate, the enclosure 400 may include features to comply with safety regulations (e.g., warnings, manufacturer's information, color coding, etc.).

The enclosure 400 may be provided with one or more handles 405 for carrying and manipulating a portable fluid container assembly 1000*b*. The handle(s) 405 may be integral to the enclosure 400 or may be a separate component that is attached to the enclosure 400. In some examples, a window 410 may be defined in one or more panels 415 of the enclosure 400. The window 410 may allow a portion of the inner body 100 to be viewable through the enclosure 400, which may enable a user to view the fluid within the inner body 100, for example to determine the fluid level or the type of fluid. The window 410 may be an aperture defined in a panel 415, or may be a transparent or translucent portion of a panel 415. In some examples, one or more markings (e.g., volume markings) may be provided adjacent to the window 410 to assist in determining the volume of fluid in the inner body 100.

As shown, the assembly 1000*b* may also include a cover 300, 300*b*, which may be similar to that described above. Although not shown, the assembly 1000*b* may also be fitted with wheels 230. The assembly 1000*b* may also include a trigger 240 for controlling fluid flow from a spout 305, 305*b*.

Figure 19:
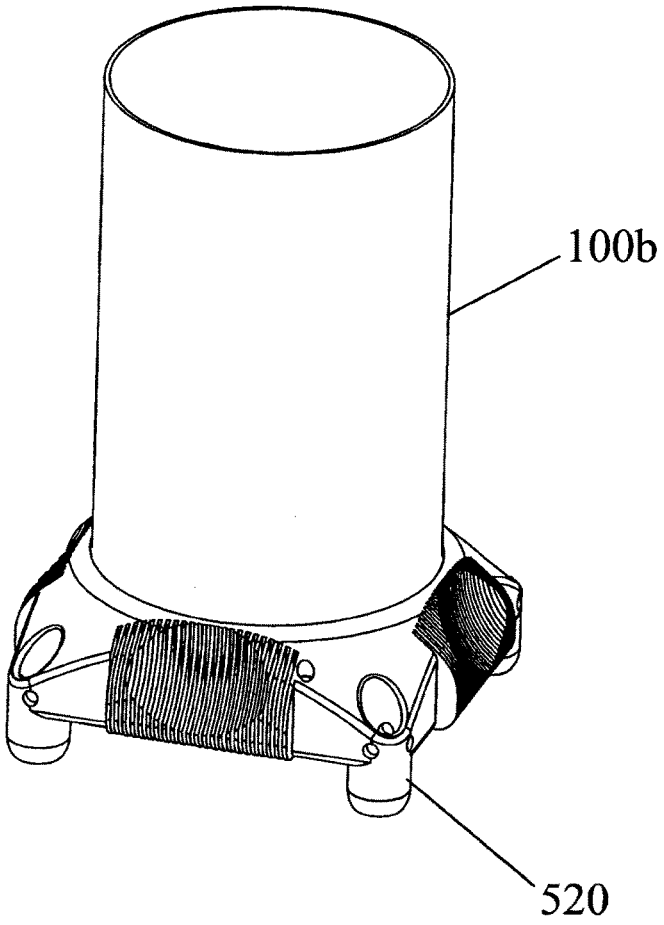
FIG. 19 is an isometric view of an example inner container suitable for the portable fluid container assembly of FIG. 18.

FIGS. 18-22 illustrate another example portable fluid container assembly 1000*c*. In this example, a portable fluid container assembly 1000*c* may include an inner body 100*b* and a frame or an enclosure 500. The inner body 100*b* may be similar to inner body 100 described above. The inner body 100*b* may be provided as an open container, for example without a top portion (e.g., as shown in FIG. 19). In some examples, the inner body 100*b* may be provided without a top portion to enable multiple inner bodies 100*b* to be nested together, for transport or storage, for example. The enclosure 500 may include one or more handles 505 that may cooperate with one or more frames 520. The frame(s) 520 may be separately formed or integrally molded to the inner body 100*b*. The frame(s) 520 may include one or more grips 510 for handling the assembly 1000*c* and/or one or more mating member(s) 515 for joining one or more assemblies 1000*c*. The enclosure may also include a top 540 for covering the top opening of the inner body 100*b*. The top 540 may be added to the inner body 100*b* by a manufacturer, for example, and may not be removable by a consumer. The top may be permanently attached to the inner body 100*b*, or may be replaceable (e.g., to be used with multiple inner bodies 100*b* or to be replaced by another top). The top 540 may be snap-fitted or welded to the inner body 100*b*, for example. The top 540 may also serve as a frame 520 for forming the enclosure 500. The top 540 may include an opening, which may be covered by a removable cap 545.

Figure 20B:
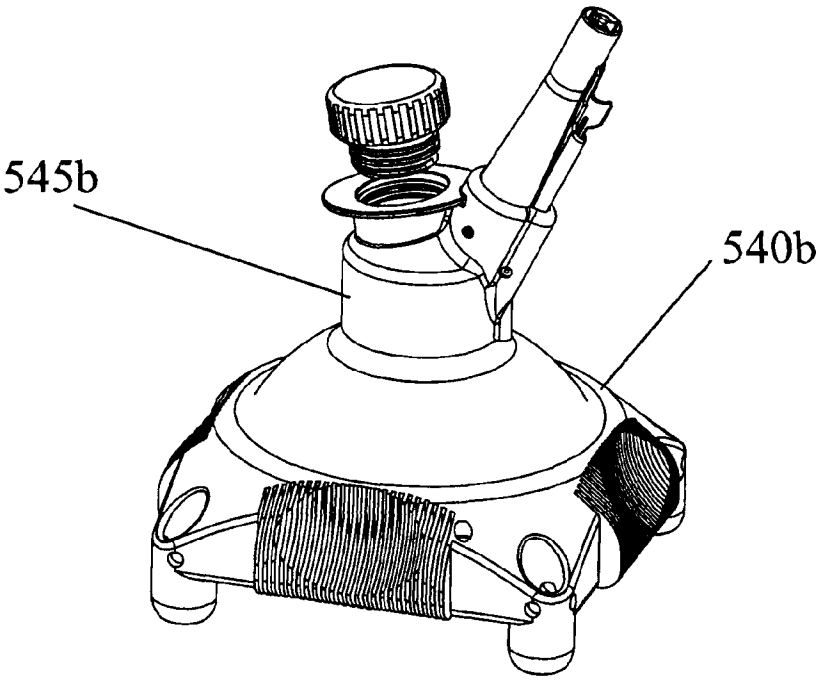
FIGS. 20A and 20B are isometric views of example container covers suitable for the portable fluid container assembly of FIG. 18.
Figure 21:
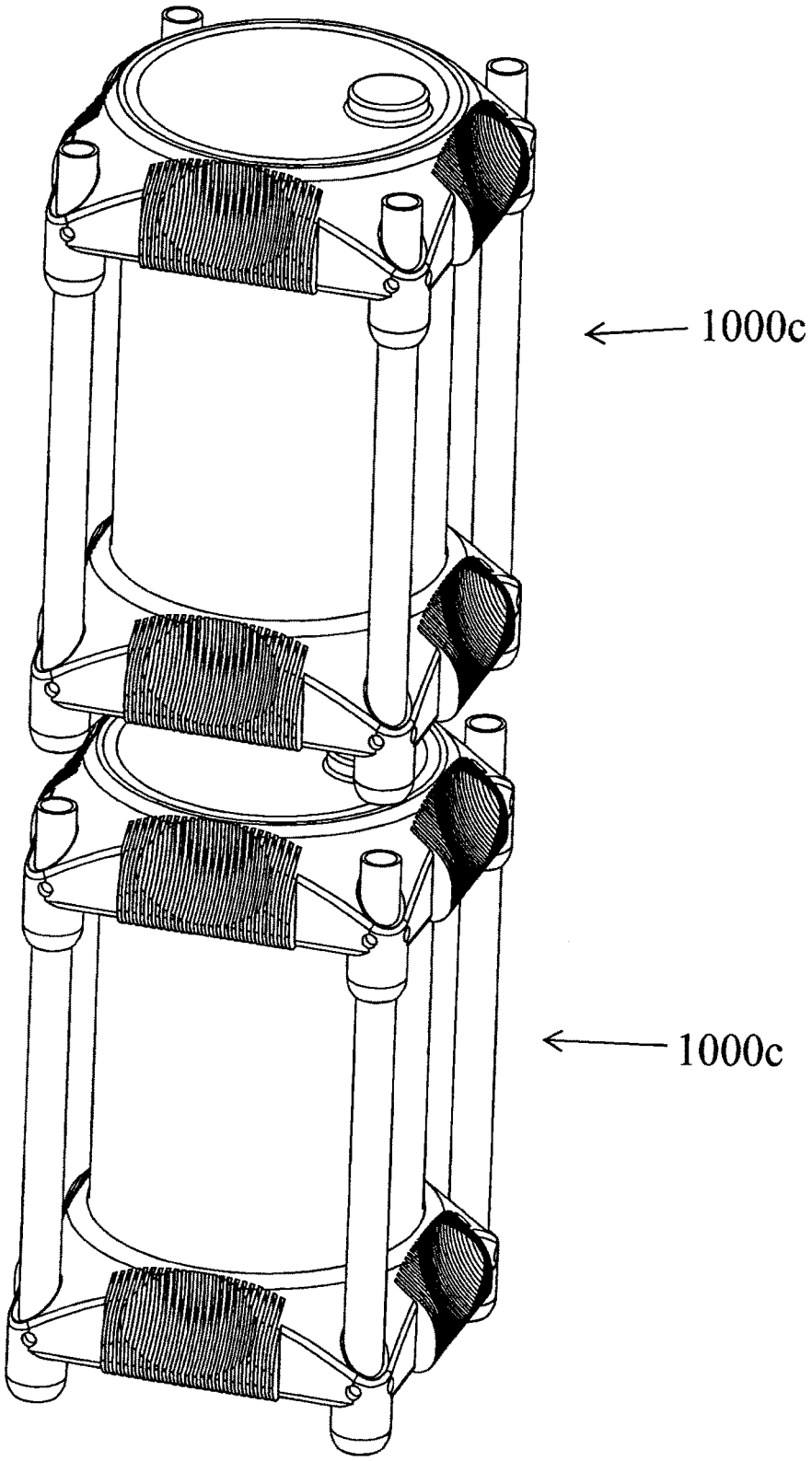
FIG. 21 illustrates an example stackable configuration of the portable fluid container assembly of FIG. 18.
Figure 22:
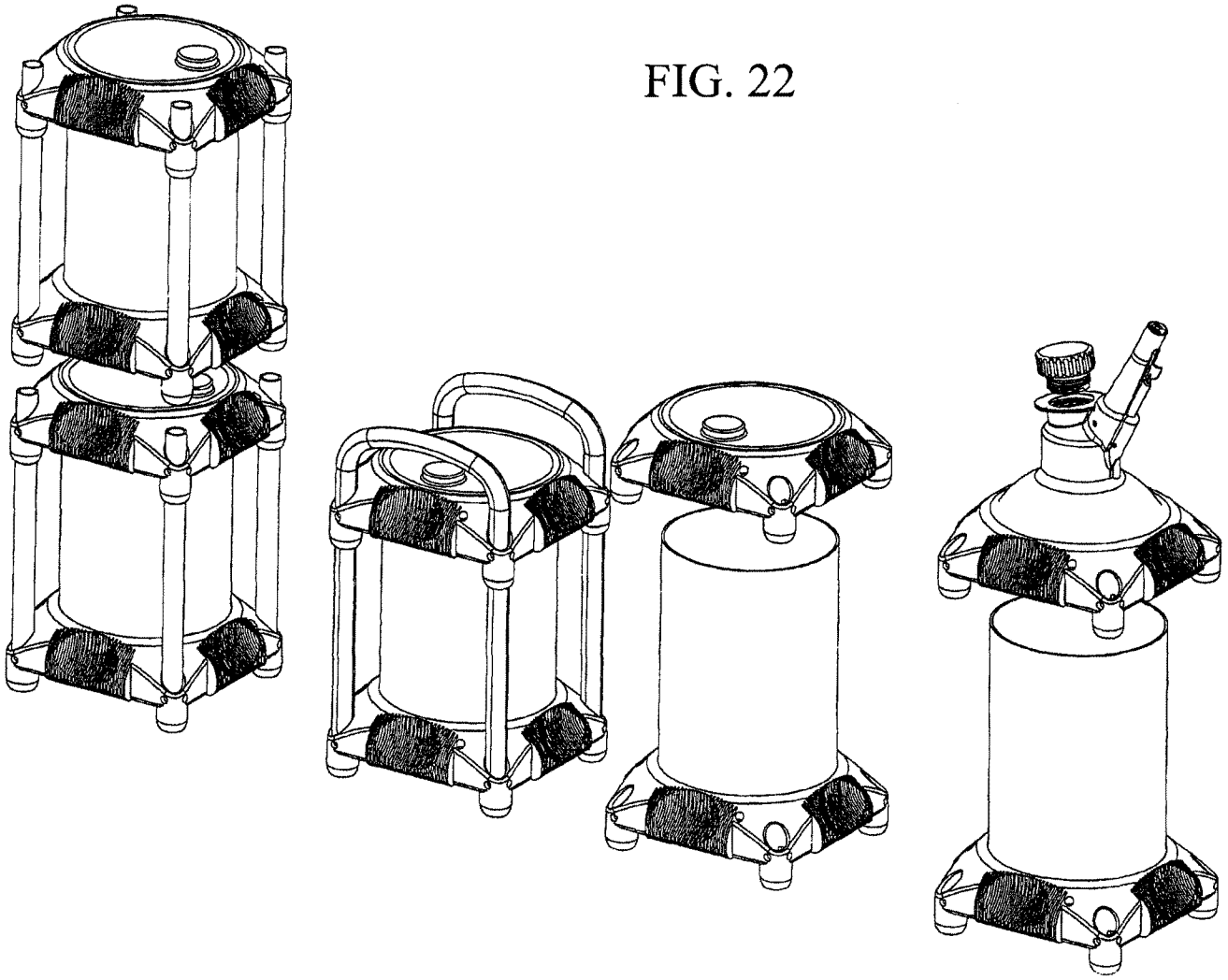
FIG. 22 illustrates example configurations of the portable fluid container assembly of FIG. 18.

In some examples, the assembly 1000*c* may include a different top 540*b*, for example as shown in FIG. 20B), which may have a different cap 545*b*. For example, the cap 545*b* may be similar to the cover 300, 300*b* described above. In some examples, a top 540 may be used to help enable stacking of assemblies 1000*c* (e.g., as shown in FIG. 21). In some examples, an enclosure 500 may have handles 505 that may fit into a frame 520 forming the base (e.g., into suitably sized recesses) of another assembly 1000*c*, to enable stacking of assemblies 1000*c*, such as shown in FIG. 21. In some examples, a top 540*b* may be used to help enable pouring of fluid from an assembly 1000*c*. As shown in FIG. 22, for example, a cap 545*b* may be replaced with a cover 300, 300*b* to help enable dispensing of fluid from the assembly 1000*c*.

Figure 20A:
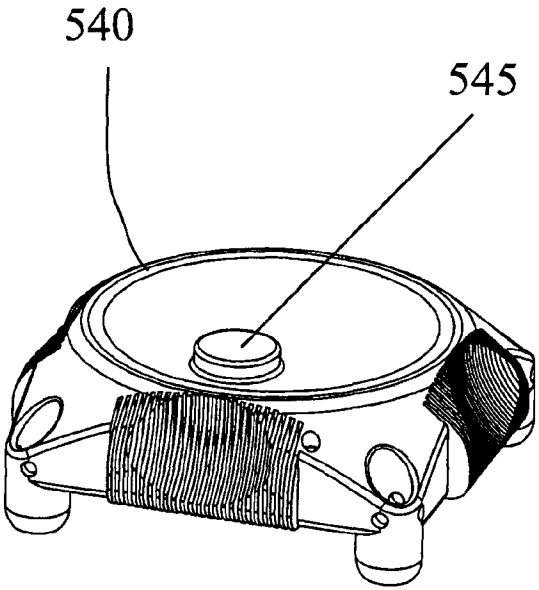

In some examples, cap 545 in FIG. 20A may be replaced by cover 300, for example to help enable dispensing of fluid from the assembly 1000*c*.

In some examples, the portable fluid container assembly 1000*c* may be a modular system, for example as shown in FIG. 22, in which the inner body 100*b* may be fitted with different frames 520, handles 505, tops 540, 540*b*, and/or covers 300, 300*b* as appropriate. Although not shown, the assembly 1000*c* may also be fitted with an extendable handle 205*b* and wheels 230. The assembly 1000*c* may also include a trigger 240 for controlling fluid flow from a spout 305, 305*b*.

In some examples, such as where the assembly 1000*c* is a modular system, a conventional fluid container, such as a conventional 5 gallon bucket (e.g., commonly used for carrying chemicals) may be used as an inner body 100*b* for the assembly 1000*c*.

In some examples, different embodiments of the portable fluid container assembly 1000, 1000*b*, 1000*c* may be joined together, for example using mating member(s) 215, 515 and/or fasteners 225. The use of an enclosure 200, 400, 500 may also allow for the inner body 100, 100*b* to be relatively cylindrical or round, which may be useful to resist deformation from changes in inner vapor pressure, while providing a non-rolling shape to enable stacking of assemblies 1000, 1000*b*, 1000*c*. For example, the enclosure 200, 400, 500 may form a four-sided or three-sided shape for the assembly 1000, 1000*b*, 1000*c*, which shape may be relatively easily stacked side-by-side or on top of each other. For example, the enclosure 200, 400, 500 may extend beyond the sides of the inner body 100, 100*b* sufficiently to enable such stacking.

Figure 79:
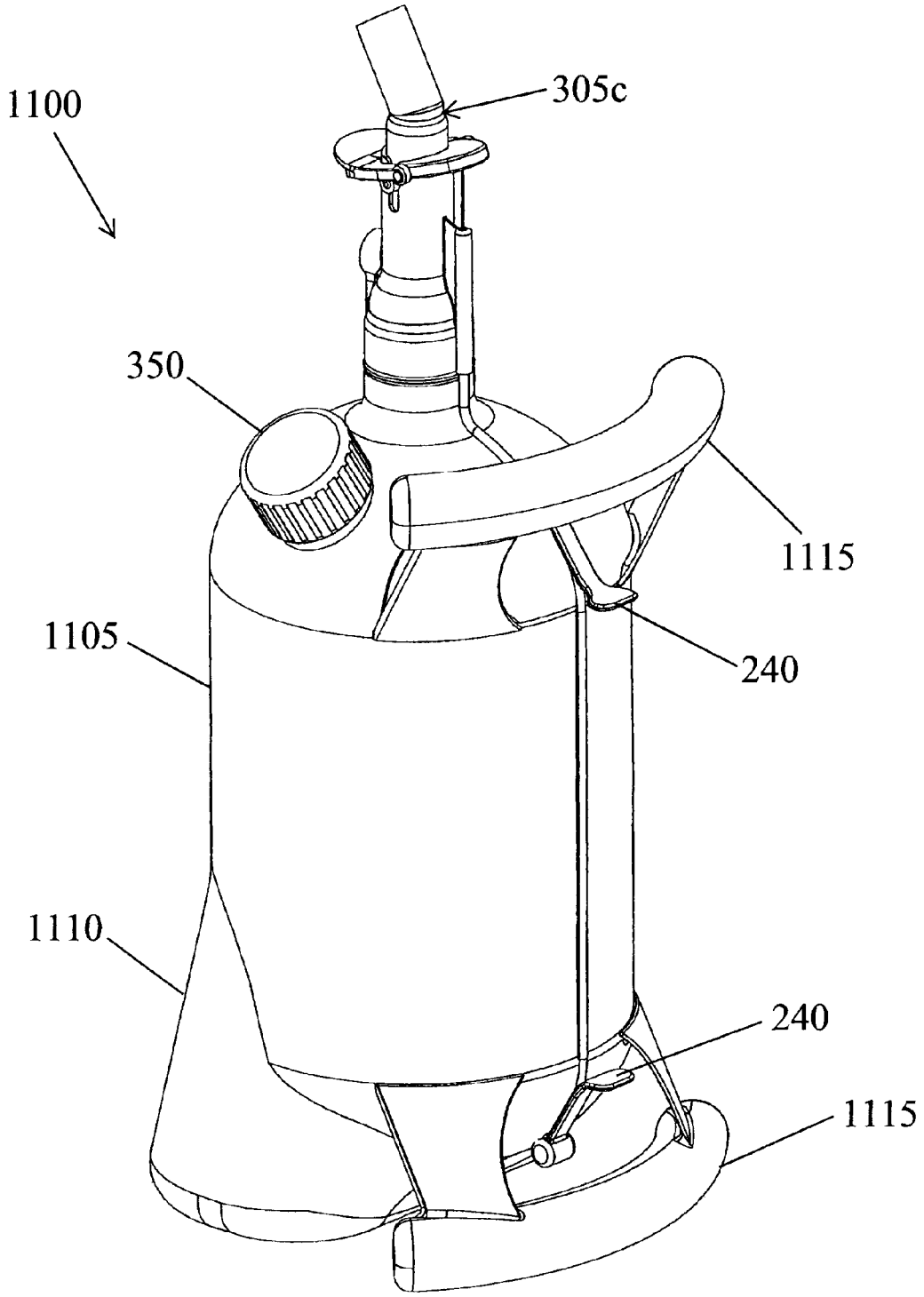
FIGS. 79 and 80 are isometric views of an example of the disclosed containers.
Figure 80:
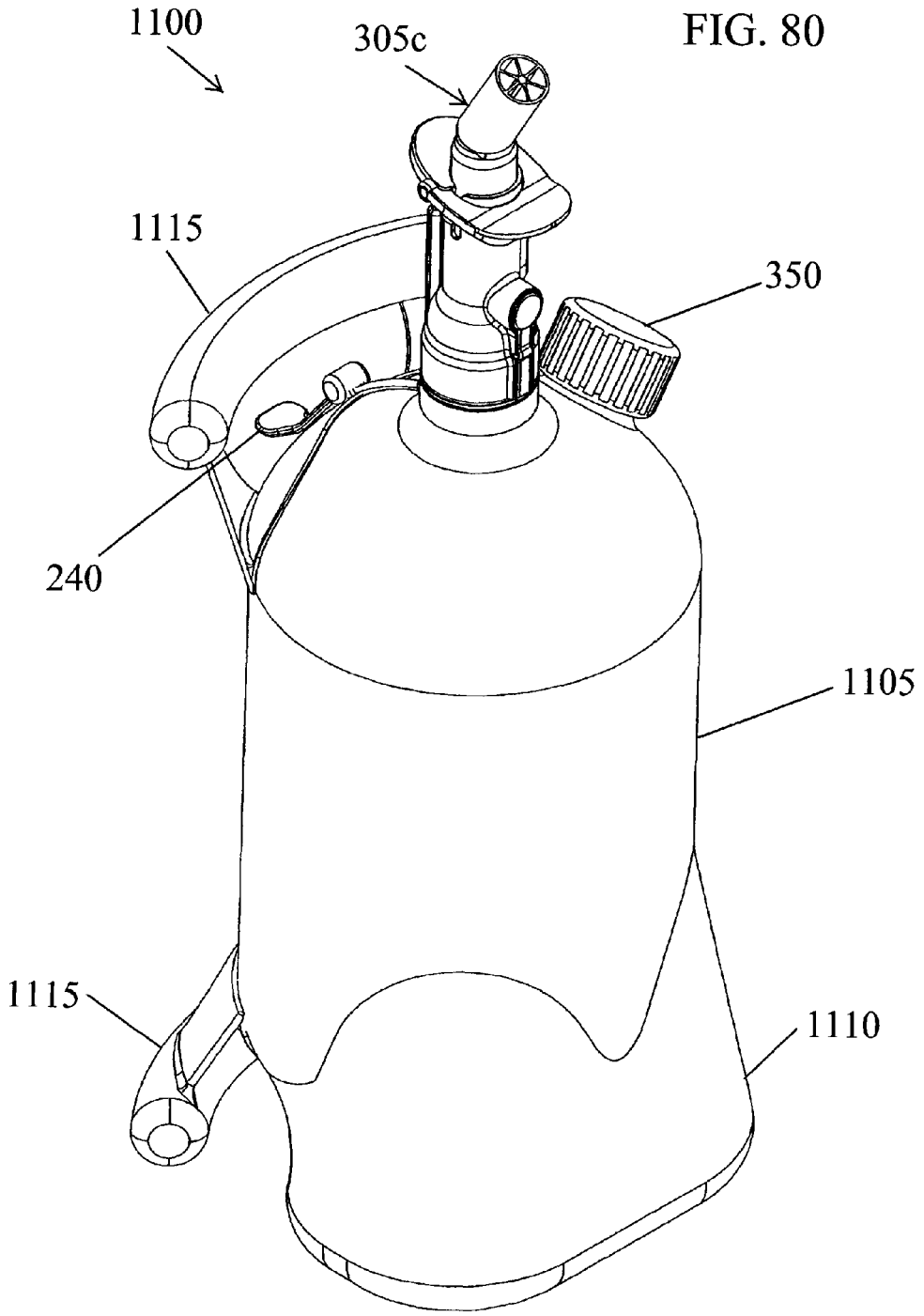
Figure 81:
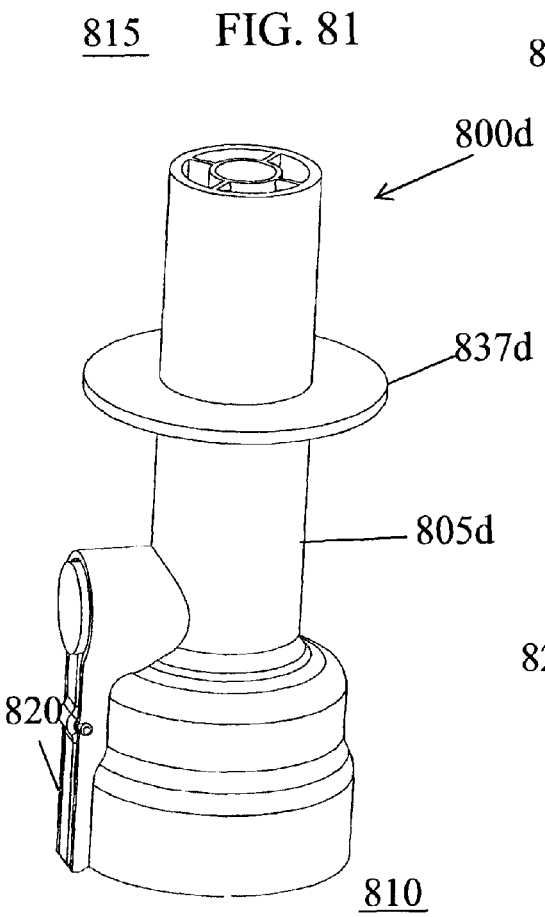
FIG. 81 is an isometric view of another example of the disclosed attachments.
Figure 82:
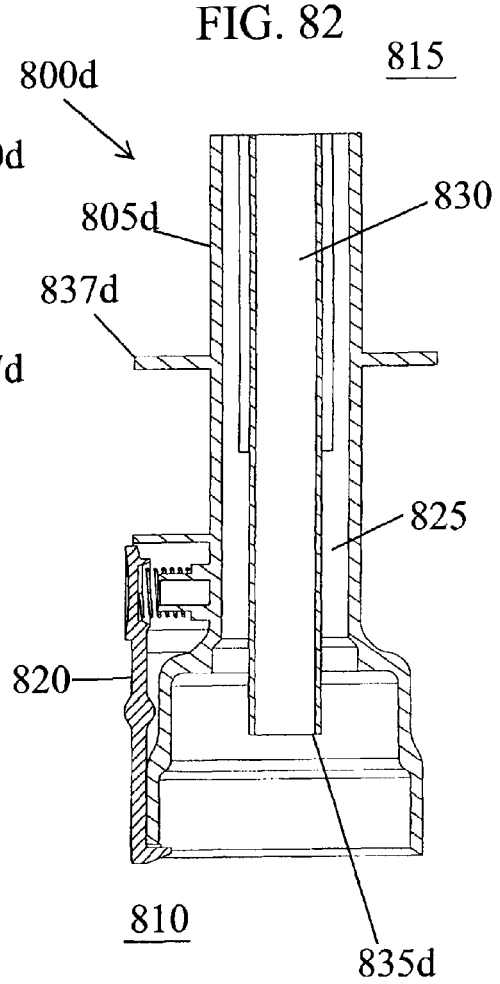
FIG. 82 is a cross-sectional view of the attachment of FIG. 81.

FIGS. 79 and 80 illustrate another example fluid container 1100. The fluid container 1100 may include a body 1105. The body 1105 may be molded (e.g., blow-molded) or manufactured using any suitable method. The body 1105 may be provided with one or more support members 1110 and/or one or more handles 1115. The support member(s) 1110 and/or the handle(s) 1115 may be removably or permanently attached to the body 1105 during or after molding of the body 1105, for example. In some examples, the support member(s) 1110 and/or the handle(s) 1115 may be integral to the body 1105, while in other examples the support member(s) 1110 and/or the handle(s) 1115 may be removably attached (e.g., via snap-fittings, thread-and-groove, adhesives, screws or any other suitable attachment systems).

The support member(s) 1110 may provide support such that the container 1100 may be kept upright when rested on a surface. The use of the support member(s) 1110 may allow the body 1105 to be formed with a round bottom, for example, to simplify the manufacturing process.

The handle(s) 1115 may be located on the body 1105 to allow for ergonomic handling of the container 1100 by a user. In the example shown, two handles 1115 may be provided, one near the base and one near the top of the container 1100, to allow for ergonomic maneuvering of the container 1100 when it is upright and when it is inverted (e.g., for dispensing fluid). Although the handles 1115 in the example shown are separate, it should be understood that the separate handles 1115 may also be replaced with a single handle 1115 spanning the height of the container 1100, for example, or any other suitable configuration of one or more handles 1115.

The container 1100 may also include one or more triggers 240, as described above, for remote actuation of a dispenser. Each of the trigger(s) 240 may be used to actuate a cable (not shown) for controlling fluid flow through a dispenser (the spout 305*c* in the example shown). Where there are two or more triggers 240, each of the triggers 240 may be used to actuate the same cable, such that actuation of any one of the triggers 240 may be used to actuate the cable. In the example shown, the container 1100 may include a trigger 240 located near each of the handles 1115 to allow a user's hand to easily operate the trigger 240 when holding the container 1100 by one of the handles 1115.

In this example, the container 1100 includes a cover 300 with a spout 305*c*, although it should be understood that any of the covers 300, 300*b* and any of the spouts 305, 305*b*, 305*c* described above may be suitable for the container 1100, in addition to any other suitable cover or spout configuration.

Although not shown, in some examples the assembly 1000, 1000*b*, 1000*c* or the container 1100 may include one or more convenience features (e.g., hooks, recesses or openings), for example storage location(s) for storing any tools, adaptors or attachments (e.g., any tools, adaptors or attachments that may be commonly used with fuel dispensing, such as adaptors for the spout 305, 305*b*). Such convenience features may include, for example, hooks or clips for attaching a covering (e.g., a curtain, a tarp, a fabric, a radar-absorbing material or a camouflage material) to the assembly 1000, 1000*b*, 1000*c* or the container 1100, which covering may be used to cover some or all of the assembly 1000, 1000*b*, 1000*c* or the container 1100. In some examples, such features may be provided by the enclosure 200, 400, 500 and/or the body 100, 1105.

In some examples, the assembly 1000, 1000*b*, 1000*c* or the container 1100 may be used with one or more removable dispensing members (e.g., spout tips or attachments). Such removable members may be adaptable to different flow rates, dispensing opening sizes and/or configurations by changing the spout tip 305, 305*b*. The spout tip may be removable and/or replaceable to allow for dispensing of fluid from different opening sizes and configurations (e.g., a removable member for reducing the opening of the spout 305, 305*b* to fill containers with smaller openings, a removable member for providing an angled tip for the spout 305, 305*b*, a removable member with a larger spout tip for high flow or a smaller tip for low flow, or a removable member that may enable operation of the remote trigger 240). FIG. 30 shows examples of spouts having different interchangeable removable members that may be used with the disclosed assembly 1000, 1000*b*, 1000*c*, or the container 1100, among others. In some examples, the removable member may be attached to the distal end of the spout 305, 305*b*, or the body of the spout 305, 305*b* may include the removable member (e.g., as a removable telescoping portion of the spout 305, 305*b*).

In some examples, the assembly 1000, 1000*b*, 1000*c* or the container 1100 may be used with one or more connectors (such as connector 600, described elsewhere in the present disclosure) for connecting the assembly 1000, 1000*b*, 1000*c*, or the container 1100 with the attachments disclosed herein and/or a pumping system for pumping fluid into or out of the assembly 1000, 1000*b*, 1000*c*, or the container 1100.

In some examples, the assembly 1000, 1000*b*, 1000*c* or the container 1100 may be provided with one or more anti-slip features (e.g., an anti-skip material, such as rubber for the base) to avoid sliding of the assembly 1000, 1000*b*, 1000*c* or the container 1100 during transport, for example.

In some examples, the cover 300, 300*b* may include one or more handles for carrying the assembly 1000, 1000*b*, 1000*c* or the container 1100.

Figure 23:
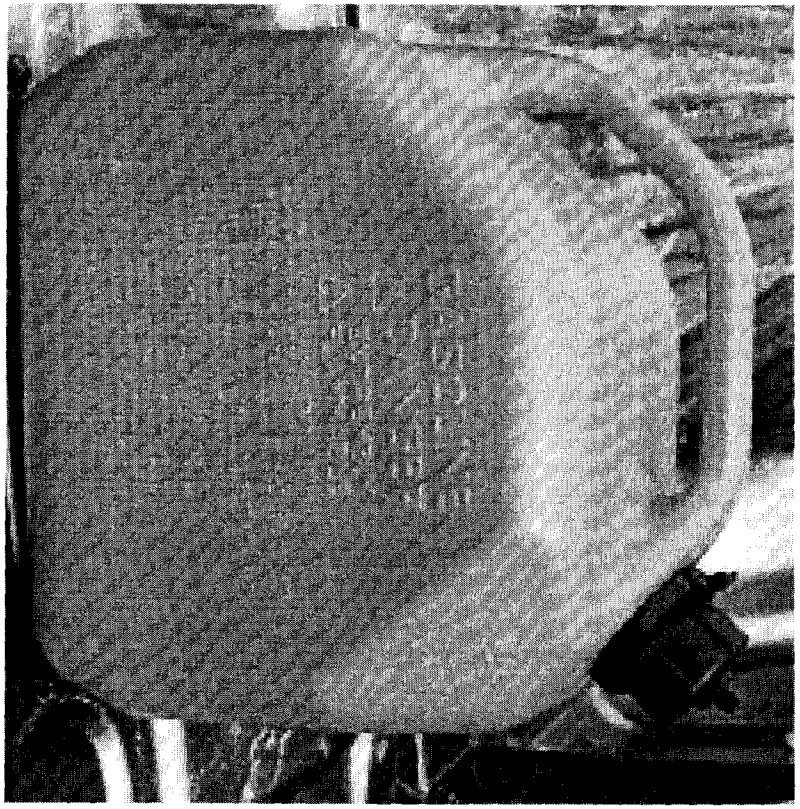
PRIOR ART FIG. 23
FIG. 23 shows an example prior art portable fluid container.

The disclosed example assembly 1000, 1000*b*, 1000*c* or the container 1100 may address one or more disadvantages of conventional portable fluid containers, such as conventional portable fuel containers (e.g., as shown in FIG. 23).

For example, conventional portable fuel containers may be manufactured using blow-molding techniques. Such conventional containers may be blow-molded with handles and structural support (e.g., stable base) integral to the container body. This may result in wasted excess material during the manufacturing process. An inner body 100, 100*b* of a disclosed assembly 1000, 1000*b*, 1000*c* or the body 1105 of the disclosed container 1100 may be manufactured as a relatively simple shape (e.g., cylindrical shape or spherical shape) with any necessary handles, structural support, etc. being provided by an enclosure 200, 400, 500 or attachable support(s) 1110 and/or handle(s) 1115.

The disclosed handles 205, 205*b*, 1115 may provide a point of attachment for clamping, locking or otherwise securing the assembly 1000, 1000*b*, 1000*c* or the container 1100 to the surrounding environment (e.g., a cart, a wall, a shelf or a vehicle)

Figure 24:
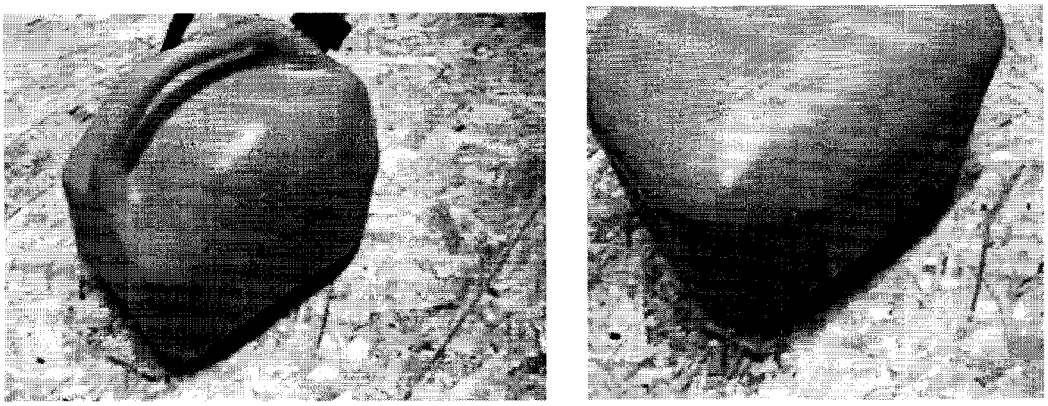
PRIOR ART FIG. 24
FIGS. 24 and 25 shows deformation of an example prior art portable fluid container due to changing vapor pressure within the container.
Figure 25:
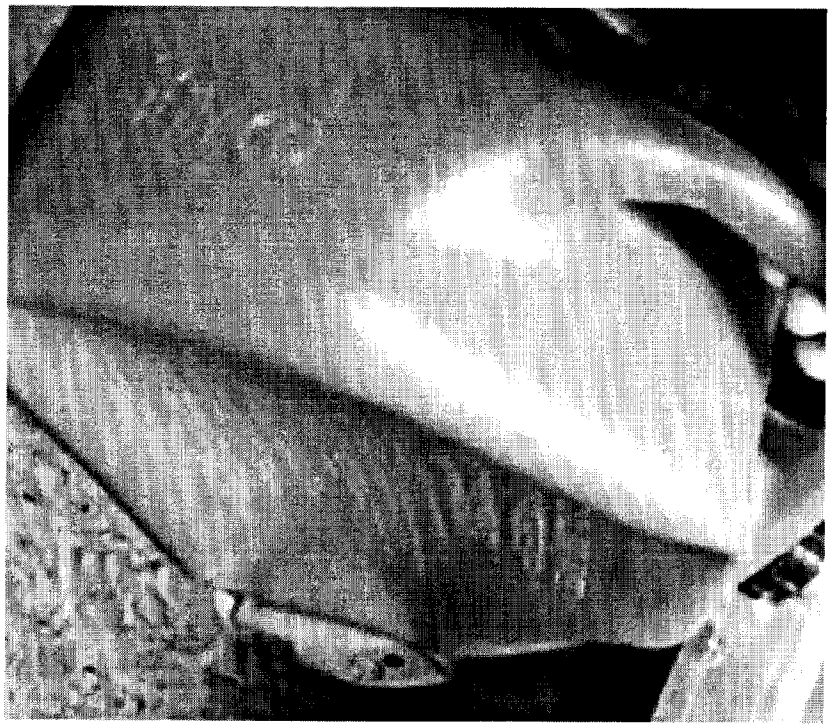
PRIOR ART FIG. 25

Conventional portable fuel containers may be relatively easily deformed by changes in internal vapor pressures. For example, FIG. 24 shows deformation of a conventional container at a relatively high temperature of about 83 degrees Fahrenheit (about 181.4 degrees Celsius), resulting in bulging of the container base causing the container to tip over. FIG. 25 shows deformation of a conventional container at a relatively low temperature of about 21 degrees Fahrenheit (about 69.8 degrees Celsius), resulting in collapse of the container side walls. An inner body 100, 100*b* of a disclosed assembly 1000, 1000*b*, 1000*c* or the body 1105 of the disclosed container 1100 may be formed in a relatively stable and simple shape (e.g., cylindrical shape), which may help to prevent or decrease such deformation.

Figure 26:
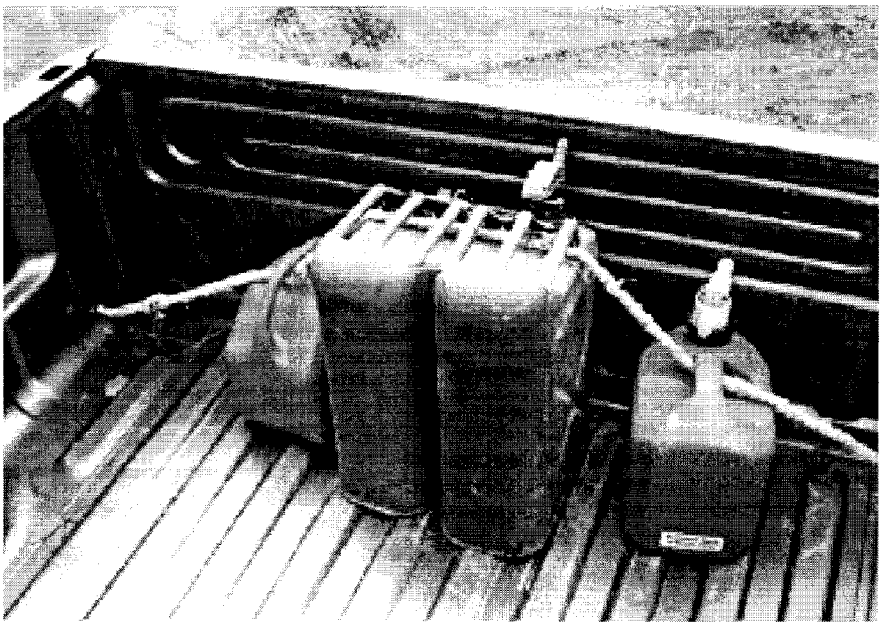
PRIOR ART FIG. 26
FIG. 26 shows an example of how prior art portable fluid containers are transported.

Conventional portable fuel containers may be designed to be used singly, not for stacking or transport together. However, a user may own more than one such container and may wish to store or transport such containers together. It may be difficult or awkward to keep multiple such containers together for storage or transport (e.g., through the use of a rope, as shown in FIG. 26). Inability to keep conventional containers from sliding relative to each other or disconnecting from each other during storage or transport may be a safety hazard. It may also be time-consuming and tiring for a user to have to transport such containers one by one. Assemblies 1000, 1000*b*, 1000*c* as disclosed may be connected to each other (e.g., through the use of mating member(s) 215, 515 and fasteners 225) for storage or transport. An assembly 1000, 1000*b*, 1000*c* may also be fitted with an extendable handle 205*b* and/or wheels 230 to help transport.

Figure 27:
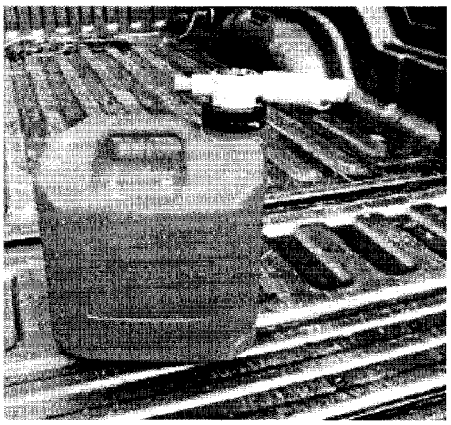
PRIOR ART FIG. 27
FIG. 27 shows an example of a dispensing spout of a prior art portable fluid container.
Figure 27:
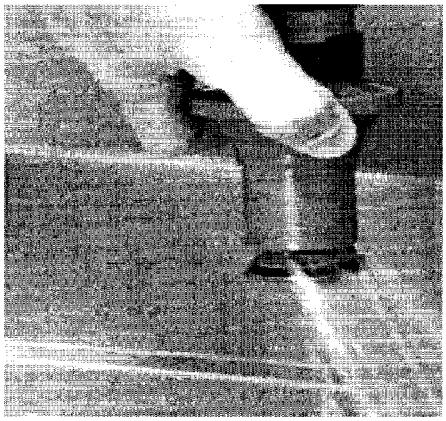
PRIOR ART FIG. 27

Conventional portable fuel containers may provide relatively poor placement of handles and/or spouts for dispensing fluid. For example, as shown in FIG. 27. Spouts for conventional containers may also be relatively difficult to activate and/or control. For example, a conventional spout, such as that shown in FIG. 27, may have a retractable collar design that may enable the flow of fluid but also provides sideways fluid flow that may result in unintentional splashing of fluid. An enclosure 200, 400, 500 of a disclosed assembly 1000, 1000*b*, 1000*c* may provide multiple conveniently located handles 205, 405, 505 for handling the assembly 1000, 1000*b*, 1000*c* and may also include grip(s) 210, 510 to suit the hand of a user handling the assembly 1000, 1000*b*, 1000*c*. The handle(s) 1115 of the container 1100 may be similarly configured.

An assembly 1000, 1000*b*, 1000*c* or the container 1100 may also be provided with a spout 305, 305*b* that may enable relatively easy direction and control of fluid flow (e.g., through the use of a trigger 240 or when the spout is actuated via engagement of the tip of the spout on the inlet opening of a destination container). The spout 305, 305*b* may be sized to fit even small openings (e.g., the spout 305, 305*b* may have a tapered shape) and fluid flow may be controlled and/or regulated to be relatively slow or relatively fast.

Figure 28:
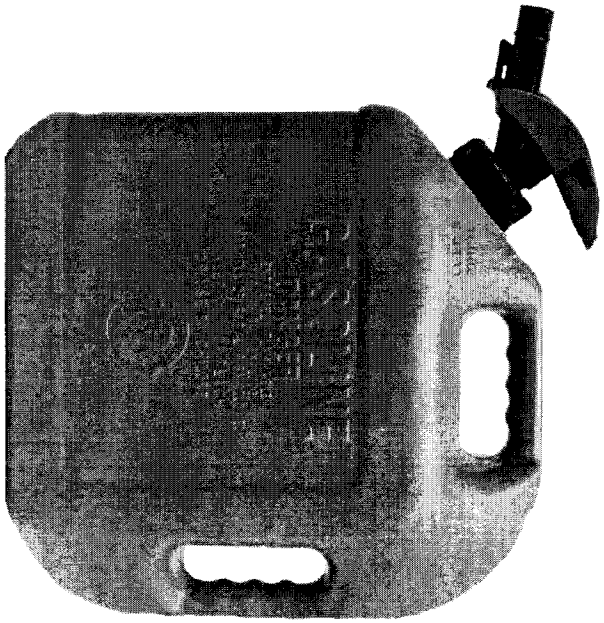
FIG. 28 shows an example of how fluid is dispensed out of a prior art portable fluid container.
Figure 29:
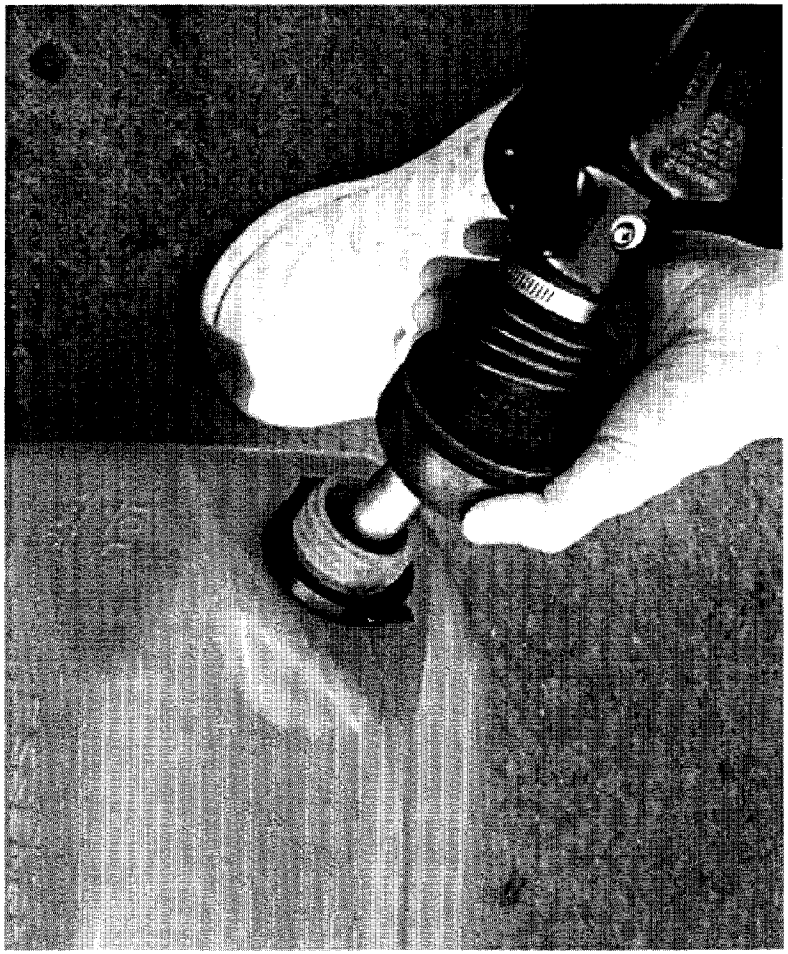
PRIOR ART FIG. 29
FIG. 29 shows an example of how fluid is introduced into a prior art portable fluid container.

Conventional portable fuel containers, even when outfitted with a spout, typically do not provide the user with an easy way to control fluid flow from the spout. Flow from a conventional container may be activated and controlled only by the amount the container is tilted, or may require the container to be pressed against the target tank or destination container. Where the target tank is relatively small or light (e.g., a smaller fluid container), the need to press the conventional portable fuel container against the target may cause the target to move or shift. This may be particularly challenging when the portable fuel container is relatively full. Other conventional portable fuel containers may have a lever or trigger for controlling fluid flow from a spout, but such levers or triggers are typically located near the spout (for example as shown in FIG. 28). This positioning may be awkward for the user to access when pouring fluid and may also cause the user's own hand to obscure viewing of the fluid being dispensed. Conventional portable fuel containers may not be adapted to receive fluid from nozzles equipped with vapor-recovery features. For example, a nozzle may include a bellows for vapor recovery, which a user would have to manually pull back in order to transfer fluid into the conventional portable fuel container (for example as shown in FIG. 29). This may be awkward, and may lead to contamination of the user's hand and/or the spout.

An assembly 1000, 1000*b*, 1000*c* or the container 1100 may provide a trigger 240 to control fluid flow from the assembly 1000, 1000*b*, 1000*c* or the container 1100. The trigger 240 may be remotely located from the spout 305, such that it may be relatively easily accessed by a hand of a user when the assembly 1000, 1000*b*, 1000*c* is tilted to dispense fluid. The trigger 240 may be engaged fully or only a little to dispense fluid quickly or slowly, as appropriate. Because the assembly 1000, 1000*b*, 1000*c* or the container 1100 does not need to be pressed against a fluid target to activate fluid flow, the user may better manage and position the assembly 1000, 1000*b*, 1000*c* or the container 1100 before the flow of fluid is initiated.

Typically, a user may fill a portable fuel container from a commercial fuelling station. A commercial fuelling station may be equipped with commercial dispensers having vapor recovery mechanisms, such as a bellows mechanism. In order to fill up a conventional portable fuel container to a desired fill level using a commercial dispenser with a bellows mechanism, a user may be required to remove the spout from the conventional portable fuel container and set it aside, manually pull back the bellows mechanism on the commercial dispenser, and fill the container while visually determining whether the container is full (e.g., by repeatedly removing the commercial dispenser and looking into the container). The bellows mechanism on a typical commercial fuel nozzle with vapor recovery capabilities typically needs to be either pushed or pulled back in order to activate the nozzle. If the user inserts the spout of the nozzle into a conventional portable fuel container so as to push the bellows back on the inlet opening of the container, the tip of the nozzle will typically be very deep inside the container and the auto shutoff will typically prevent the user from reaching a desirable fill level in the portable container. Thus, a user refueling a conventional portable container at a gas station typically pulls back the bellows on a commercial fuel nozzle with vapor recovery. This process may cause the user's hands to become dirtied, either from removing the container's spout or by handling the bellows mechanism, may cause the spout to become contaminated when it is set aside, may prevent any vapor recovery by the commercial dispenser, and may result in unintentional overflow of the container.

In a disclosed assembly 1000, 1000*b*, 1000*c* or the container 1100, the cover opening 312 of a cover 300*b* may be designed to accommodate a conventional dispenser from a fuelling station, which may have a bellows mechanism for vapor recovery. When the conventional dispenser is inserted into the cover opening 312, the size of the cover opening 312 and the presence of the surrounding flat surface 313 may be such that the bellows mechanism is pushed back, without requiring the user to manually pull back the bellows. The inclusion of a cover opening 312 separate from a spout 305*b* may also avoid the need for the user to remove the spout 305*b* when filling the assembly 1000, 1000*b*, 1000*c* or the container 1100, which may help to avoid the possibility of the user coming into contact with fuel on the spout 305*b*, and also may help to avoid the possibility of contaminating the spout 305*b* when the spout 305*b* is removed and set aside. The height of the cover opening 312 and the surrounding flat surface 313 above the top of the inner body 100 may help to ensure that the tip of the spout on a commercial dispenser (e.g., a fuel nozzle) does not extend too deeply into the inner body 100 so that the auto-shutoff on the commercial dispenser is not tripped until the container assembly 1000, 1000*b*, 1000*c*, or the container 1100 has been filled to a desired fill level. Consequently, when the user does not have to continually check on the fill level in the portable container this may help to avoid unintentional overflow and dripping because the user may not need to repeatedly maneuver or remove the conventional dispenser to determine the level of fluid in the assembly 1000, 1000*b*, 1000*c*, 1000*d* or the container 1100.

Other advantages may be provided by the disclosed assembly 1000, 1000*b*, 1000*c* or the container 1100 in addition to those discussed above.

The selection of suitable materials for any component of the assembly 1000, 1000*b*, 1000*c* or the container 1100, based on such factors as desired durability, corrosion resistance, tolerances, fluid absorbance, etc., will be understood by those skilled in the relevant arts, once they have been made familiar with the present disclosure.

In some examples, the assembly 1000, 1000*b*, 1000*c* or the container 1100 may be used with a dry-break connector that will be described below. The dry-break connector may allow the assembly 1000, 1000*b*, 1000*c* or the container 1100 to be connected to a pump, a dispenser (such as the attachment disclosed herein) or other fluid source/destination relatively quickly and easily, while decreasing the risk of spillage and vapor loss.

The present disclosure also describes dry-break connectors that may be used with the containers and assemblies described above. The disclosed dry-break connectors may also be used with other conventional fluid communication systems (e.g., conventional portable fuel containers).

In some examples, the present disclosure provides a connector for communication of a fluid includes a body defining a connection end and an attachment end, the connection end (or attachment-receiving portion) for receiving a fluid transfer attachment such as a spout and an attachment end (or source-connection portion) for attachment to a fluid source or fluid destination; a first fluid passage defined within the body permitting fluid flow through the body, for example enabling fluid communication at least between the attachment end and the connection end; a first valve for controlling flow of the fluid through the first fluid passage, the first valve being biased towards the connection end to define a valve closed configuration in which fluid flow through the first fluid passage is inhibited; a second fluid passage defined within the body permitting fluid flow through the body, for example enabling fluid communication at least between the connection end and the attachment end; a second valve for controlling flow of the fluid through the second fluid passage, the second valve being biased towards the attachment end to define a valve closed configuration in which fluid flow through the second fluid passage is inhibited; wherein the first valve and the second valve are moveable at least partially from their respective valve closed configurations to respective valve opened configurations by motion of the first valve towards the attachment end, the motion of the first valve being interconnected with motion of the second valve.

Such a connector (or source connector) may be configured as a cap for an opening of a fluid source, such as a portable container, for example.

In some examples, the interconnected motion of the first and second valves may result from a single motion of the first valve towards the attachment end. For example, motion of the first valve toward the attachment end simultaneously, nearly simultaneously or with some slight delay may also unseat the second valve thereby moving the second valve to its valve opened configuration. This may be the case, for example, where the second valve is seated against the first valve when both valves are in their respective valve closed configurations.

In some examples, for at least a portion of the motion of the first valve towards the attachment end, the second valve may be carried along by the first valve towards the attachment end before the second valve is moved to its valve opened configuration.

In some examples, the first fluid passage and the second fluid passage may be generally co-axial.

In some examples, the first valve and the second valve may be independently biased towards their respective valve closed configuration.

In some examples, the first fluid passage may be configured for liquid fluid flow and the second fluid passage may be configured for vapor fluid flow. In some examples, the fluid may be a volatile fluid (e.g., a fluid fuel).

In some examples, the first and second valves may be biased toward their respective valve closed configurations by respective independent first and second biasing members. The first and second biasing members may include compression springs.

In some examples, the connector is formed at least partly of plastic components.

In some examples, the first and second valves may be positioned near the connection end.

In some examples, the first and second valves, when in their respective valve closed configurations, may define a substantially planar surface.

In some examples, the present disclosure also provides a connector for communication of a fluid may include a body defining a connection end and an attachment end, the attachment end for attachment to a fluid source or fluid destination; a first fluid passage defined within the body permitting fluid flow through the body, for example enabling fluid communication at least between the attachment end and the connection end; a first valve for controlling flow of the fluid through the first fluid passage, the first valve being biased towards the attachment end to define a valve closed configuration in which fluid flow through the first fluid passage is inhibited; a second fluid passage defined within the body permitting fluid flow through the body, for example enabling fluid communication at least between the connection end and the attachment end; a second valve for controlling flow of the fluid through the second fluid passage, the second valve being biased towards the connection end to define a valve closed configuration in which fluid flow through the second fluid passage is inhibited; wherein the first valve and the second valve are moveable at least partially from their respective valve closed configurations to respective valve opened configurations; wherein the first valve is moveable to its valve opened configuration by motion of the first valve towards the connection end, the motion of the first valve unseating the second valve.

In the example described herein, the second valve may be carried along with the first valve but the second valve may not open unless the second connector is coupled with a complementary first connector. When thus coupled, the second valve of the second connector may be carried along by motion of the first valve towards the connection end before the second valve is moved to its valve opened configuration by contact with the second valve on the first connector.

Such a connector may be useful as a connection between a fluid container and a fluid dispenser and may complement a connector that serves as a cap for the fluid container as described above, for example.

In some examples, for at least a portion of the motion of the first valve towards the connection end, the second valve may be carried along by the first valve towards the connection end before the second valve is moved to its valve opened configuration.

In some examples, the body may include at least two telescoping portions, wherein relative motion of the telescoping portions causes the motion of the first valve towards the connection end to open the first valve. For example, the second valve may be moveable towards the attachment end by an applied force, to open the second valve.

In some examples, the first fluid passage and the second fluid passage may be generally co-axial.

In some examples, the first valve and the second valve may be independently biased towards their respective valve closed configuration.

In some examples, the first fluid passage may be configured for liquid fluid flow and the second fluid passage may be configured for vapor fluid flow. In some examples, the fluid may be a volatile fluid.

In some examples, the first and second valves may be biased toward their respective valve closed configurations by respective independent first and second biasing members. The first and second biasing members may include compression springs.

In some examples, the connector may be formed at least partly of plastic components.

In some examples, the first and second valves may be positioned near the connection end.

In some examples, the first and second valves, when in their respective valve closed configurations, may define a substantially planar surface.

In some examples, the present disclosure also provides a combination of the two types of connectors described above, defined as first and second connectors, wherein: the first and second connectors are configured to connect with each other at their respective connection ends; when the first and second connectors are connected, the first valve of the first connector contacts or abuts the first valve of the second connector and the second valve of the first connector contacts or abuts the second valve of the second connector, the valves having contacting surfaces that complement each other to permit: the motion of the first valve of the second connector towards the connection end of the second connector to cause the motion of the first valve of the first connector towards the attachment end of the first connector, to open the respective first and second valves of the first and second connectors, to permit fluid flow between the first fluid passages of the respective first and second connectors and fluid flow between the second fluid passages of the respective first and second connectors.

In some examples, the contacting surfaces may be substantially planar.

In some examples, the present disclosure also provides an attachment for communication of a fluid, which may include: a body defining a receiving end and an distal end, the distal end being open to fluid flow; a first fluid passage defined in the body permitting fluid flow through the body, for example enabling fluid communication between the distal end and the receiving end; a second fluid passage defined in the body permitting fluid flow through the body, for example enabling fluid communication at least between the receiving end and the distal end; at least one valve engaging portion housed in the body; the body comprising at least two telescoping portions, wherein motion of the telescoping portions towards each other brings the at least one valve engaging portion towards the receiving end.

Such an attachment may be useful as an attachable and removable dispenser (e.g., a spout) for a fluid container, complementary to the connectors described above.

In some examples, the distal end may be configured as a spout.

In some examples, the first fluid passage and the second fluid passage may be generally co-axial.

In some examples, motion of the telescoping portions towards each other may be actuated by a cable. For example, the cable may be connectable to a trigger remotely located from the attachment for actuating motion of the telescoping portions towards each other.

In some examples, the first fluid passage may be configured for liquid fluid flow and the second fluid passage may be configured for vapor fluid flow. In some examples, the fluid may be a volatile fluid.

In some examples, the attachment may be configured to connect with the connectors described above, wherein: the attachment and the connector are configured to connect with each other at the receiving end and the connection end; when the attachment and the connector are connected, the at least one valve engaging portion of the attachment contacts or abuts the first valve of the connector; and motion of the at least one valve engaging portion towards the connection end causes the single motion of the first valve of the connector towards the attachment end of the connector, to open the first and second valves of the connector, thereby permitting fluid flow between the first fluid passages of the respective attachment and connector and fluid flow between the second fluid passages of the respective attachment and connector.

In some examples, the present disclosure provides a connector kit that may include a combination of at least two of: the two types of connector and the attachment described above.

In some examples, the present disclosure provides a portable fluid container that may include at least one of the connectors described above.

The connectors described above may be referred to as dry-break connectors. The dry-break connectors may each be liquid- and vapor-tight, to inhibit unwanted escape of liquid or vapors. Each connector may be a half of a dry-break connection. When two halves of a dry-break connection are mated, they may form a closed environment in which, when the valves of the connectors are opened, fluid may flow between the two connectors but are inhibited from escaping to the outside environment. When the valves are closed and the two halves are again separated, there may be little or no liquid left on the surface or connection faces of each connector. The connection faces of the connectors may be relatively planar such that they closely contact or abut each other, to reduce the amount of liquid trapped between the two halves of the connection that may remain when the halves are separated. Although the term dry-break may be used to refer to the disclosed connectors, it should be understood that the connection formed may not be perfectly dry.

The attachment, which may be in the form of a dispenser or spout, may cooperate with either half of a dry-break connection to open the valves of the connector and enable fluid flow through the connector.

In some examples, the connectors disclosed here in may provide one half of a dry-break connection that may mate with another half of a dry-break connection that is present on a conventional fluid source/destination (e.g., vehicle fuel tank, pumping system or other such fluid sources/destinations). The connectors disclosed herein may be permanently or removably provided on a fluid container (e.g., the disclosed assembly 1000, 1000*b*, 1000*c* or the container 1100), to allow the fluid container to form a dry-break connection.

The disclosed connectors may also be used to connect the disclosed assembly to a dispensing system (e.g., a manual or electronic pump). For example, the dispensing system may be a stationary or mobile (e.g., cart-mounted) pump. This may allow a consumer to keep multiple portable fluid container assemblies, which may be relatively inexpensive, to refill the dispensing system, which may be more expensive and less portable. Thus, the consumer may need to purchase the more expensive dispensing system only once and may not need to transport the less portable dispensing system to a refilling station for refill.

The disclosed connectors may also be used to connect the disclosed assembly to a two-line hose, for example for dispensing liquid while recovering vapor.

When the disclosed assembly is provided with one of the disclosed connectors, fluid may be dispensed from the assembly only when the valves of the connector are opened. Opening of the valves may occur by mating the connector with another complementary connector, thereby forming a dry-break connection, and opening the connection. Opening of the valves may also occur by fitting the attachment (e.g., spout) described above which cooperates with the connector to open the valves, allowing fluid to flow directly from the assembly through the attachment.

By providing the assembly with a connector that includes valves to inhibit unwanted fluid flow, such valves may not be necessary in the spout. For example, the use of a connector as described above may take the place of a remote trigger for controlling fluid flow from the spout. Instead, the spout may have relatively simple protrusions, as described above, for cooperating with the valves of the connector. This may simplify the design and manufacture of the spout and may allow the spout to be less expensive.

Figure 34:
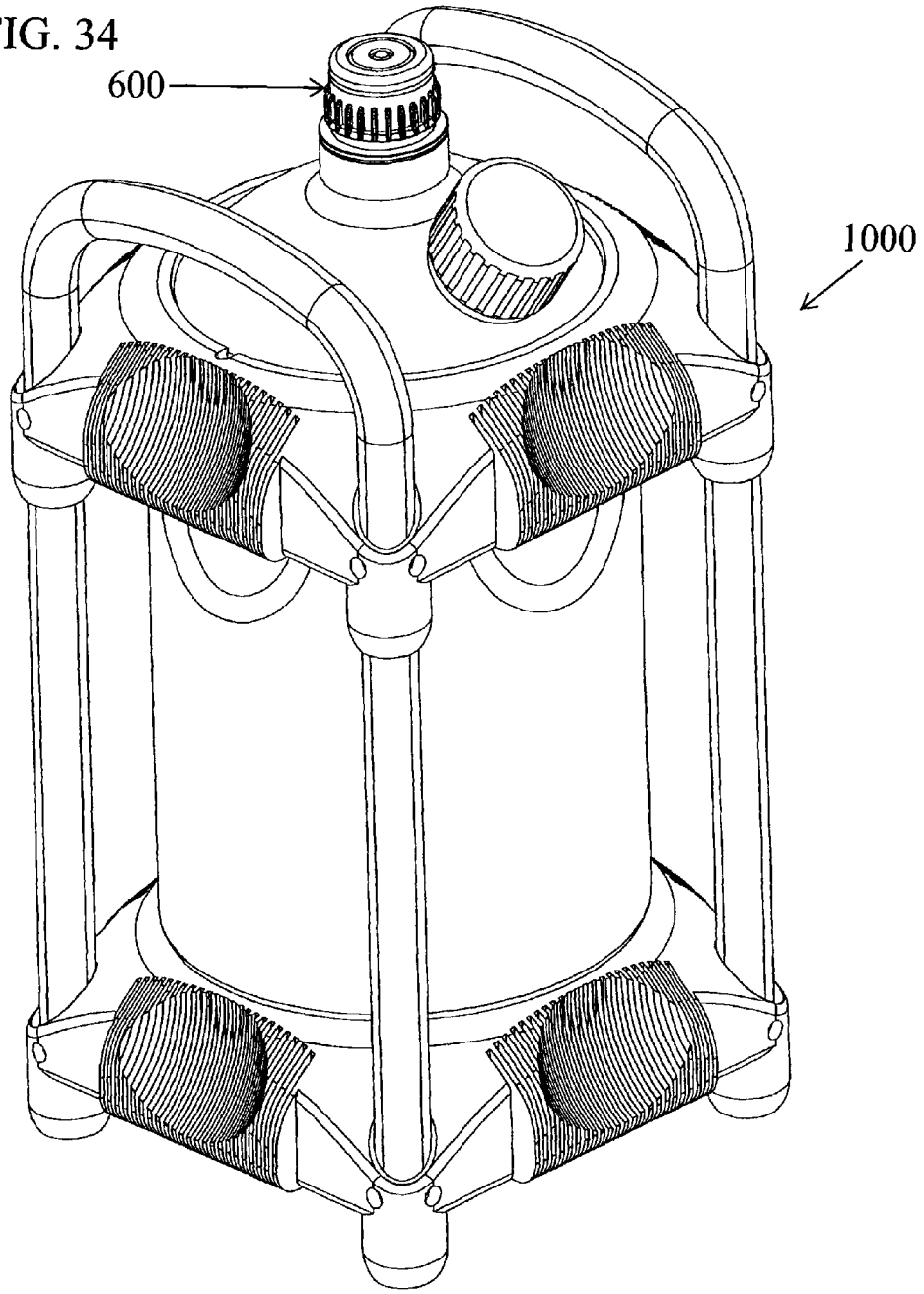
FIGS. 34 and 35 are isometric views showing an example of the disclosed connectors provided on an example of the disclosed assemblies.
Figure 54:
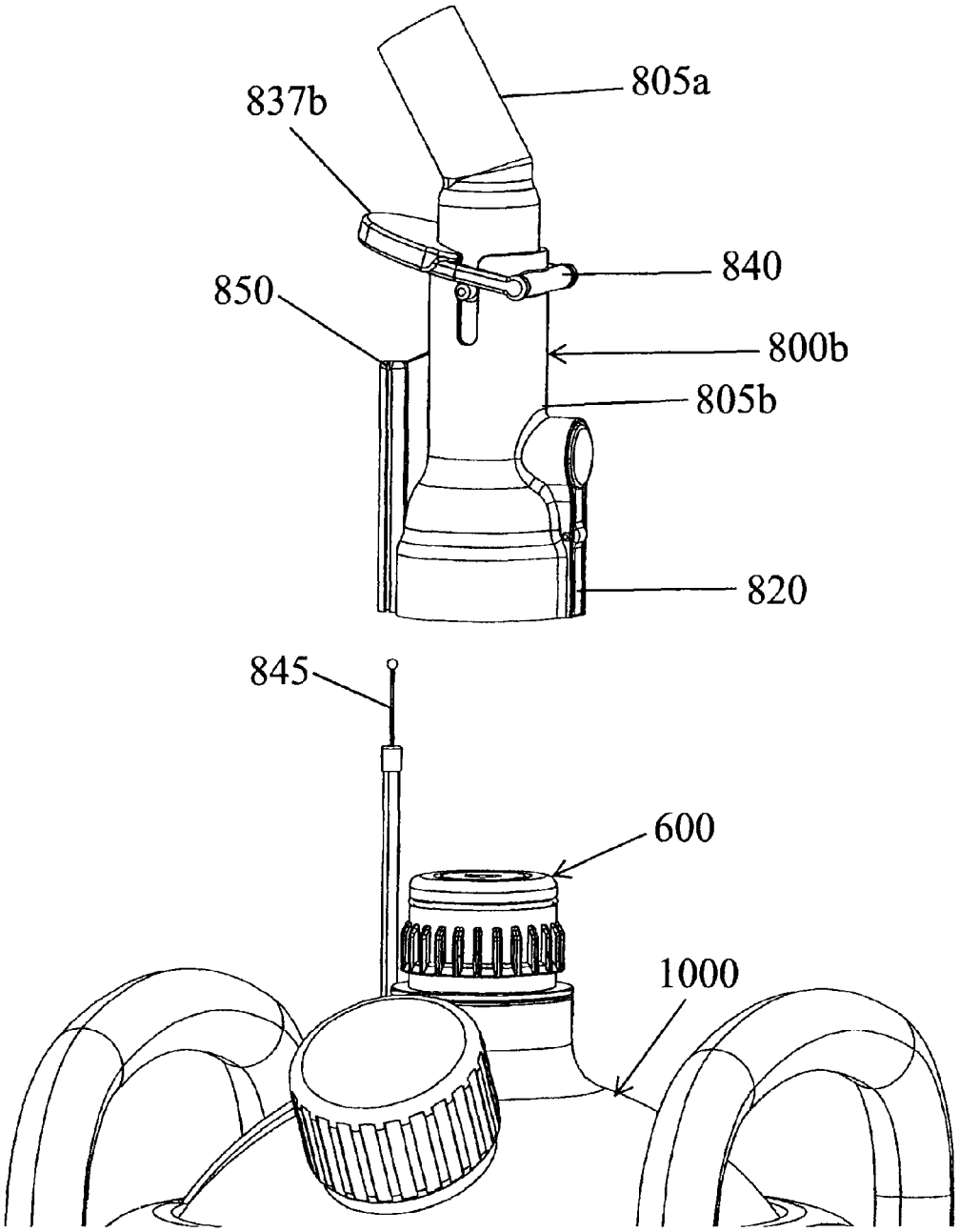
FIGS. 54-56 are isometric views of how the attachment of FIG. 52 and the connector of FIG. 31 may mate and operate together.

The disclosed connectors may be included in a cover 300, 300*b* for the disclosed assembly 1000, 1000*b*, 1000*c* or the container 1100. For example, FIGS. 14 and 54 show that one half of a thy-break connection (e.g., the connector described in the present disclosure), may be included as part of the cover 300*b*, in the form of a connection insert 325. Other configurations incorporating a dry-break connection into the assembly 1000, 1000*b*, 1000*c* or the container 1100 may be possible (e.g., as shown in FIGS. 34 and 54).

Although the disclosed connectors have been described as being used on the disclosed assembly, it should be understood that the disclosed connectors may be suitable for any other fluid container, opening, conduit or other fluid connections.

Examples of the disclosed connectors will now be described in further detail.

Figure 31:
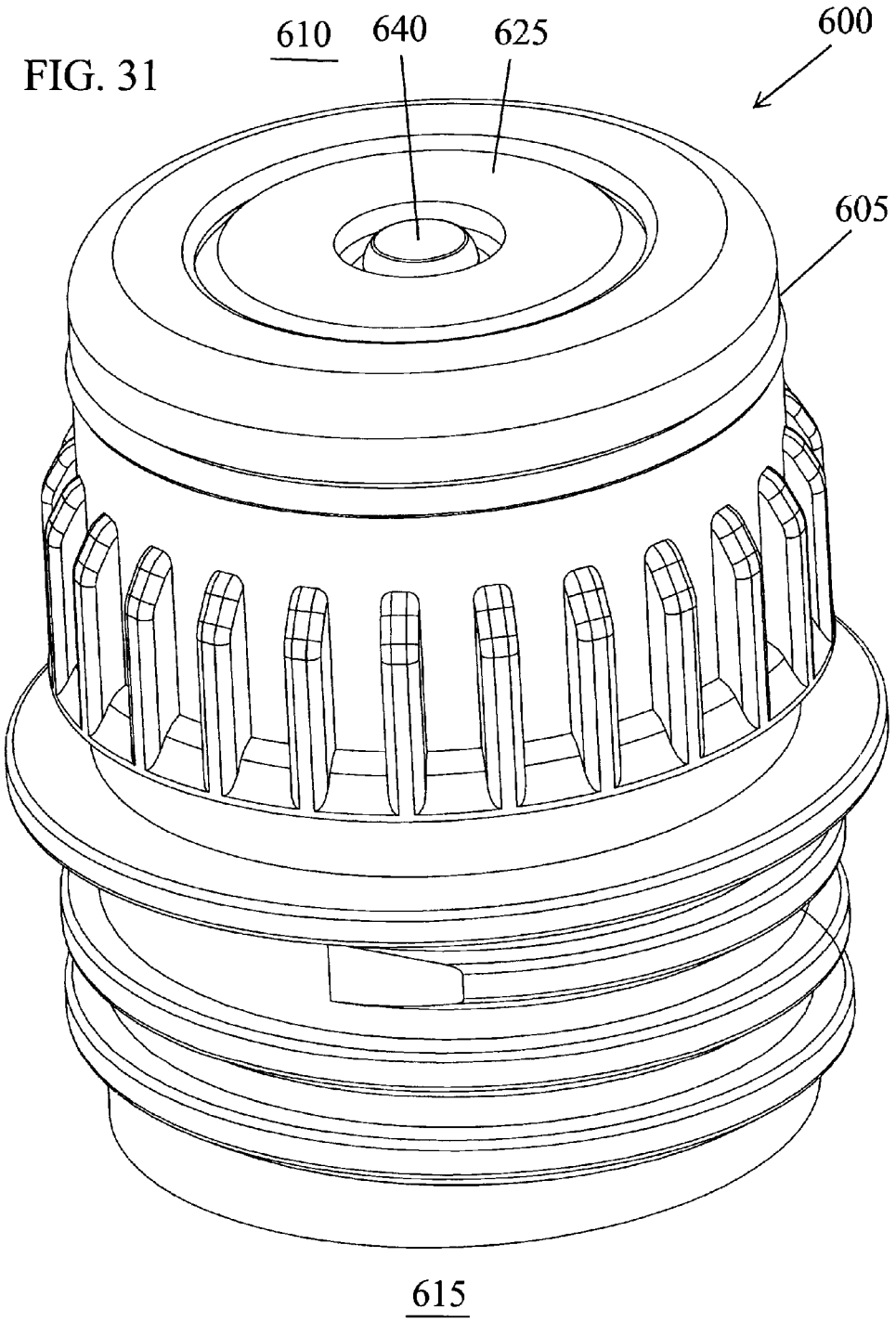
FIG. 31 is an isometric view of an example of the disclosed connectors.
Figure 32:
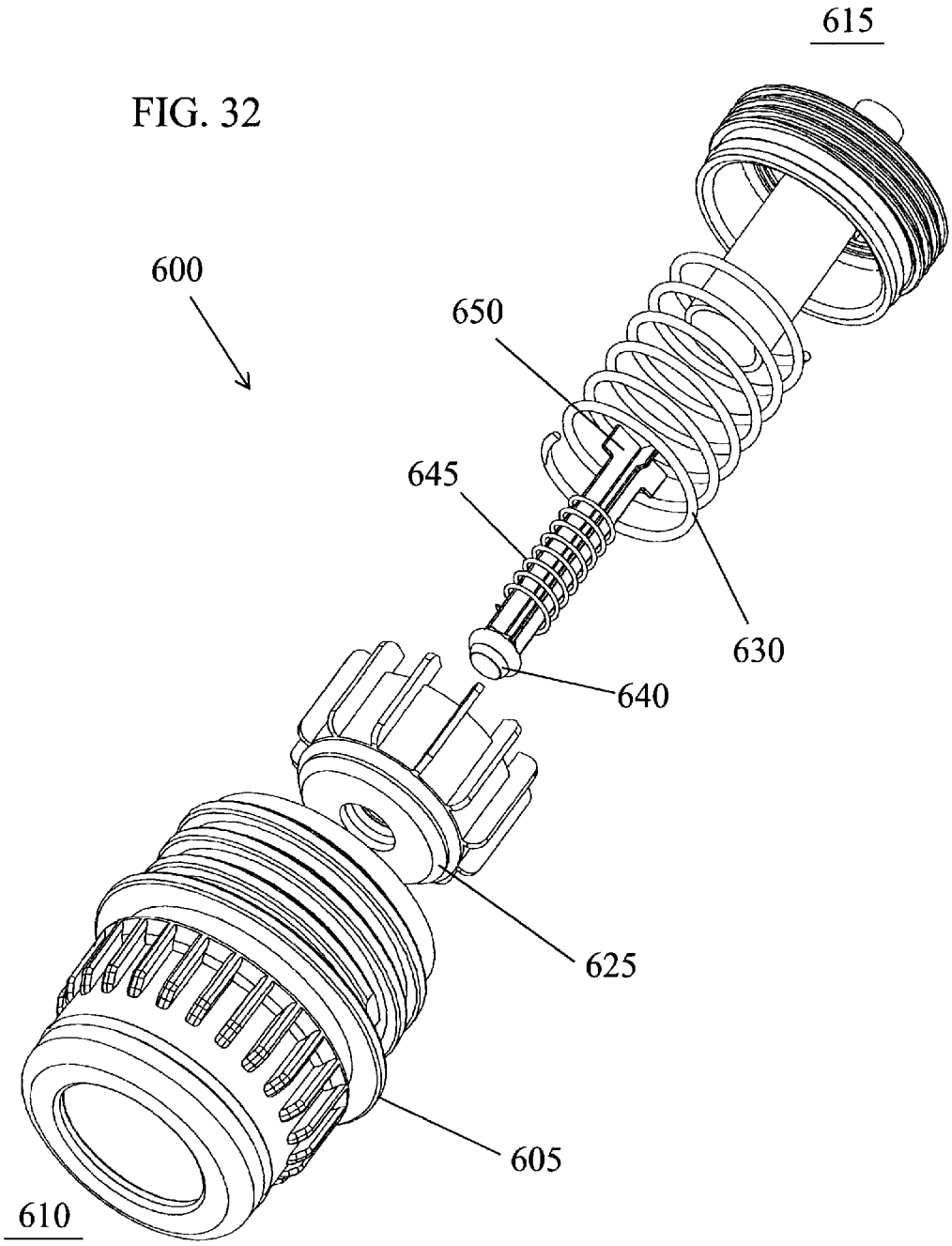
FIG. 32 is an exploded view of the connector of FIG. 31.
Figure 33:
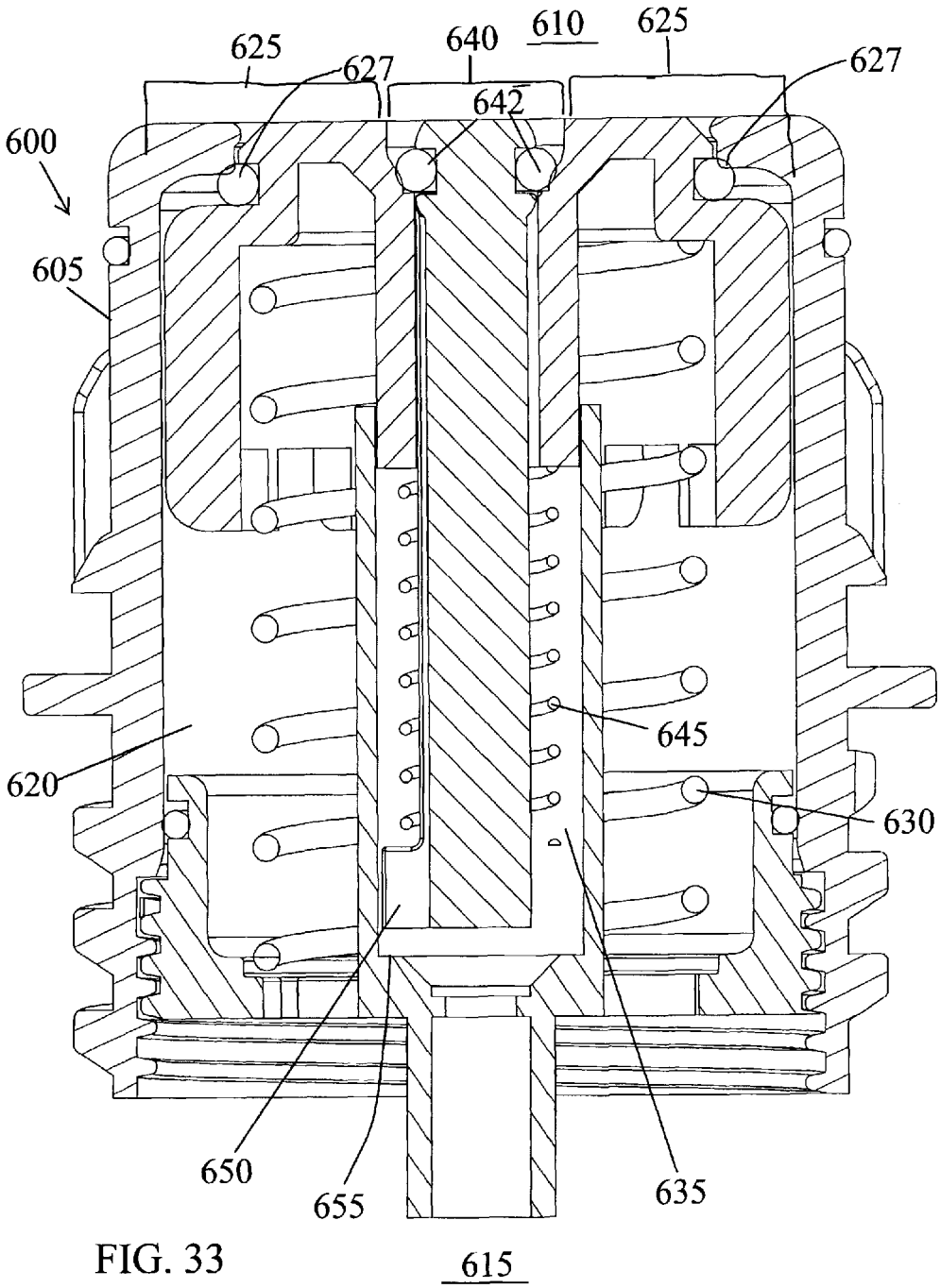
FIG. 33 is a cross-sectional view of the connector of FIG. 31.
Figure 35:
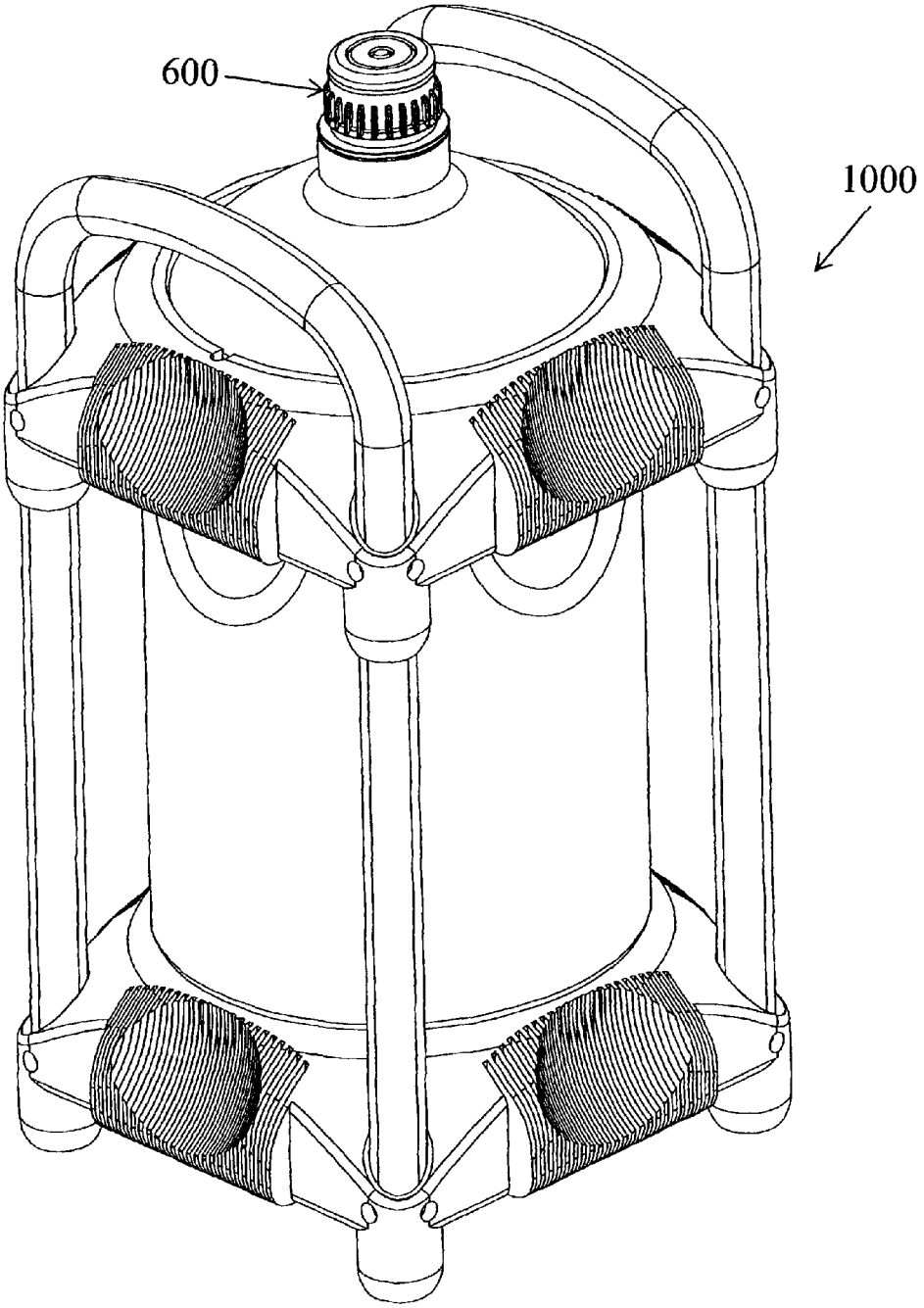
Figure 36:
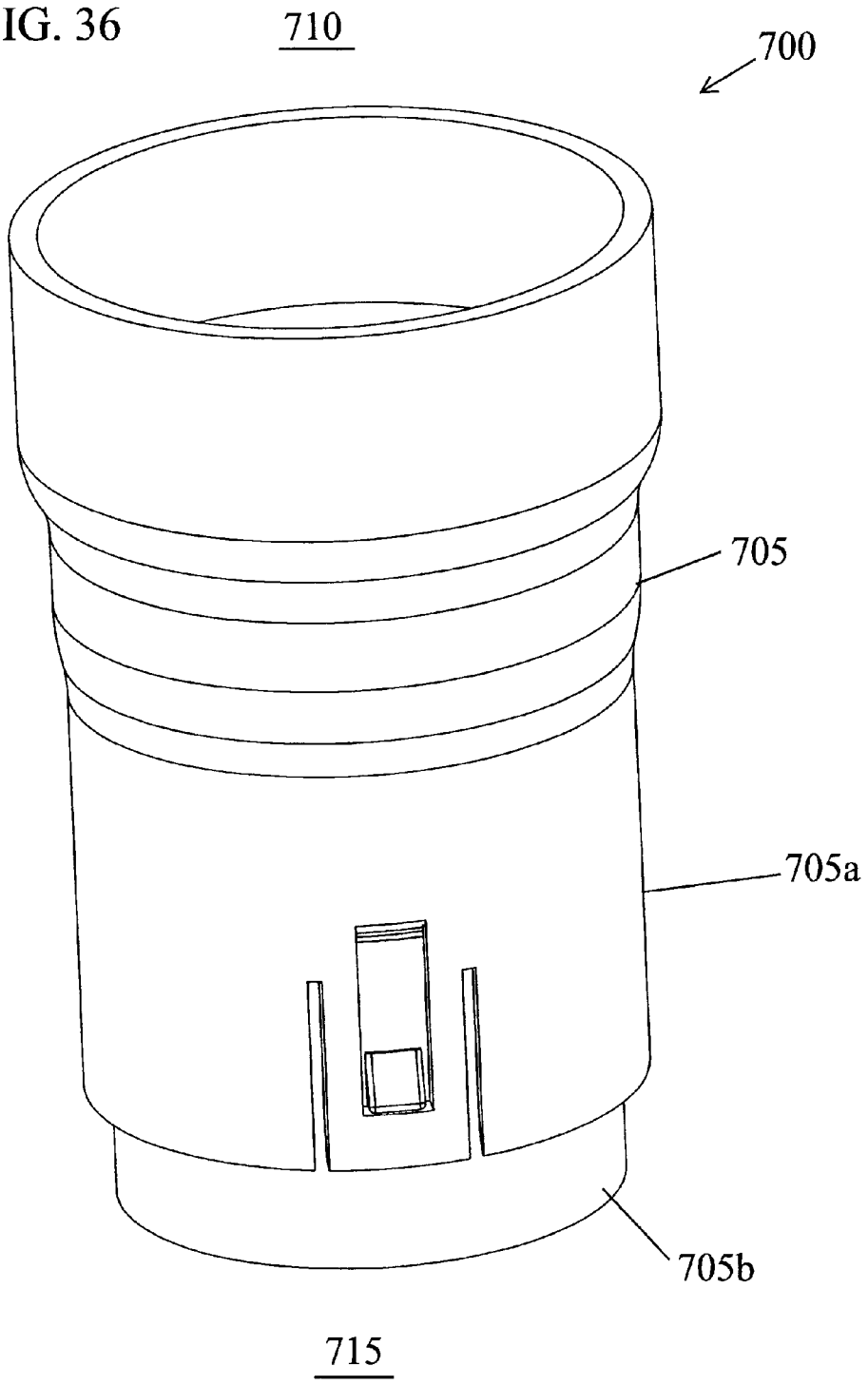
FIG. 36 is an isometric view of another example of the disclosed connectors.
Figure 37:
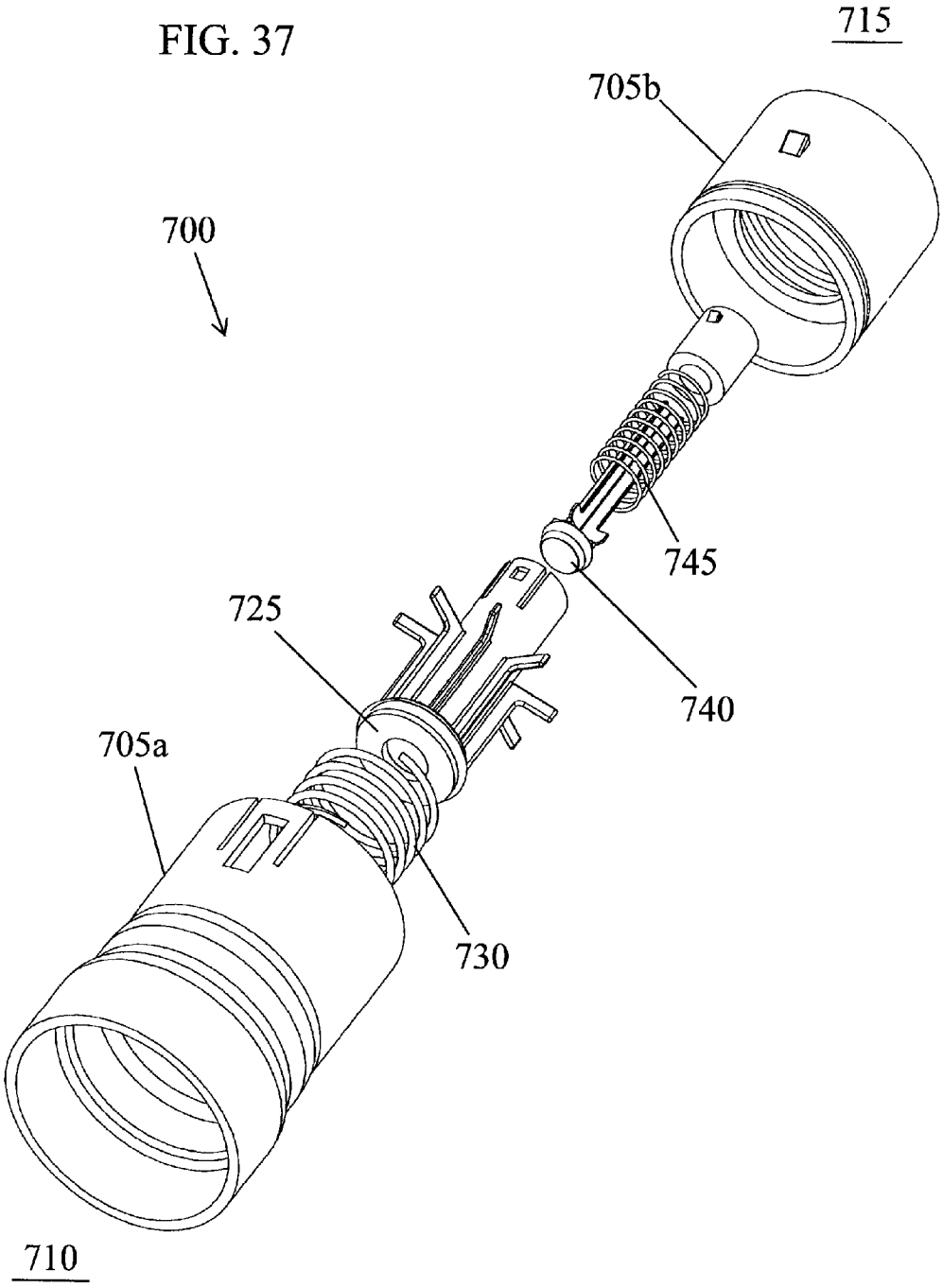
FIG. 37 is an exploded view of the connector of FIG. 36.

FIGS. 31-33 show a first connector 600 that may form one half of a dry-break connection. The connector 600 may be configured as a cover or an insert in a cover for an opening of a fluid container, for example. FIGS. 34-35 illustrate an example of the connector 600 being used as a cover for embodiments of the disclosed assembly 1000. It should be understood that the connector 600 may be used as a cover for any embodiment of the disclosed assembly, as well as other fluid containers, including conventional fluid containers.

The connector 600 includes a body 605 defining a connection end 610 and an attachment end 615. The connector 600 may be attached to a fluid source (e.g., the disclosed assembly) or fluid destination (e.g., the tank of a pump) at or near the attachment end 615, while the connection end 610 may receive another connector to form a dry-break connection. The attachment end 615 may include one or more features (e.g., grooves, threads, protrusions or snap-fittings) to enable attachment of the connector 600 to a fluid source/destination.

A first fluid passage 620 may be defined within the body 605 for permitting fluid flow through the body 605. The first fluid passage 620 may permit fluid to flow to the connection end 610, for example by enabling fluid communication at least between the attachment end 615 and the connection end 610. A first valve 625 may be provided (e.g., in the first fluid passage 620) for controlling or mediating flow of fluid through the first fluid passage 620. The first valve 625 may be sealed using, for example, an o-ring 627 or any other suitable sealing member. The first valve 625 may be biased towards the connection end 610 (e.g., by a biasing member, such as a compression spring 630) to define a closed position (or valve closed configuration) of the first valve 625 in which fluid flow through the first fluid passage 620 is inhibited.

A second fluid passage 635 may be defined within the body 605 permitting fluid flow through the body 605. The second fluid passage 635 may permit fluid to flow from the connection end 610, for example by enabling fluid communication at least between the connection end 610 and the attachment end 615. A second valve 640 may be provided (e.g., in the second fluid passage 635) for controlling flow of fluid through the second fluid passage 635. The second valve 640 may be sealed using, for example, an o-ring 642 or any other suitable sealing member. The second valve 640 may be biased towards the attachment end 615 (e.g., by another biasing member, such as another compression spring 645) to define a closed position (or valve closed configuration) of the second valve 640 in which fluid flow through the second fluid passage 635 is inhibited.

Although the fluid passages 620, 635 have been described as enabling fluid communication between the connection end 610 and the attachment end 615, it should be understood that in operation fluid may not necessarily travel the full distance between the connection end 610 and the attachment end 615.

The first and second valves 625, 640 may be independently biased towards their respective closed positions. Independent biasing of the valves 625, 640 may help to ensure that a fluid-tight seal is maintained by each valve 625, 640 in its respective closed position. For example, each valve 625, 640 may require a different biasing force to maintain a fluid-tight seal. This may be difficult to achieve if a single biasing force were used for both valves 625, 640. The use of independent biasing may also help to simplify manufacture of the connector 600 since it may be easier to adapt manufacturing tolerance levels where the valves 625, 640 are independently biased.

In the example shown, the first and second valves 625, 640 are positioned near the connection end 610 and may define the connection surface. This may allow the valves 625, 640 to form a substantially planar surface for the connector 600 when in their respective closed positions, to help reduce the amount of liquid that might remain when the dry-break connection is separated. In some examples, the first and second valves 625, 640 may be positioned to suit the specific configuration of the particular attachment (e.g., spout), with the being first and second valves 625, 640 operatively mounted with respect to the fluid passages.

To open the connector 600 and permit fluid flow through the connector 600, the first valve 625 and the second valve 640 may be moved at least partially from their respective closed positions to respective opened positions (or valve opened configurations) by moving the first valve 625 towards the attachment end 615. The motion of the first valve 625 may cause the second valve 640 to become unseated.

The interconnected motion of the first and second valves 625, 640 may result from a single motion of the first valve 625 towards the attachment end 615. For example, motion of the first valve 625 toward the attachment end simultaneously, nearly simultaneously or with some slight delay may also unseat the second valve 640 thereby moving the second valve 640 to its opened position (or valve opened configuration). This may be the case, for example, where the second valve 640 is seated against the first valve 625 when both valves 625, 640 are in their respective closed positions, as shown in FIG. 33. In the example shown, the second valve 640 may not be immediately unseated when the first valve 625 starts its motion towards the attachment end 615. The second valve 640 may be carried along by the first valve 625 towards the attachment end 615 for a short period, until a post 650 of the second valve 640 contacts or abuts against a stop 655, at which point the second valve 640 is prevented from moving in the same direction as the first valve 625 and is unseated from the first valve 625.

In the example shown, the first fluid passage 620 and the second fluid passage 635 may be generally co-axial. In other examples, the first fluid passage 620 and the second fluid passage 635 may be in tandem, concentric, contained in each other but off-center, or separated from each other, among other configurations.

The disclosed connector 600 may be used for mediating two-phase fluid flow. For example, the first fluid passage 635 may be configured for liquid fluid flow and the second fluid passage 640 may be configured for vapor fluid flow, or vice versa. In some examples, the fluid may be a volatile fluid (e.g., a fluid fuel). Thus, the connector 600 may provide a two-phase fluid connection, such as for fuel dispensing systems having vapor recovery capabilities.

FIGS. 36-39 show a second connector 700 that may form one half of a dry-break connection. The second connector 700 may mate with the first connector 600 to form a dry-break connection, as will be described. The connector 700 includes a body 705 defining a connection end 710 and an attachment end 715. The connector 700 may be attached to a fluid source (e.g., the disclosed assembly) or fluid destination (e.g., the tank of a pump) at or near the attachment end 715, while the connection end 710 may receive another connector (e.g., the connector 600) to form a dry-break connection. The attachment end 715 may include one or more features (e.g., grooves, threads, protrusions or snap-fittings) for attaching the connector 700 to a fluid source/destination.

A first fluid passage 720 may be defined within the body 705 for permitting fluid flow through the body 705. The first fluid passage 720 may permit fluid to flow to the connection end 710, for example by enabling fluid communication at least between the attachment end 715 and the connection end 710. A first valve 725 may be provided (e.g., in the first fluid passage 720) for controlling or mediating flow of fluid through the first fluid passage 720. The first valve 725 may be sealed with a sealing member, such as an o-ring 727 or any other suitable sealing member. The first valve 725 may be biased (e.g., by a biasing member, such as a coil spring 730) towards the attachment end 715 to define a closed position (or valve closed configuration) for the first valve 725 in which fluid flow through the first fluid passage 720 is inhibited.

A second fluid passage 735 may be defined within the body 705 for permitting fluid flow through the body 705. The second fluid passage 735 may permit fluid to flow from the connection end 710, for example by enabling fluid communication at least between the connection end 710 and the attachment end 715. A second valve 740 may be provided (e.g., in the second fluid passage 735) for controlling or mediating flow of fluid through the second fluid passage 735. The second valve 740 may be sealed with a sealing member, such as an o-ring 742 or any other suitable sealing member. The second valve 740 may be biased (e.g., by another biasing member, such as another coil spring 745) towards the connection end 710 to define a closed position (or valve closed configuration) of the second valve 740 in which fluid flow through the second fluid passage 735 is inhibited.

Although the fluid passages 720, 735 have been described as enabling fluid communication between the connection end 710 and the attachment end 715, it should be understood that in operation fluid may not necessarily travel the full distance between the connection end 710 and the attachment end 715.

The first and second valves 725, 740 may be independently biased towards their respective closed positions, similarly to the first and second valves 625, 640, with similar advantages.

In the example shown, the first and second valves 725, 740 are positioned near the connection end 710. This may allow the valves 725, 740 to form a substantially planar surface for the connector 700 when in their respective closed positions, to help reduce the amount of liquid that might remain when the dry-break connection is separated.

To open the connector 700 and permit fluid flow through the connector 700, the first valve 725 and the second valve 740 may be moved at least partially from their respective closed positions to respective opened positions (or valve opened configurations) by moving the first valve 725 towards the connection end 710. The motion of the first valve 725 may cause the second valve 740 to become unseated.

In the example described herein, the second valve 740 may be carried along with the first valve 725 but the second valve 740 may not open unless the second connector 700 is coupled with a complementary first connector 600. When thus coupled, the second valve 740 of the second connector 700 may be carried along by motion of the first valve 725 towards the connection end 710 before the second valve 740 contacts the second valve 640 of the first connector 600 and is prevented from moving the first valve 725, thereby moving the second valve 740 to its opened position (or valve opened configuration).

Figure 38:
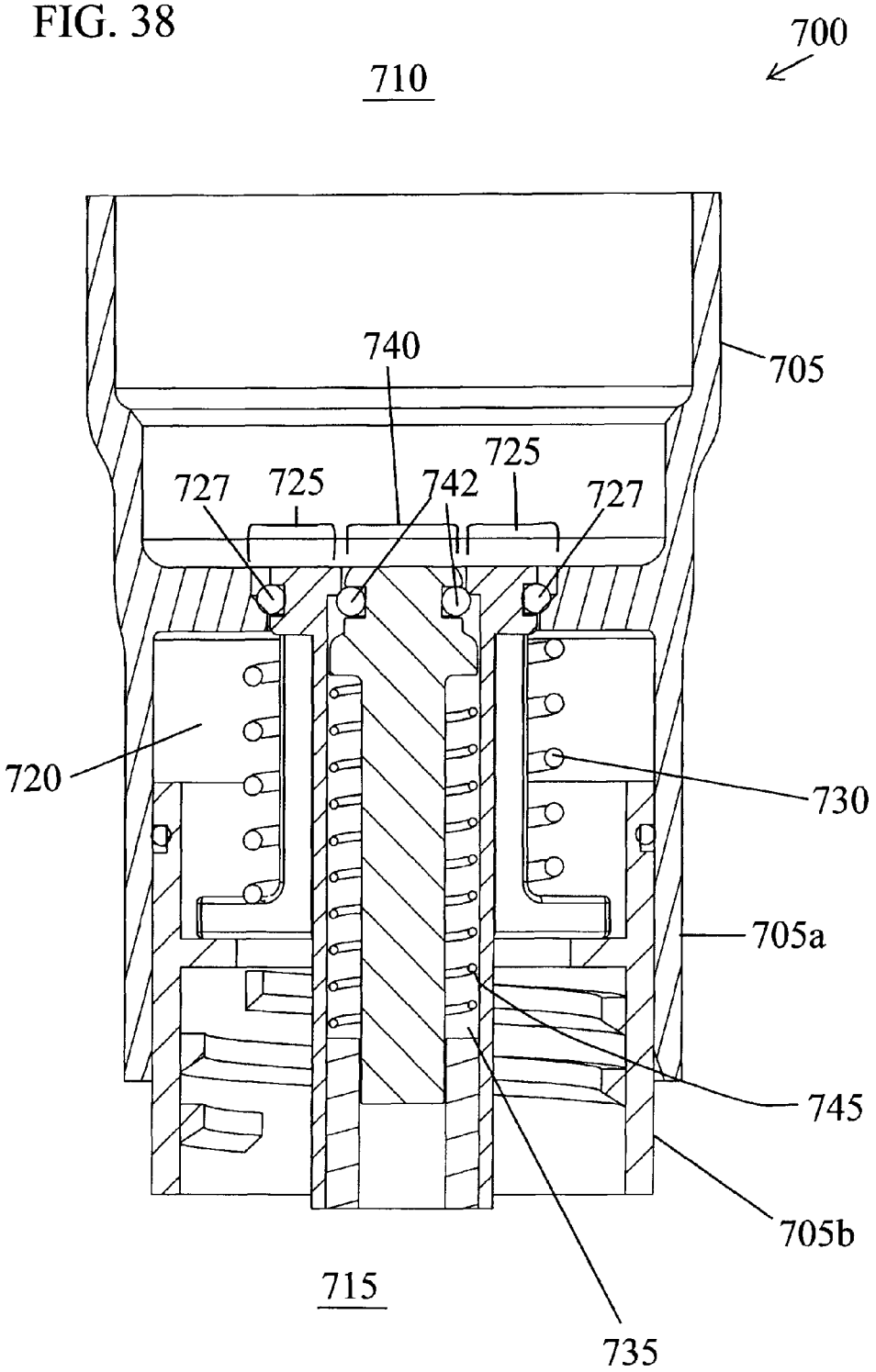
FIGS. 38 and 39 are cross-sectional views of the connector of FIG. 36 in valve closed and valve opened configurations.
Figure 39:
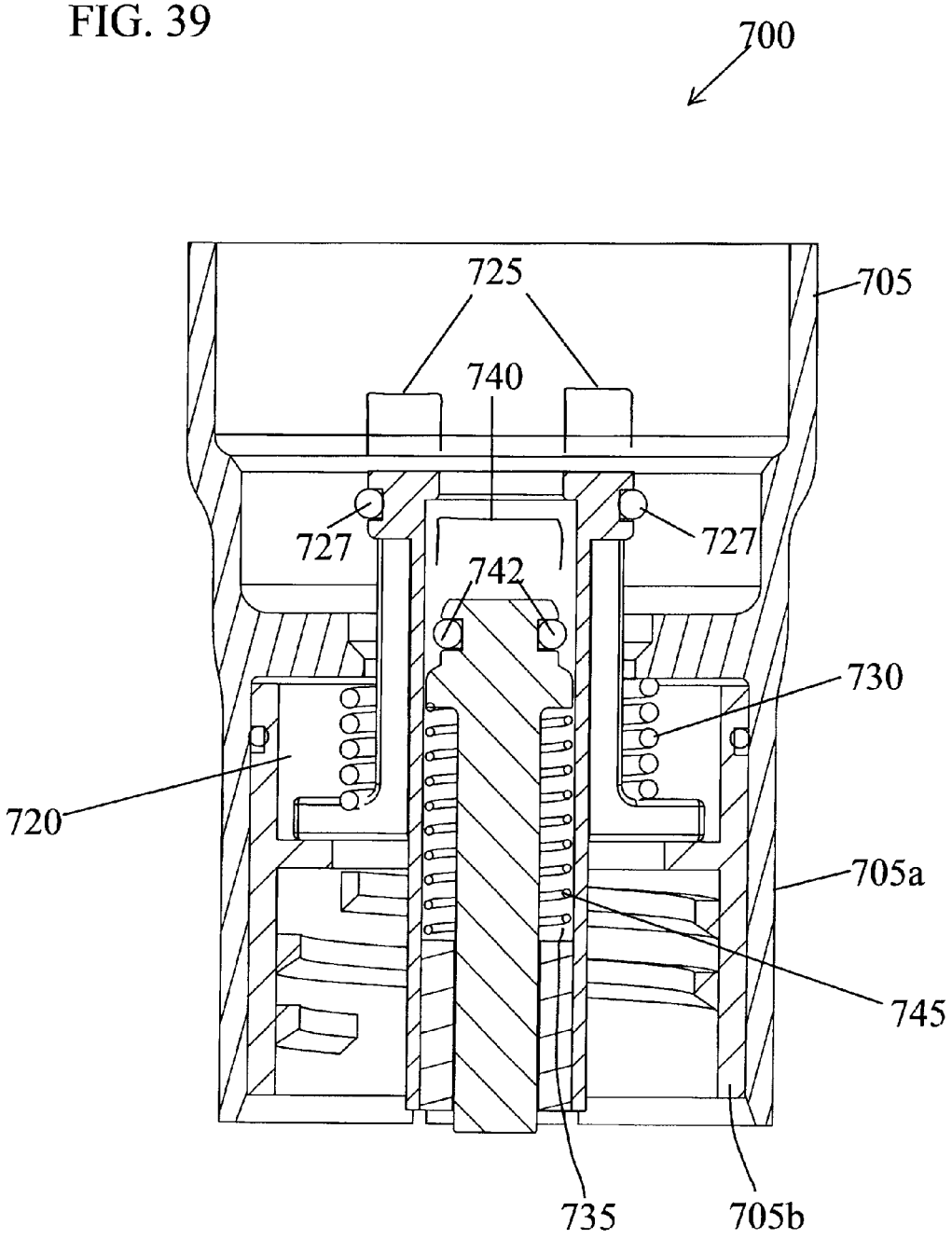
Figure 40:
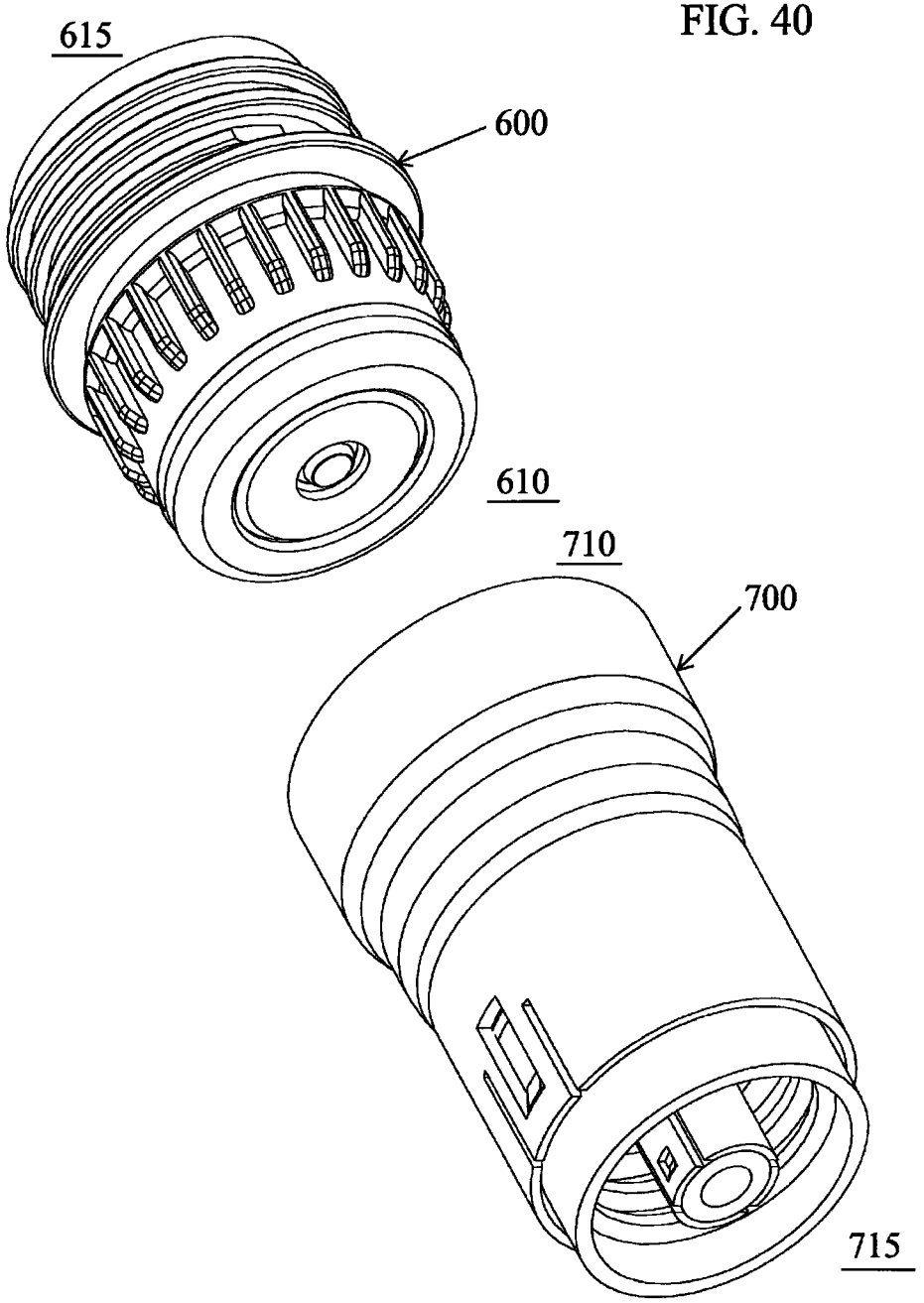
FIGS. 40-44 are various views of how the connector of FIG. 31 and the connector of FIG. 36 may mate together.
Figure 41:
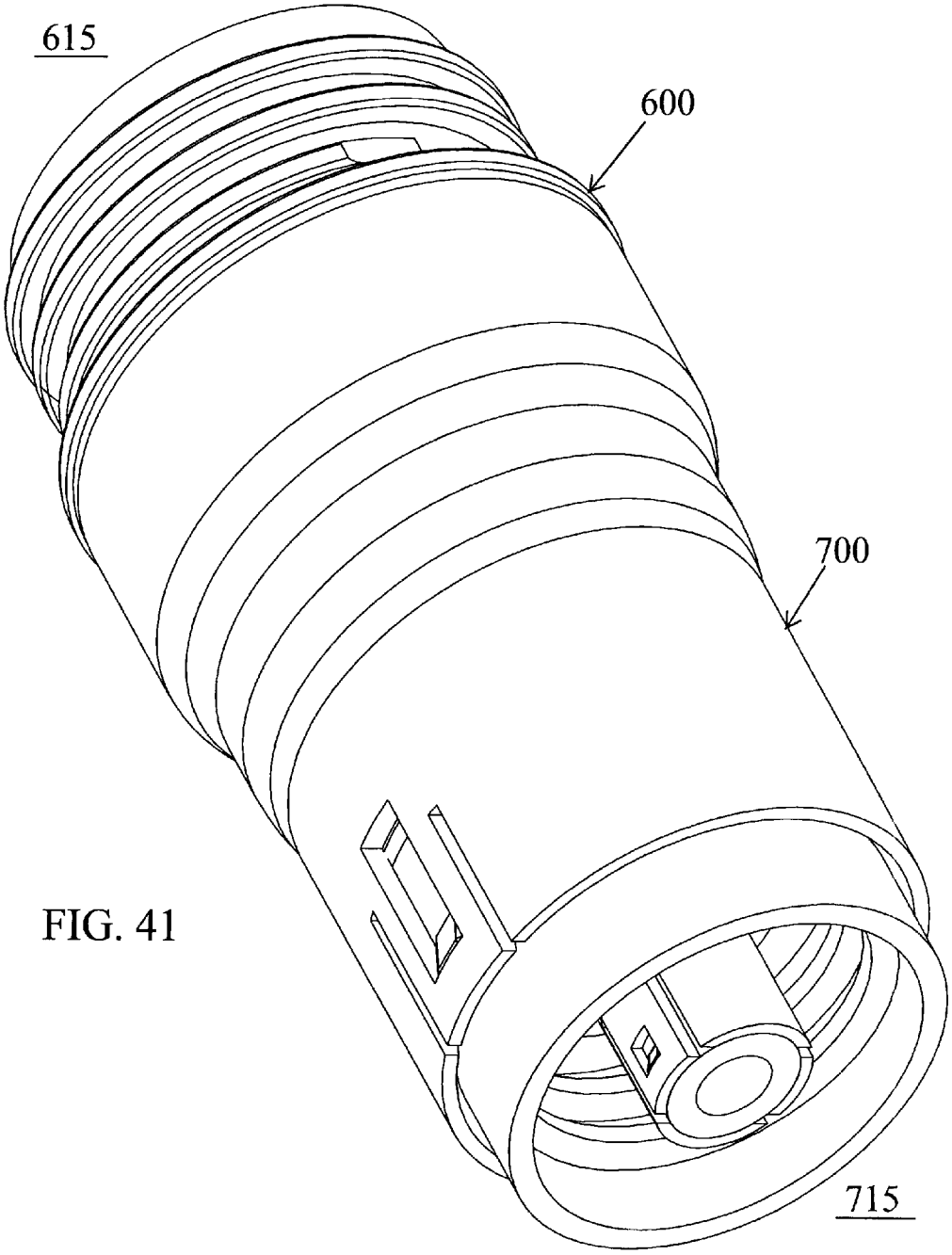
Figure 42:
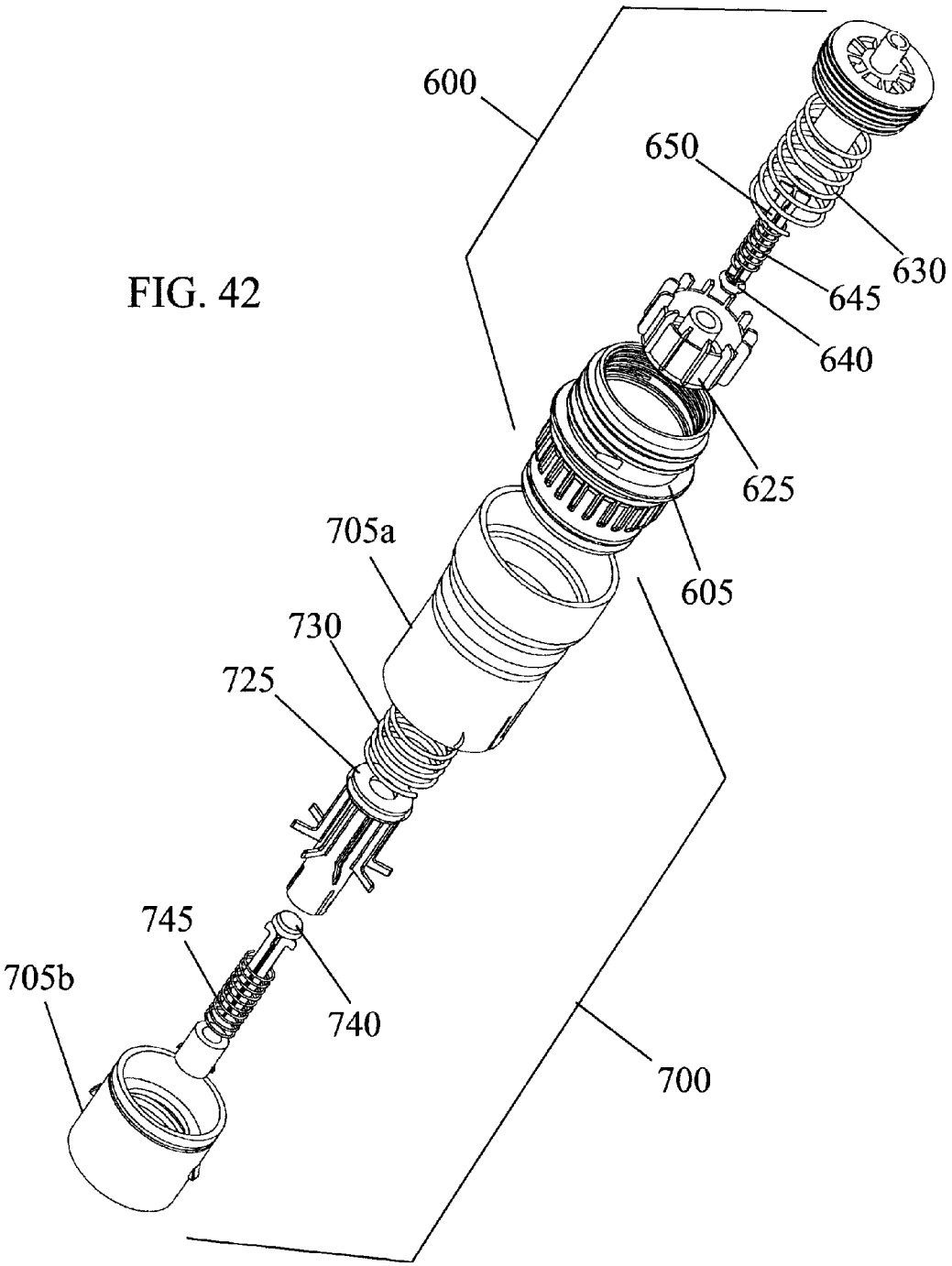
Figure 43:
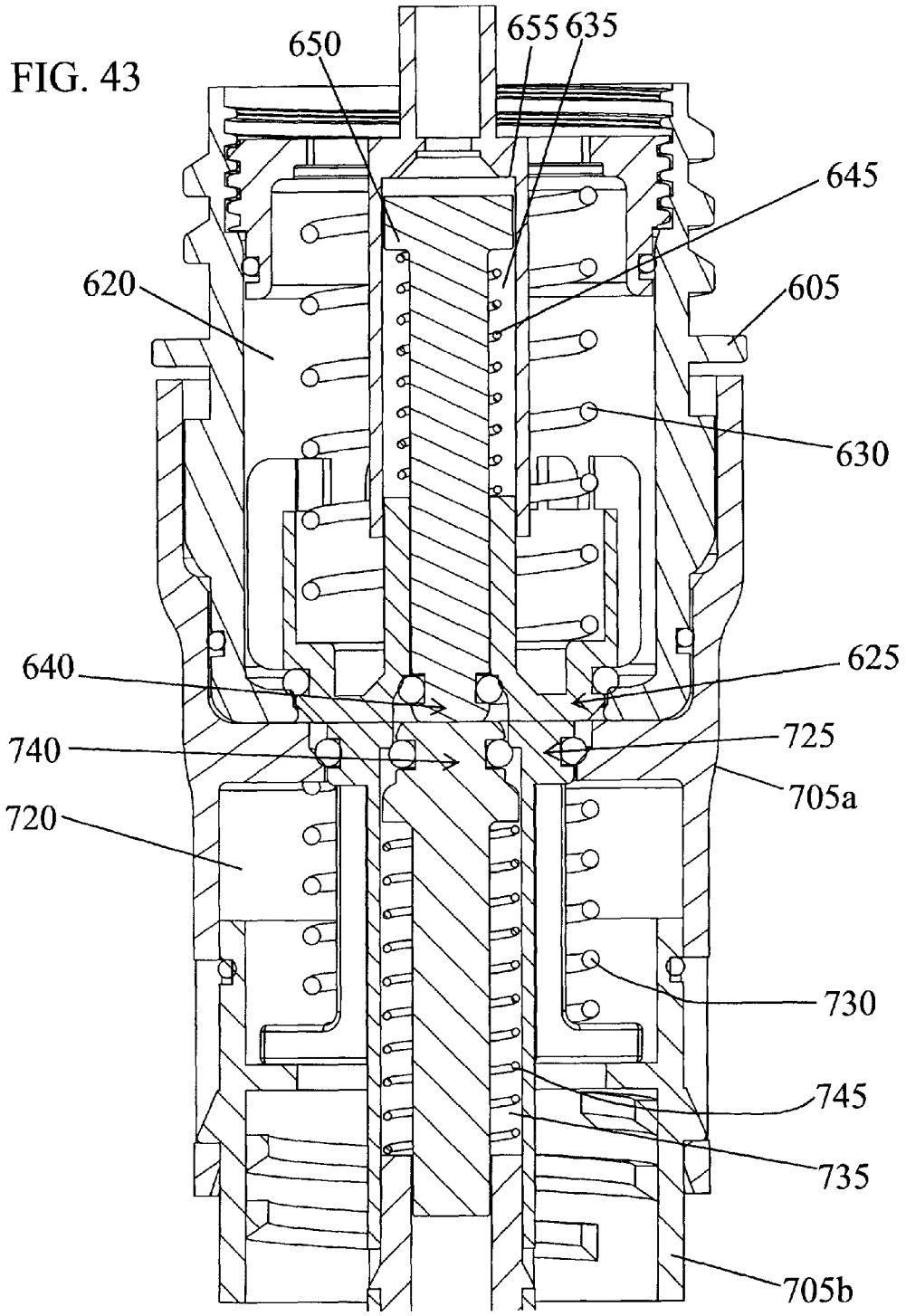
Figure 44:
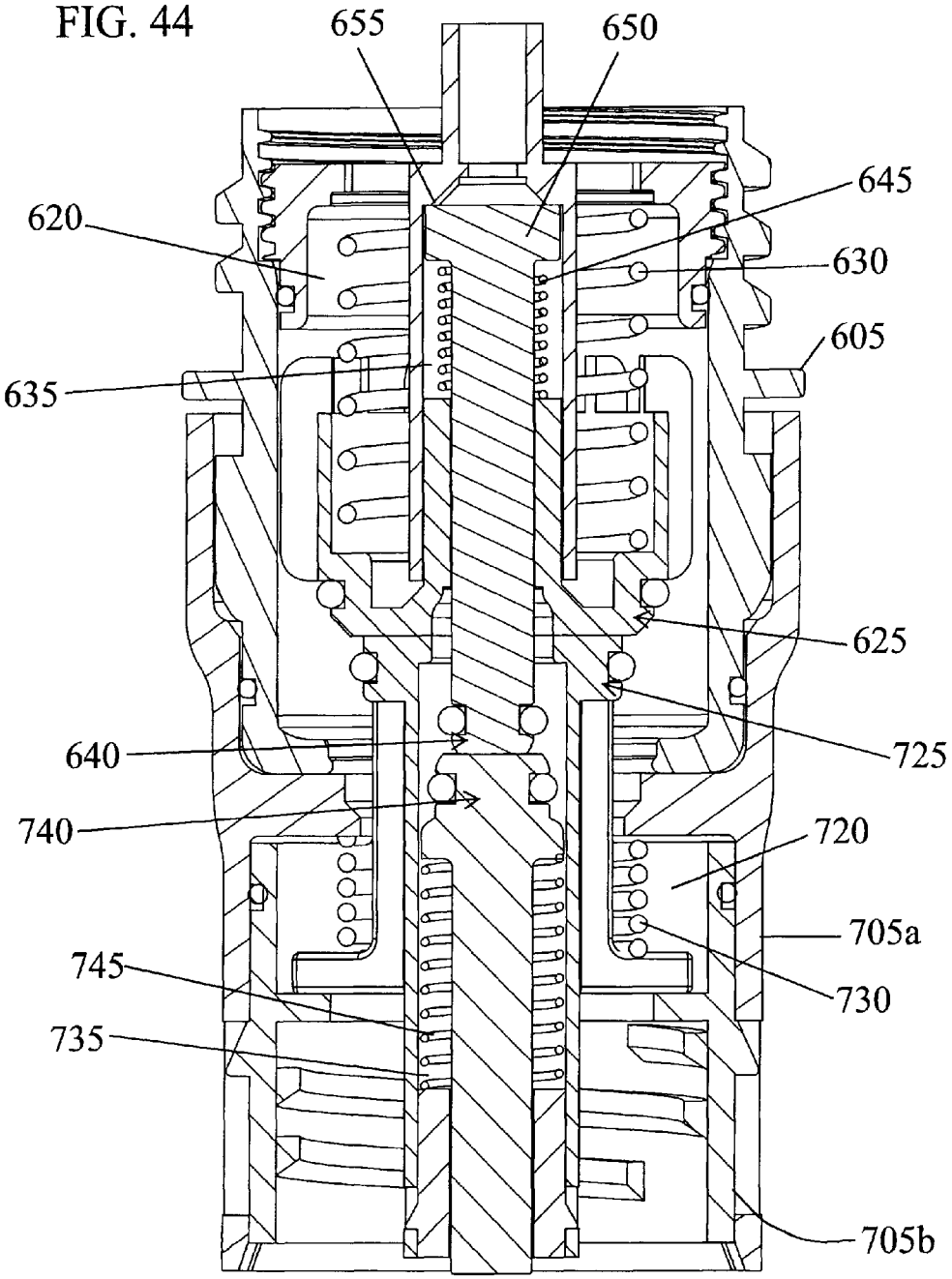

The interconnected motion of the first and second valves 725, 740 may result from a single motion of the first valve 725 towards the connection end 710. For example, motion of the first valve 725 toward the connection end 710 may simultaneously, nearly simultaneously or with some slight delay may also unseat the second valve 740 thereby moving the second valve 740 to its opened position (e.g., when the second connector 700 is coupled with the first connector 600). This may be the case, for example, where the second valve 740 is seated against the first valve 725 when both valves 725, 740 are in their respective closed positions, as shown in FIG. 38. In the example shown, the second valve 740 may not be immediately unseated when the first valve 725 starts its motion towards the connection end 710. The second valve 740 may be carried along by the first valve 725 towards the connection end 710 for a short period, until the second valve 740 contacts or abuts against the other half of the dry-break disconnect as shown in FIG. 44 (e.g., the connection surface of the connector 600) and is unseated from the first valve 725, as shown in FIG. 39.

In some examples, the body 705 may include at least two telescoping portions 705*a*, 705*b*. Relative motion of the telescoping portions 705*a*, 705*b* (e.g., to thereby shorten the body 705) may move the first valve 720 towards the connection end 710 to open the first valve 720. In some examples, the second valve 735 may be moveable towards the attachment end 715, independently of any motion of the first valve 720, to open the second valve 735.

In the example shown, the first fluid passage 720 and the second fluid passage 735 may be generally co-axial. In other examples, the first fluid passage 720 and the second fluid passage 735 may be in tandem, concentric, contained in each other but off-center, or separated from each other, among other configurations. The first and second fluid passages 720, 735 may be configured to correspond to the configuration of fluid passages to which the connector 700 is being connected. For example, where the second connector 700 is intended to mate with the first connector 600, the first and second fluid passages 720, 735 of the second connector 700 may be configured to match the configuration of the first and second fluid passages 620, 635 of the first connector 600.

The disclosed connector 700 may be used for mediating two-phase fluid flow. For example, the first fluid passage 735 may be configured for liquid fluid flow and the second fluid passage 740 may be configured for vapor fluid flow, or vice versa. In some examples, the fluid may be a volatile fluid (e.g., a fluid fuel). Thus, the connector 700 may provide a two-phase fluid connection, such as for fuel dispensing systems having vapor recovery capabilities.

As shown in FIGS. 40-44, the first connector 600 and the second connector 700 may be configured to mate with each other at their respective connection ends 610, 710 to form a dry-break connection.

When the first and second connectors 600, 700 are connected in this manner, the first valve 625 of the first connector 600 may contact or abut the first valve 725 of the second connector 700 and the second valve 640 of the first connector 600 may contact or abut the second valve 740 of the second connector 700. The contacting surfaces of the valves 625, 640, 725, 740 may complement each other (e.g., the contacting surfaces may all be substantially planar).

By moving the first valve 725 of the second connector 700 towards the connection end 710 of the second connector 700 (e.g., by bringing the telescoping portions 705*a*, 705*b* of the second connector 700 towards each other), the first valve 625 of the first connector 600 may be moved towards the attachment end 615 of the first connector 600, thereby opening the respective first and second valves 625, 640, 725, 740 of the first and second connectors 600, 700 and permitting fluid flow between the connectors 600, 700.

When the telescoping portions 705*a*, 705*b* are moved relative to each other (e.g., towards each other), the first valve 725 of the second connector 700 may be brought towards the connection end 710 of the second connector. Because the first valve 725 of the second connector 700 may contact or abut against the first valve 625 of the first connector 600, this motion also may cause the first valve 625 of the first connector 600 to move towards the attachment end 615 of the first connector. This may cause the second valve 640 of the first connector 600 to become unseated when the post 650 of the second valve 640 is stopped by the stop 655. Because the second valve 640 of the first connector 600 may contact or abut the second valve 740 of the second connector 700, the second valve 740 of the second connector 700 may also be unseated.

The first and second fluid passages 620, 635 of the first connector 600 may be configured to match the position of the respective first and second fluid passages 720, 735 of the second connector 700 when the connectors 600, 700 are mated. Thus, fluid may flow between the first fluid passages 620, 720 of the respective first and second connectors 600, 700 and also between the second fluid passages 635, 735 of the respective first and second connectors 600, 700.

Figure 66:
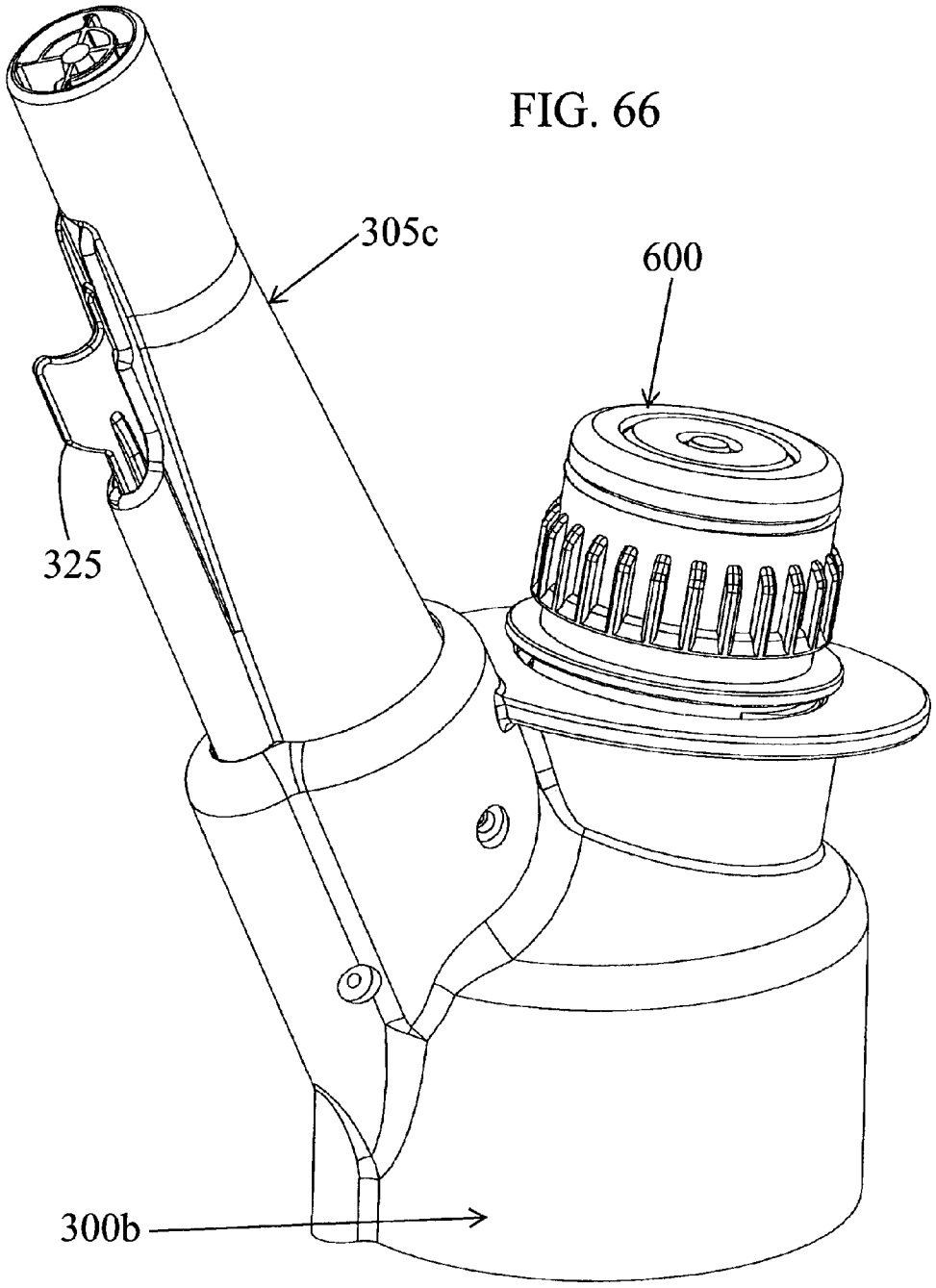

As shown in the drawings, for example FIG. 66, one of the connectors 600, 700 may be used to replace the cap 310 or cover 350 of the assembly 1000, 1000*b*, 1000*c* or the container 1100. In the example of FIG. 66, the connector 600 may replace the cap 310 of the cover 300*b* for the assembly 1000, 1000*b*, 1000*c* or the container 1100. Such a configuration may allow fluid to be received by or removed (or dispensed) from the assembly 1000, 1000*b*, 1000*c* or the container 1100, or other such container without having to remove the cap 310 or the cover 350, which may help to simplify the transfer of fluid, may help to reduce unwanted escape of vapors, may reduce the risk of contamination and/or may reduce the risk of misplacing the cap 310 or cover 350, for example. The use of the connector 600, 700 in place of the cap 310 or cover 350 may also provide the assembly 1000, 1000*b*, 1000*c* or the container 1100 with an additional point of connection for fluid communication. For example, the use of the connector 600 in place of the cap 310 in FIG. 66 may allow fluid to be both dispensed using the spout 305*c* as well as using the connector 600 to connect to a dispenser (e.g., a pump, a hose or another spout).

Figure 67:
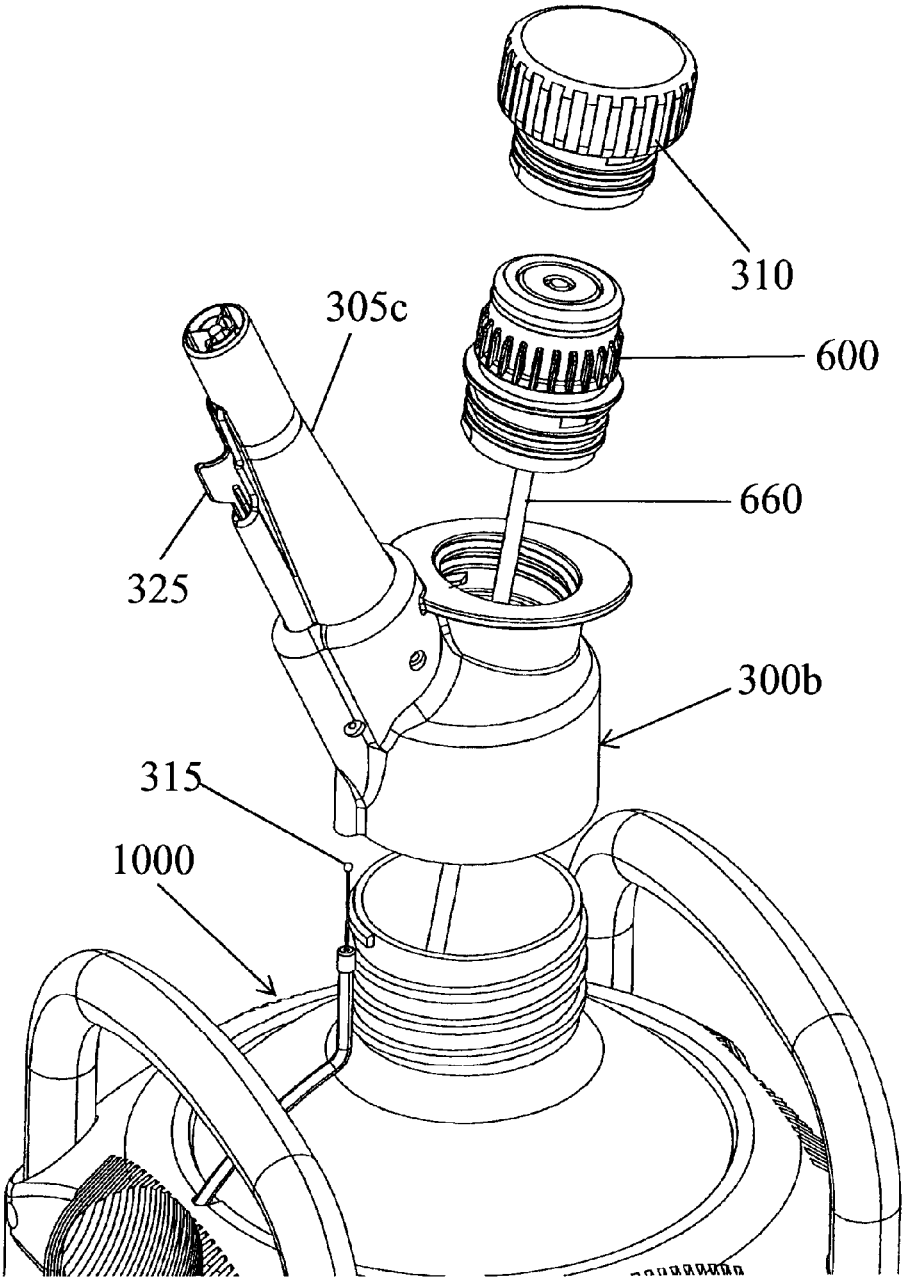
Figure 68:
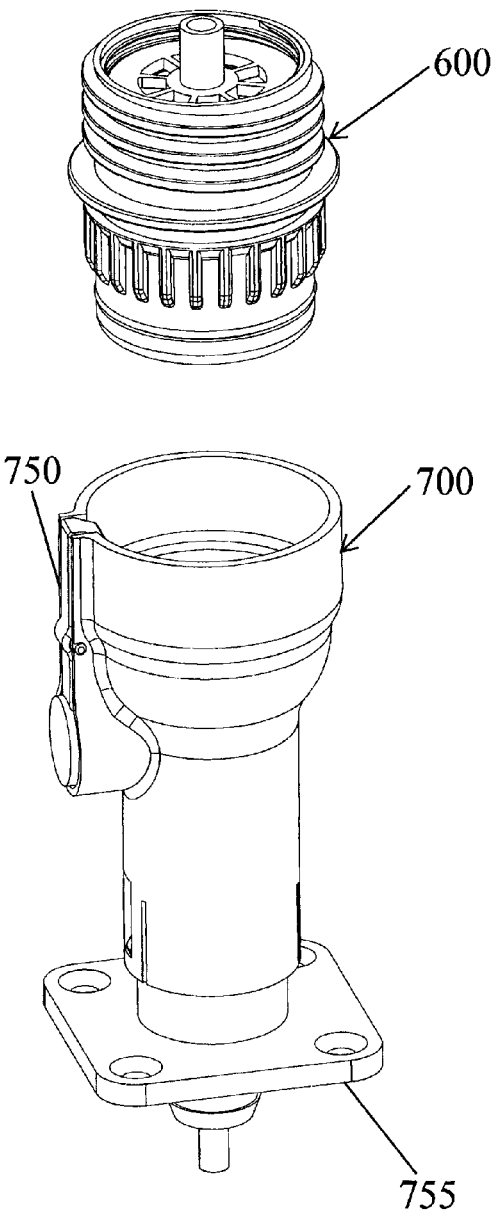
FIGS. 68 and 69 are isometric views of the connectors of FIGS. 31 and 36 in another variation.
Figure 69:
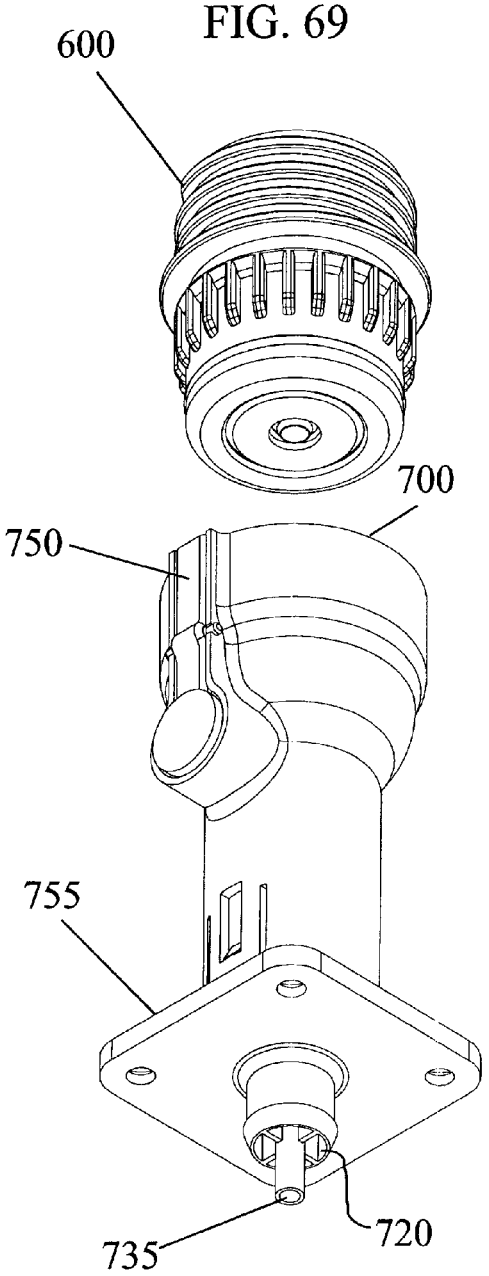

FIG. 67 shows another example where one of the connectors 600, 700 (in the example shown, the connector 600 is used) is used in addition to the cap 310 on the cover 300*b* for the assembly 1000. In this example, the cap 310 may fit over the connector 600 and may provide an extra degree of protection against contamination and/or unintentional escape of vapors, for example.

FIG. 67 also shows an example of a conduit extension 660 that may be in fluid communication with any of the fluid passages 620, 635, 720, 735 of the connector 600, 700. The conduit extension 660 may be, for example, a hose to help direct fluid flow. In the example shown, the conduit extension 660 may be in fluid communication with the second fluid passage 635 of the connector 600 for directing vapor received in the second fluid passage 635 towards the base of the fluid container. This configuration may help to speed up fluid transfer when the fluid container is inverted by helping to equilibrate pressure inside the fluid container and pressure inside the fluid destination. Although not shown, it should be understood that the conduit extension 660 may also be provided in fluid communication with any of the fluid passages of any of the disclosed spouts 305, 305*b*, 305*c* as well as the attachments described below.

Figure 45A:
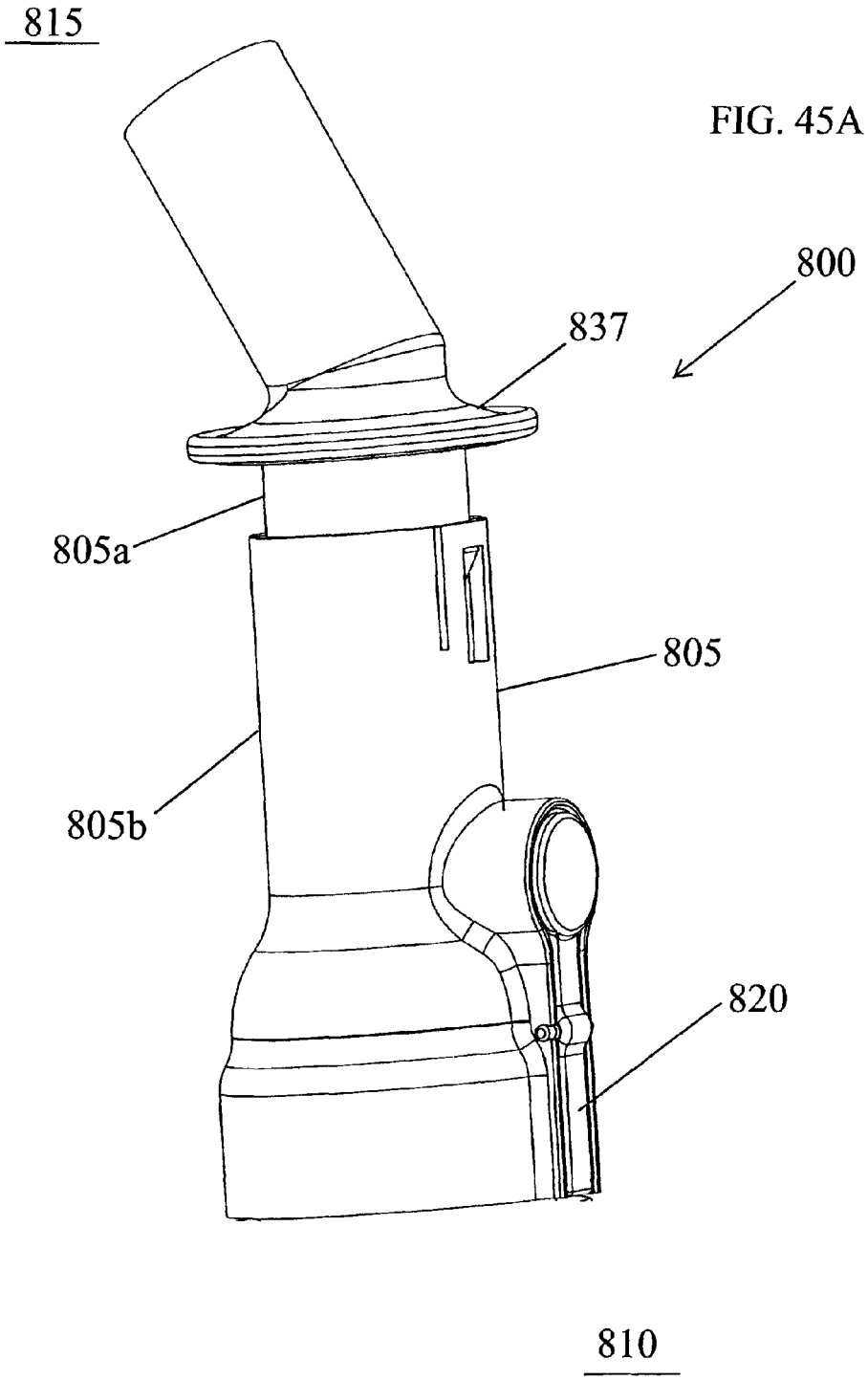
FIG. 45A is an isometric view of an example of the disclosed attachments.
Figure 45B:
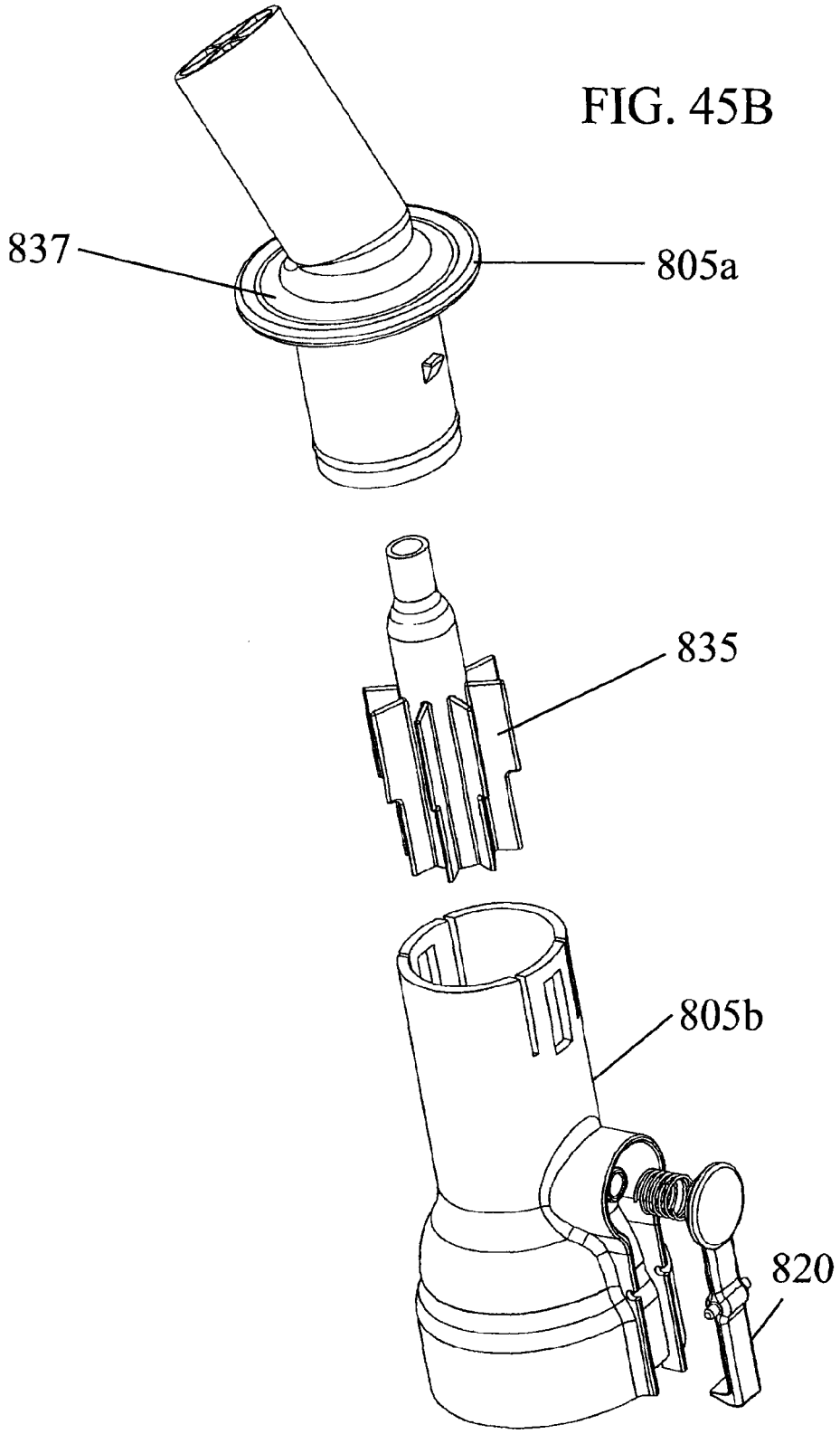
FIG. 45B is an exploded view of the attachment of FIG. 45A.
Figure 46:
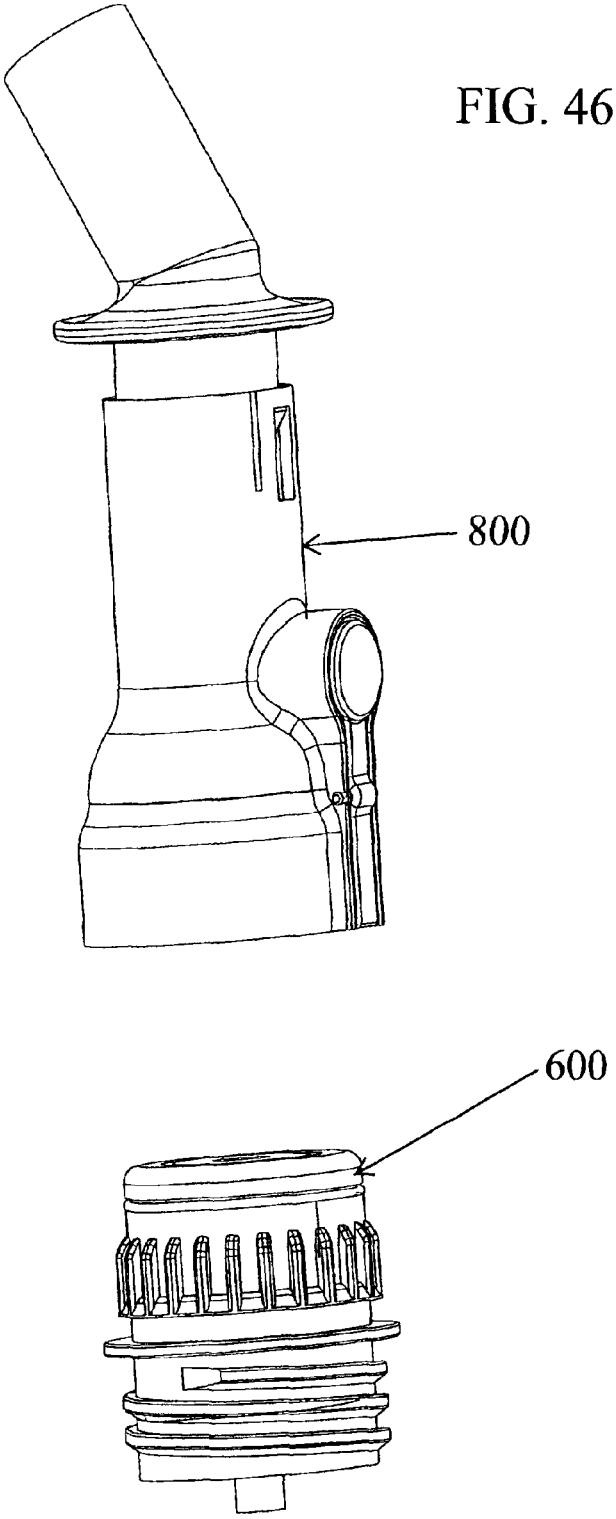
FIGS. 46-51 are various views of how the attachment of FIG. 45A and the connector of FIG. 31 may mate and operate together.
Figure 47:
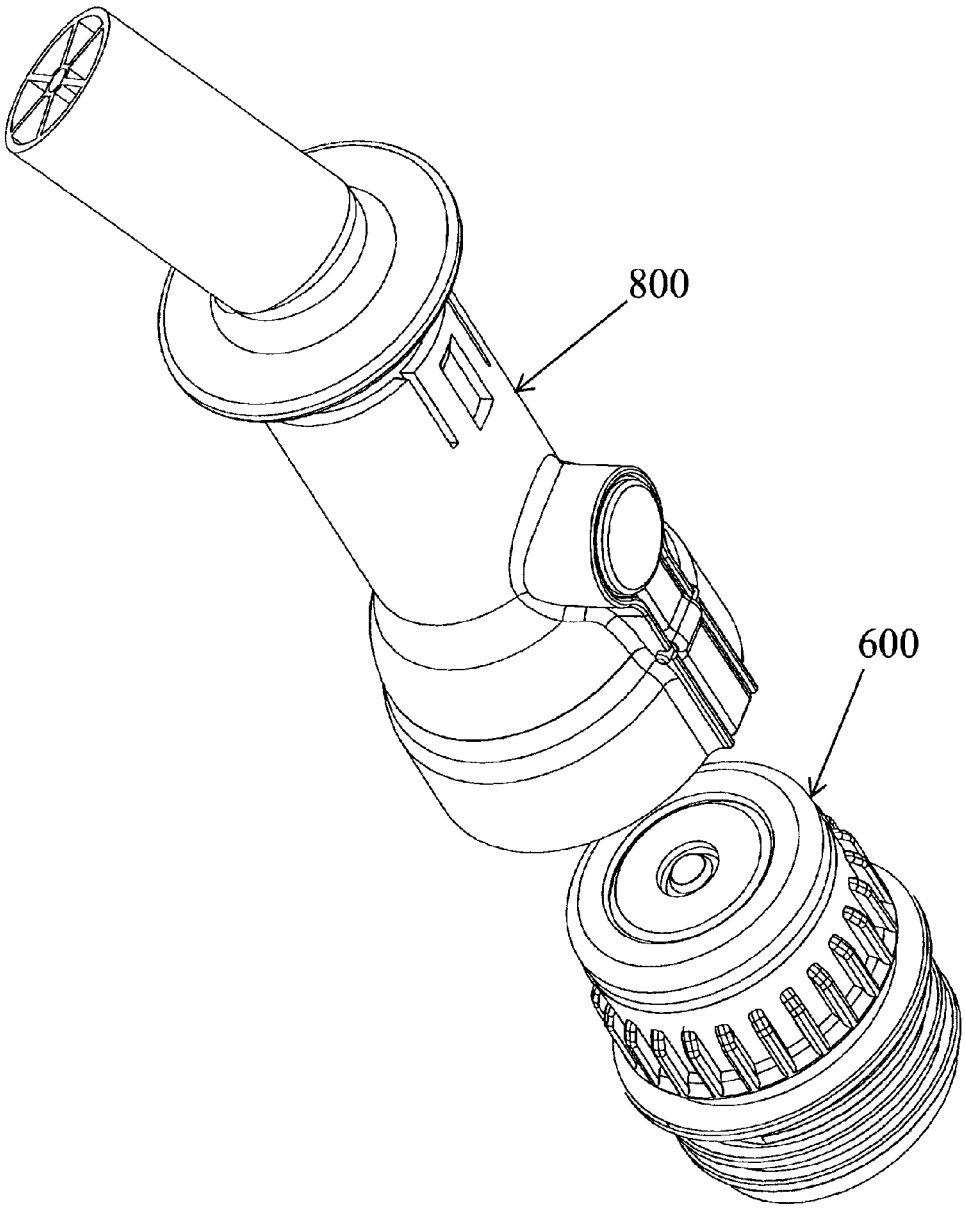
Figure 48:
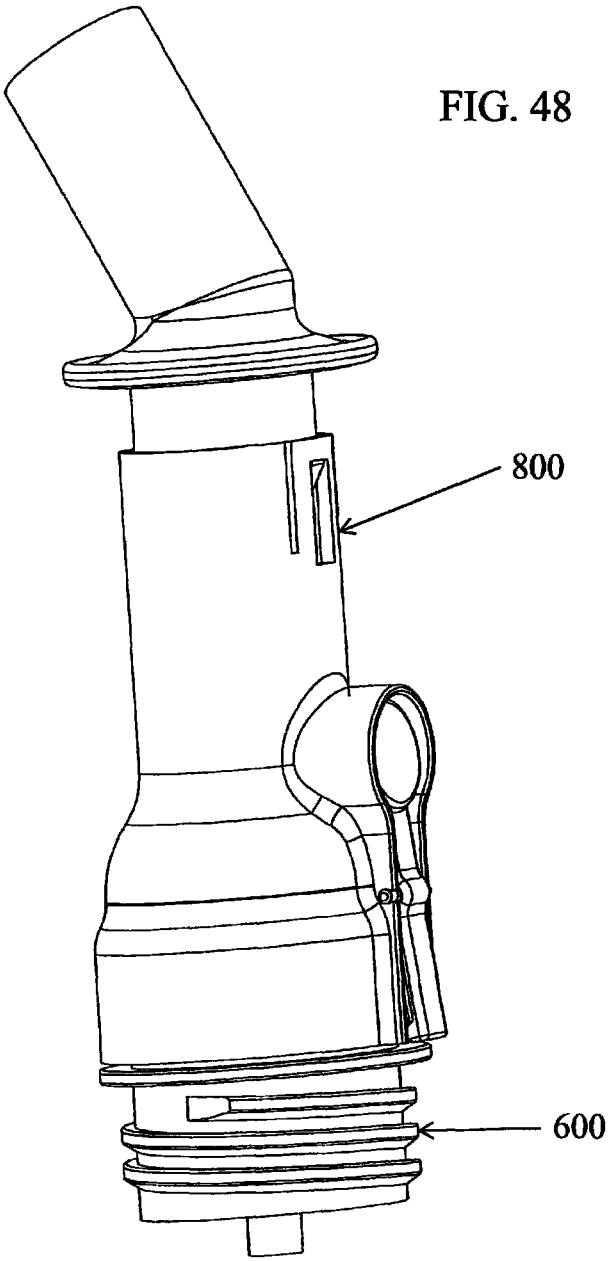
Figure 49:
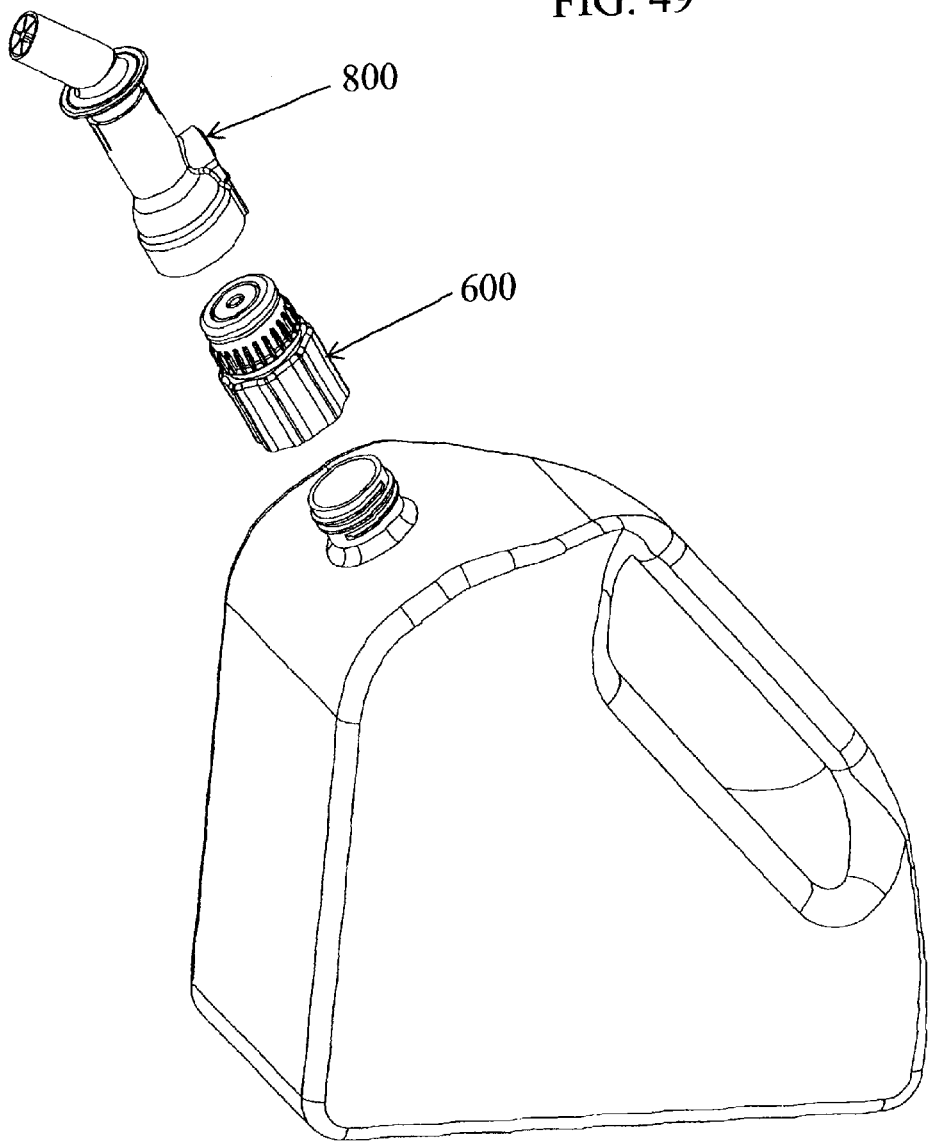

FIGS. 45A and 45B show an example attachment 800, in this case in the form of a spout, that may cooperate with the disclosed connectors 600, 700 to enable operation of the connectors 600, 700. The attachment 800 may be useful as an attachable and removable dispenser (e.g., a spout) for a fluid container that has one of the disclosed connectors 600, 700 as a cover, for example. FIGS. 46-49 illustrate an example attachment 800, in the form of a spout, that may mate with the connector 600, for dispensing fluid from a portable fluid container, for example. In the example shown, the connector 600 may be modified to include a threaded portion at the attachment end 615 for screwing the connector 600 onto a threaded opening of the fluid container.

The attachment 800 may include a body 805 defining a receiving end 810 for receiving fluid from a fluid source and a distal end 815 (e.g., in the form of a spout) for dispensing fluid from the attachment 800 (and optionally recovering vapor into the attachment 800). A connector 820 with one or more features (e.g., grooves, threads, protrusions or snap-fittings) may be provided at or near the receiving end 810 for attaching the body 805 to the fluid source or to a connector 600, 700, for example. In the example shown, the connector 820 may be in the form of a snap or clip. The connector 820 may be released, for example by depressing a portion of the connector 820 to release the snap or clip. For example, the attachment 800 may be mounted at or near its receiving end 810 on a connector 600, 700 that is attached to an opening of the disclosed assembly, in order to dispense fluid from the assembly. The attachment 800 may be mounted in such a way that the attachment 800 may still swivel, which may be useful in directing the distal end 815.

In some examples, the body 805 may include at least two telescoping portions (in this example, two telescoping portions 805*a*, 805*b*) to enable motion of the telescoping portions 805*a*, 805*b* relative to each other, for example to shorten the body 805.

Figure 50:
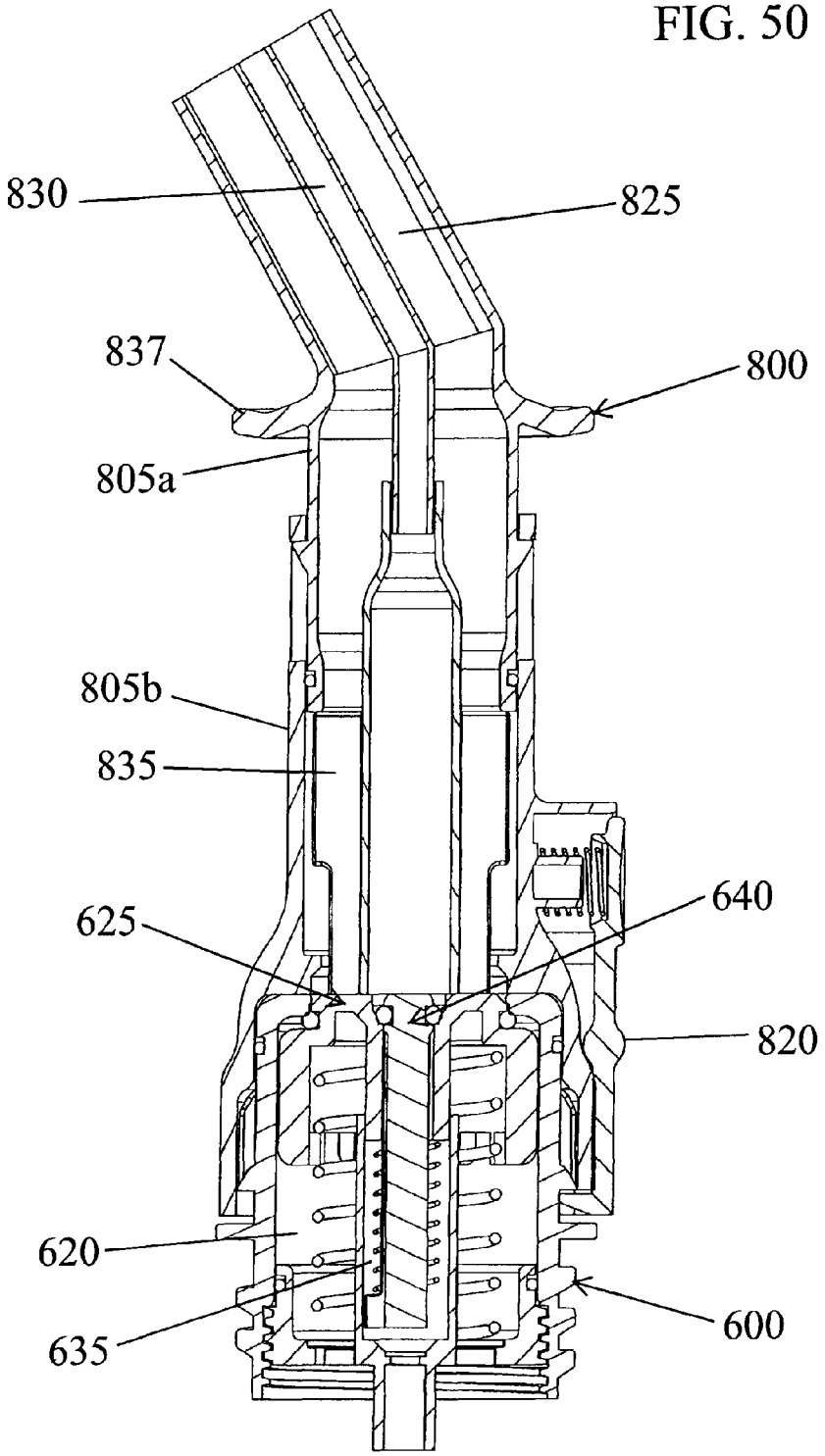
Figure 51:
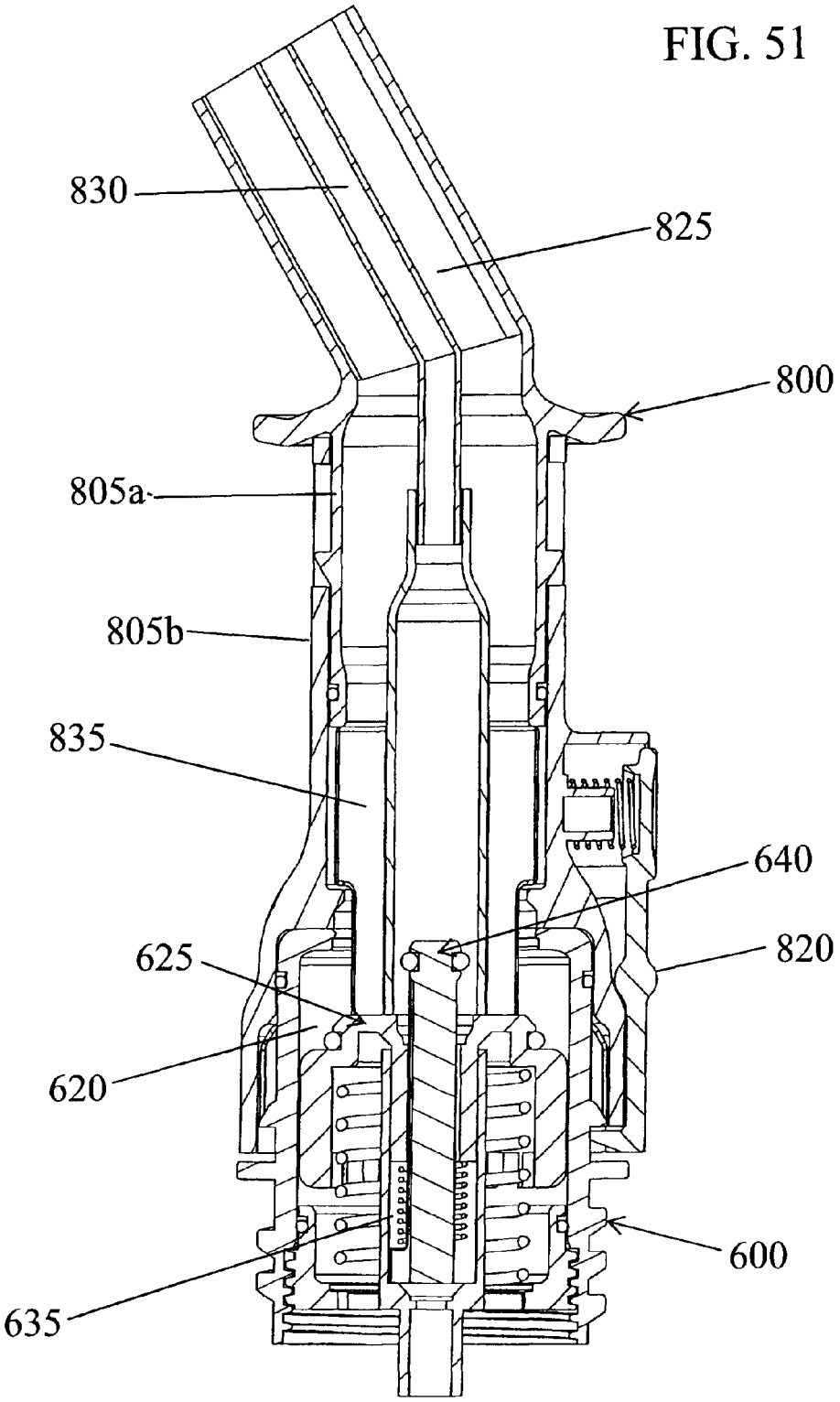

FIGS. 50 and 51 illustrate an example of how the attachment 800 may mate with one half of a dry-break connection, in this example the connector 600, to enable operation of the connector.

A first fluid passage 825, which may have a fluid inlet and a fluid outlet, may be defined in the body 805 of the attachment 800 permitting fluid flow through the body 805. The first fluid passage 825 may permit fluid to flow to the distal end 815, for example by enabling fluid communication between at least the receiving end 810 and the distal end 815. A second fluid passage 830 may be defined in the body 805 permitting fluid flow first fluid passage 825 may be defined in the body 805 of the attachment 800 permitting fluid flow through the body 805. The second fluid passage 830 may permit fluid to flow from the distal end 815, for example by enabling fluid communication between at least the distal end 815 and the receiving end 810.

Although the fluid passages 825, 830 have been described as enabling fluid communication between the receiving end 810 and the distal end 815, it should be understood that in operation fluid may not necessarily flow the entire distance between the distal end 815 and the receiving end 810.

There may be at least one valve engaging portion 835 (e.g., one or more projections) housed in the body 805, for example in the first fluid passage 825. The valve engaging portion 835 may cooperate with a valve surface to cause opening of a valve. When mated with one connector 600, 700, the valve engaging portion 835 may cooperate with one of the valves 625, 640, 725, 740, such that motion of the valve engaging portion 835 relative to the connector 600, 700 causes unseating of the one valve 625, 640, 725, 740 and allows fluid flow through the one connector 600, 700.

For example, the valve engaging portion 835 may contact or abut against the surface of the first valve 625 of the connector 600 when the attachment 800 is attached to the connector 600. A force applied on the valve engaging portion 835 may move the valve engaging portion 835 relative to the connector 600, pushing the first valve 625 towards the attachment end 615 of the connector 600, thereby opening the first valve 625 and the second valve 640.

In the example shown, shortening of the body 805 by motion of the telescoping portions 805*a*, 805*b* towards each other may bring the valve engaging portion 835 towards the receiving end 810. Since the valve engaging portion 835 may contact or abut the first valve 625, the first valve 625 may be thus moved to its opened position.

Figure 83:
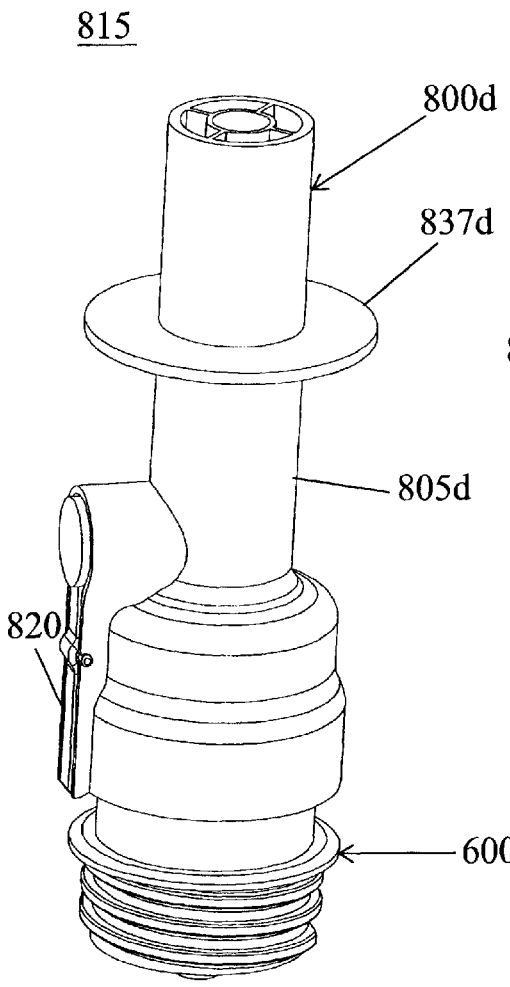
FIGS. 83-85 are various views illustrating how the attachment of FIG. 81 and a variation of the connector of FIG. 31 may mate and operate together.
Figure 84:
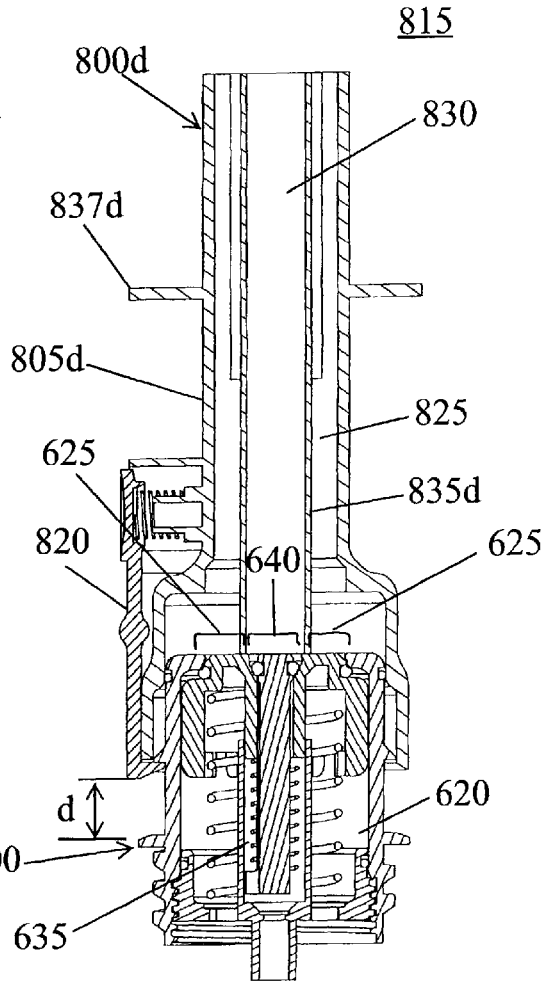
Figure 85:
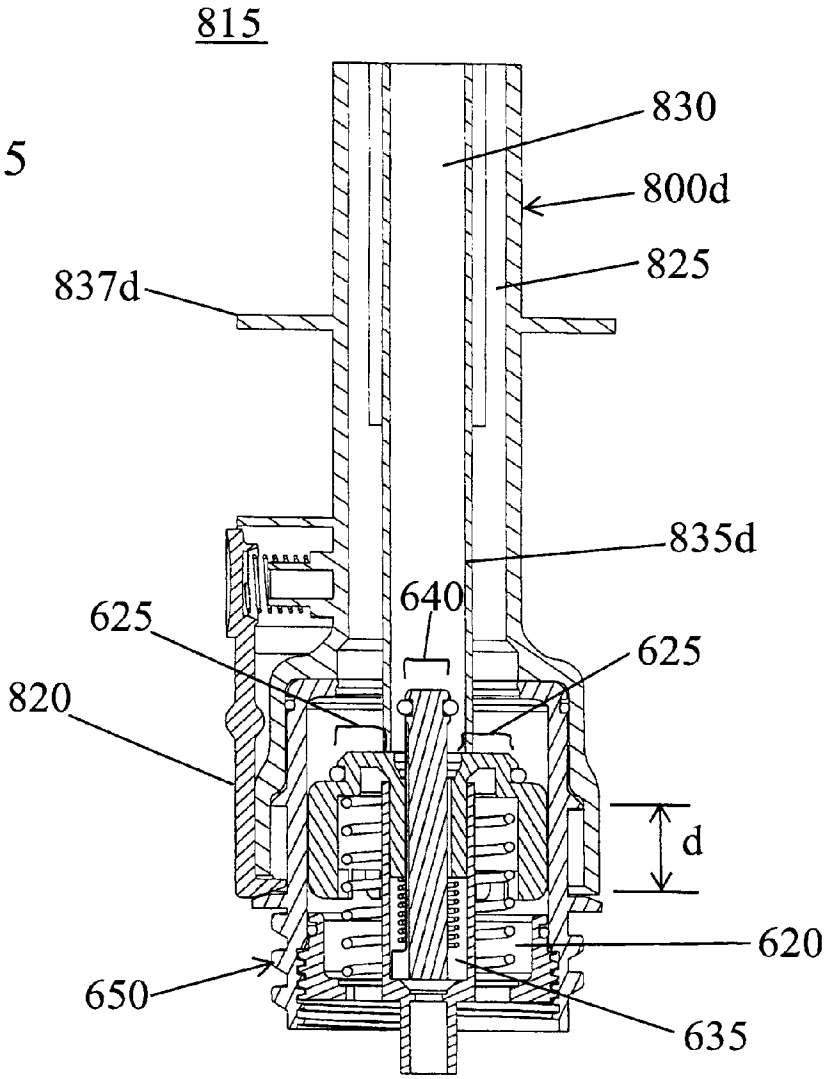

Although in the example shown the valve engaging portion 835 opens the first valve 625 by motion of the telescoping portions 805*a*, 805*b* that shortens the body 805, it should be understood that other types of motion may be used. For example, the body 805 and the connector 820 may have a telescoping motion relative to each other, such that the connector 820 is fixed relative to the connector 600 and the body 805 slides relative to the connector 600 to cause the valve engaging portion 835 to push against and open the first valve 625, such as shown in FIGS. 83-85.

In the example shown, the first fluid passage 825 and the second fluid passage 830 may be generally co-axial. In other examples, the first fluid passage 825 and the second fluid passage 830 may be in tandem, concentric, contained in each other but off-center, or separated from each other, among other configurations. The first and second fluid passages 825, 830 may be configured to correspond to the configuration of fluid passages to which the attachment 800 is being attached. For example, where the attachment 800 is intended to mate with the first connector 600, the first and second fluid passages 825, 830 of the attachment 800 may be configured to match the configuration of the first and second fluid passages 620, 635 of the first connector 600.

The disclosed attachment 800 may be used for two-phase fluid flow, such as for dispensing liquid while recovering vapor (e.g., in fuel dispensing systems having vapor recovery capabilities). For example, the first fluid passage 825 may be configured for liquid fluid flow and the second fluid passage 830 may be configured for vapor fluid flow, or vice versa. In some examples, the fluid may be a volatile fluid (e.g., a fluid fuel).

In some examples, the attachment 800 may be integral with the connector 600, 700. In other examples, the attachment 800 may be used to operate valves, as described above, but may itself be free of valves. The absence of valves from the attachment 800 may simplify manufacturing of the attachment 800 and may help to reduce the costs and time associated with manufacturing of the attachment 800.

In some examples, the distal end 815 of the attachment 800 may include a protrusion, such as an extended surface 837, such that the distal end 815 may complement or mate with the vapor recovery inlet of the fluid destination, in order to help provide a more effective recovery of vapor during the delivery of fluid.

The extended surface 837 may also be used to effect the relative motion of the telescoping portions 805*a*, 805*b*. For example, the extended surface 837 may be provided on one telescoping portion 805*a* closer to the distal end 815 such that, when the distal end 815 is inserted into the inlet of the fluid destination, the extended surface 837 may not fit into the inlet. Pushing the attachment 800 against the inlet may then cause the other telescoping portion 805*b* to move relative to the first telescoping portion 805*a*, thereby causing opening of a valve (e.g., the first and second valves 625, 640 of the connector 600) and permitting fluid to flow into the fluid destination. This may be useful to ensure that the distal end 815 is inserted into the inlet of the fluid destination before fluid flow occurs, to avoid unintentional spillage, for example. The fluid flow rate through the attachment 800 may also be controlled by controlling the degree to which the telescoping portions 805*a*, 805*b* are moved relative to each other (and in turn the degree to which the valve is opened) by controlling how far the distal end 815 is inserted into the inlet of the fluid destination. This may also avoid the need for the user to directly manipulate the attachment 800, thereby avoiding or reducing the possibility of contamination of the user's hand and/or the distal end 815.

FIGS. 52-56 show an example attachment 800*b* in which motion of the telescoping portions 805*a*, 805*b* relative to each other may be remotely actuated (e.g., using a remote trigger 240).

Figure 52:
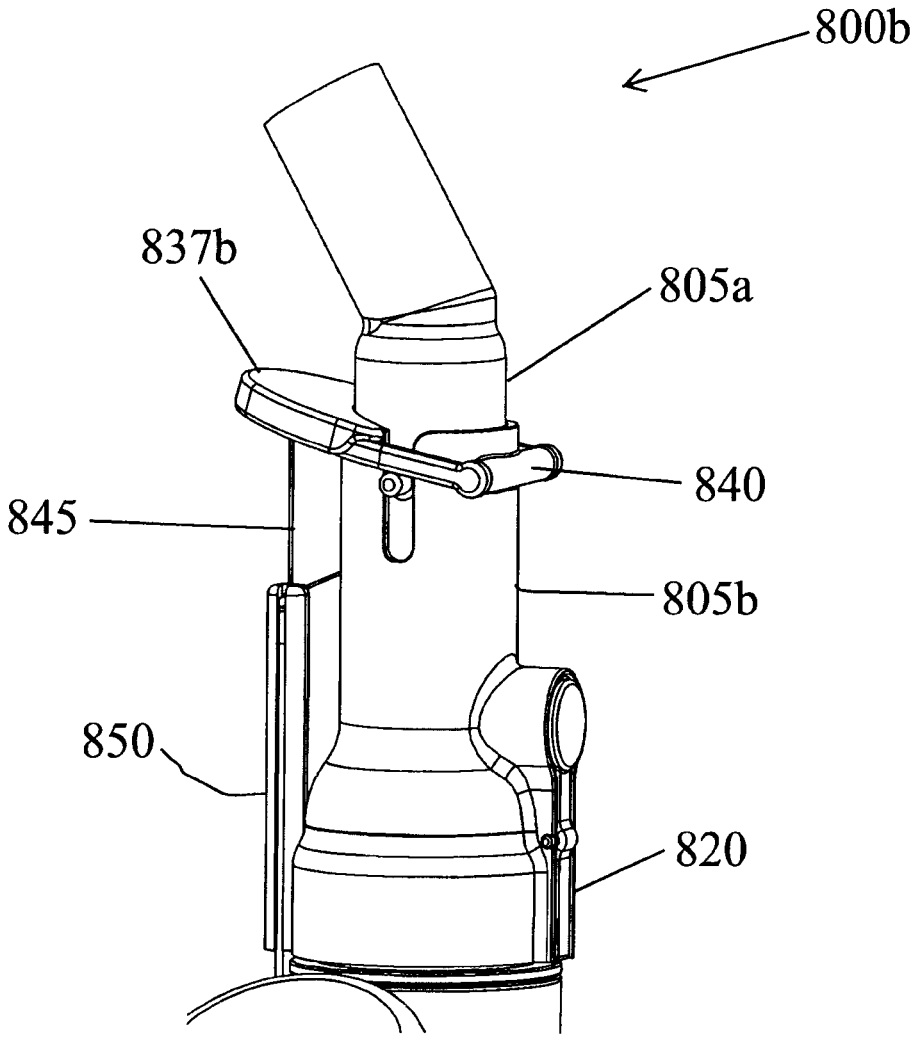
FIGS. 52 and 53 are isometric views of another example of the disclosed attachments.
Figure 53:
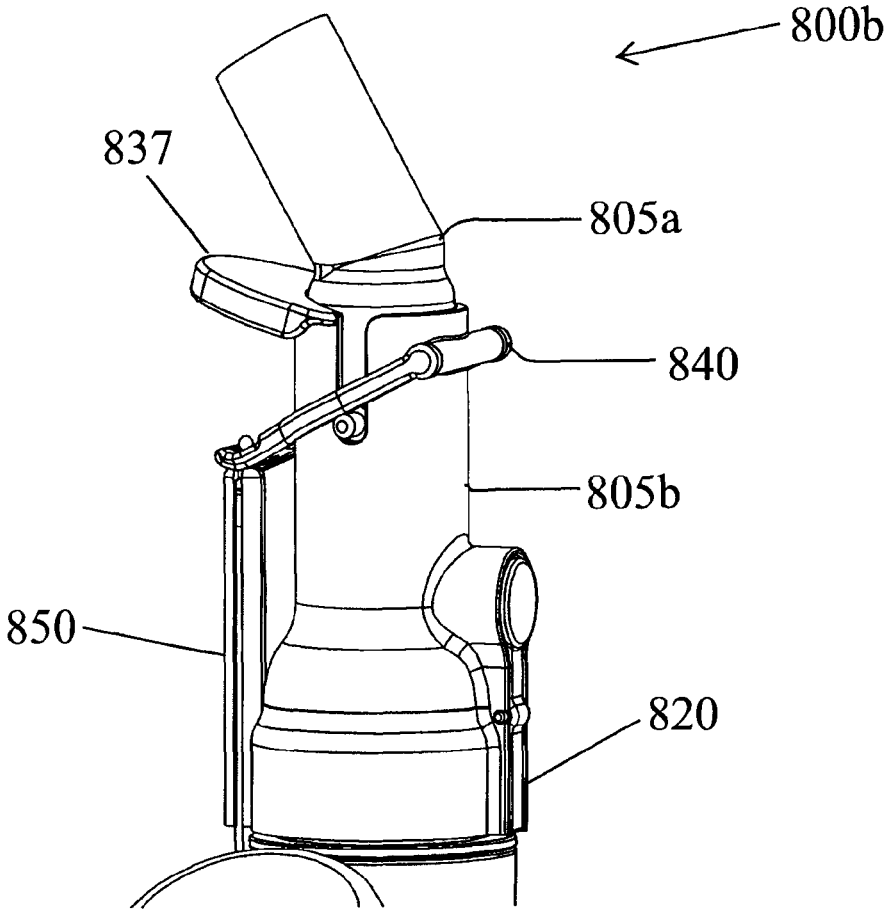

The attachment 800*b* may be similar to the attachment 800 described above. The attachment 800*b* may have an extended surface 837*b* that may be similar to the extended surface 837 described above. The extended surface 837*b* may not be used to move the telescoping portions 805*a*, 805*b* relative to each other. The attachment 800*b* may include a lever mechanism 840 for moving the telescoping portion 805*a* relative to the telescoping portion 805*b*. The lever mechanism 840 may be connected by a cable 845 that may run through a channel 850 defined in the body 805. The cable 845 may couple the lever mechanism 840 to the remote trigger 240 such that actuation of the remote trigger 240 causes the cable 845 to pull the lever mechanism 840, which in turn moves the telescoping portion 805*a* relative to the telescoping portion 805*b*, as shown in FIGS. 52 and 53. Similarly to the attachment 800 described above, this motion of the telescoping portions 805*a*, 805*b* relative to each other may cause the attachment 800*b* to open a valve and allow fluid flow through the attachment 800*b*.

The telescoping portions 805*a*, 805*b* may be biased away from each other (e.g., by a biasing member, such as a compression spring), such that when the cable 845 is released (e.g., by releasing the remote trigger 240) and the lever mechanism 840 is released and the telescoping portions 805*a*, 805*b* are allowed to move away from each other, thereby stopping closing the valve and stopping fluid flow.

Thus, the attachment 800*b* may allow actuation of a remote trigger 240 located remotely from the attachment 800*b* to cause the attachment 800*b* to open a valve and enable fluid flow, as described above. This remote actuation of the attachment 800*b* may allow for control of fluid flow through the attachment 800*b* in a manner that is not dependent on direct manipulation of the attachment 800*b* by a user. This may avoid or reduce the possibility of contamination of the user's hand and/or the distal end 815, and may also allow for more ergonomic control of fluid flow. This may also allow for stopping fluid flow through the attachment 800*b* without having to remove the distal end 815 from the inlet of the fluid destination. The fluid flow rate may also be controlled by controlling the degree to which the telescoping portions 805*a*, 805*b* are moved relative to each other (and in turn the degree to which the valve is opened) by controlling the degree of actuation of the cable 840 (e.g., using the remote trigger 240).

Figure 55:
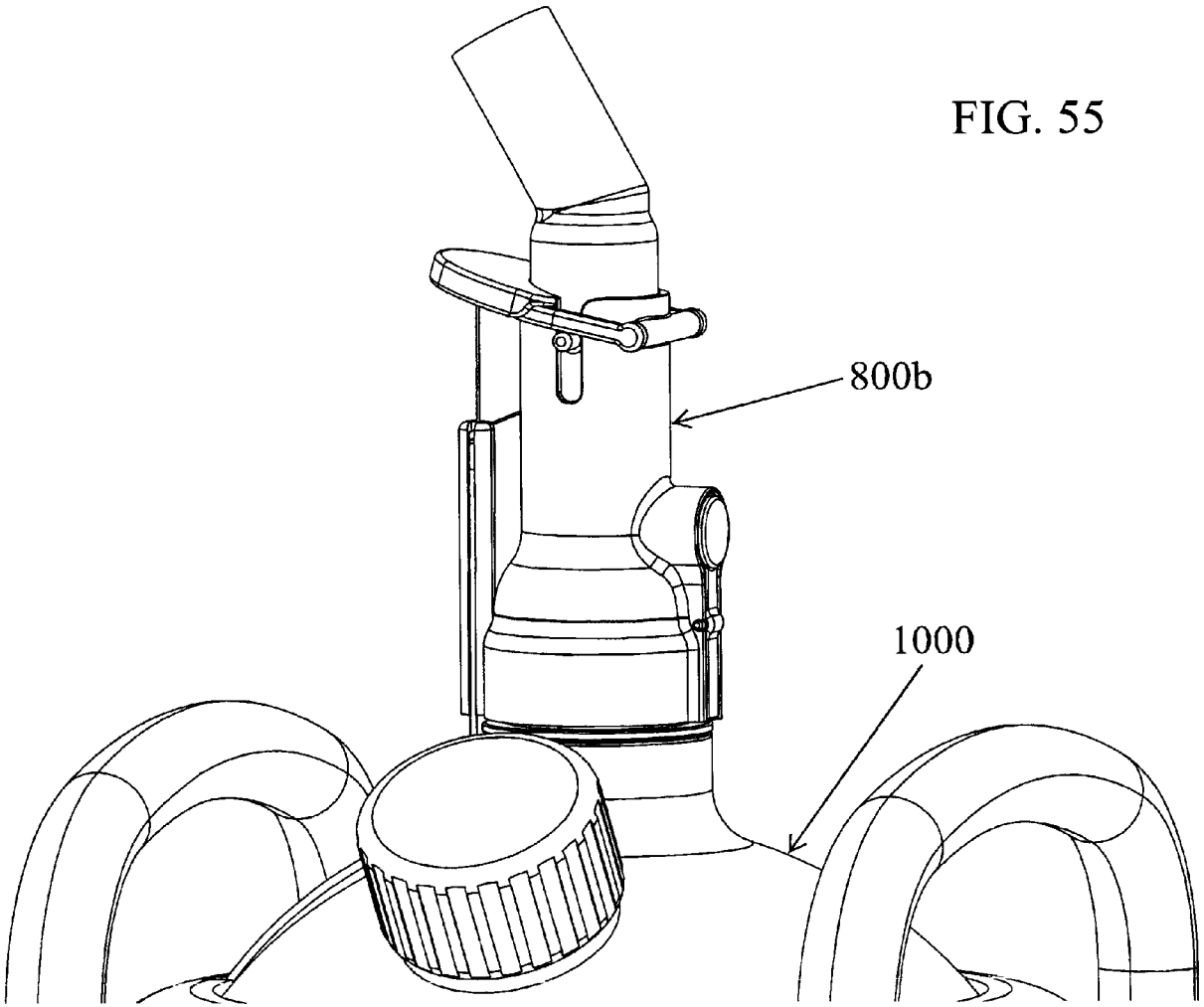
Figure 56:
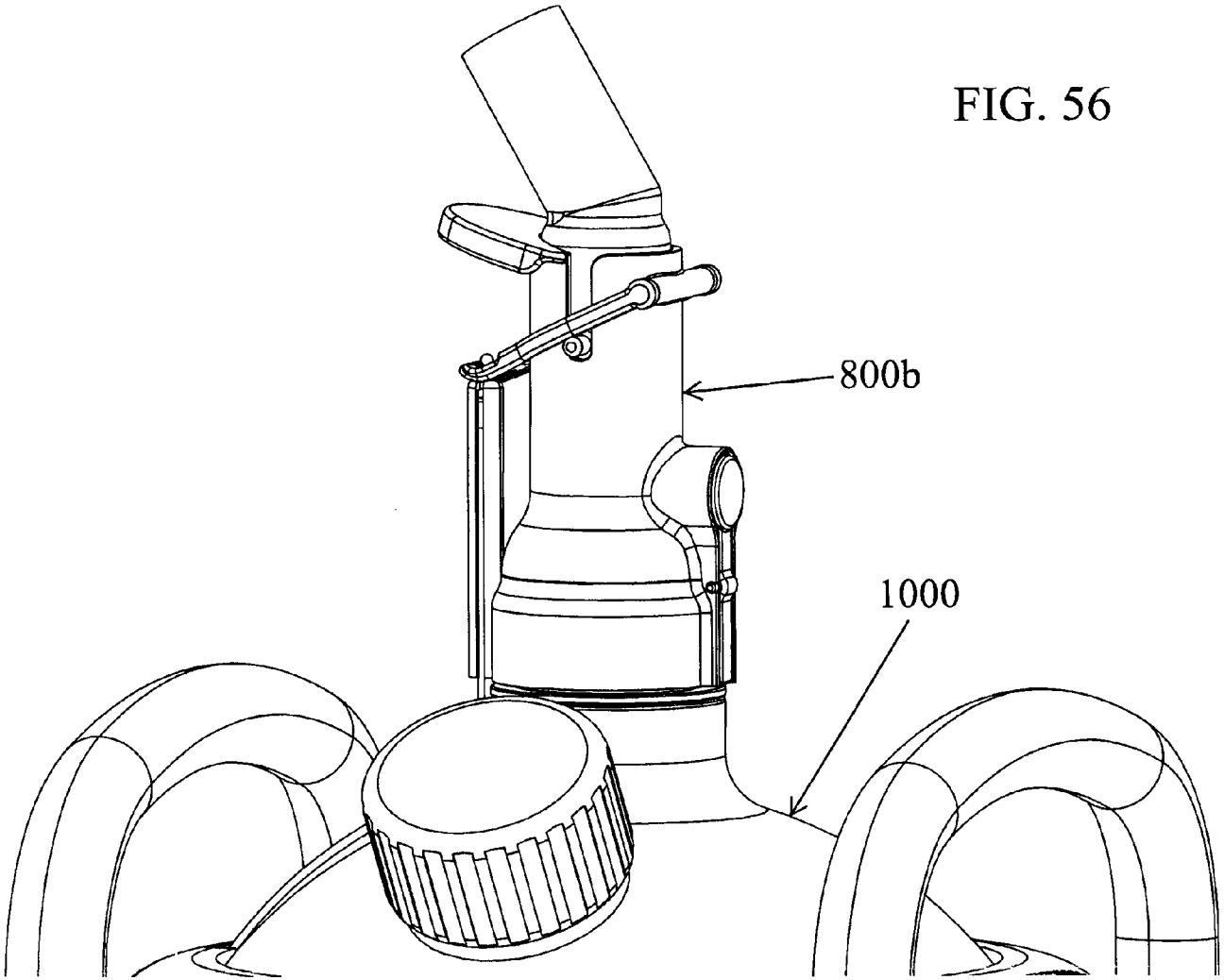
Figure 57:
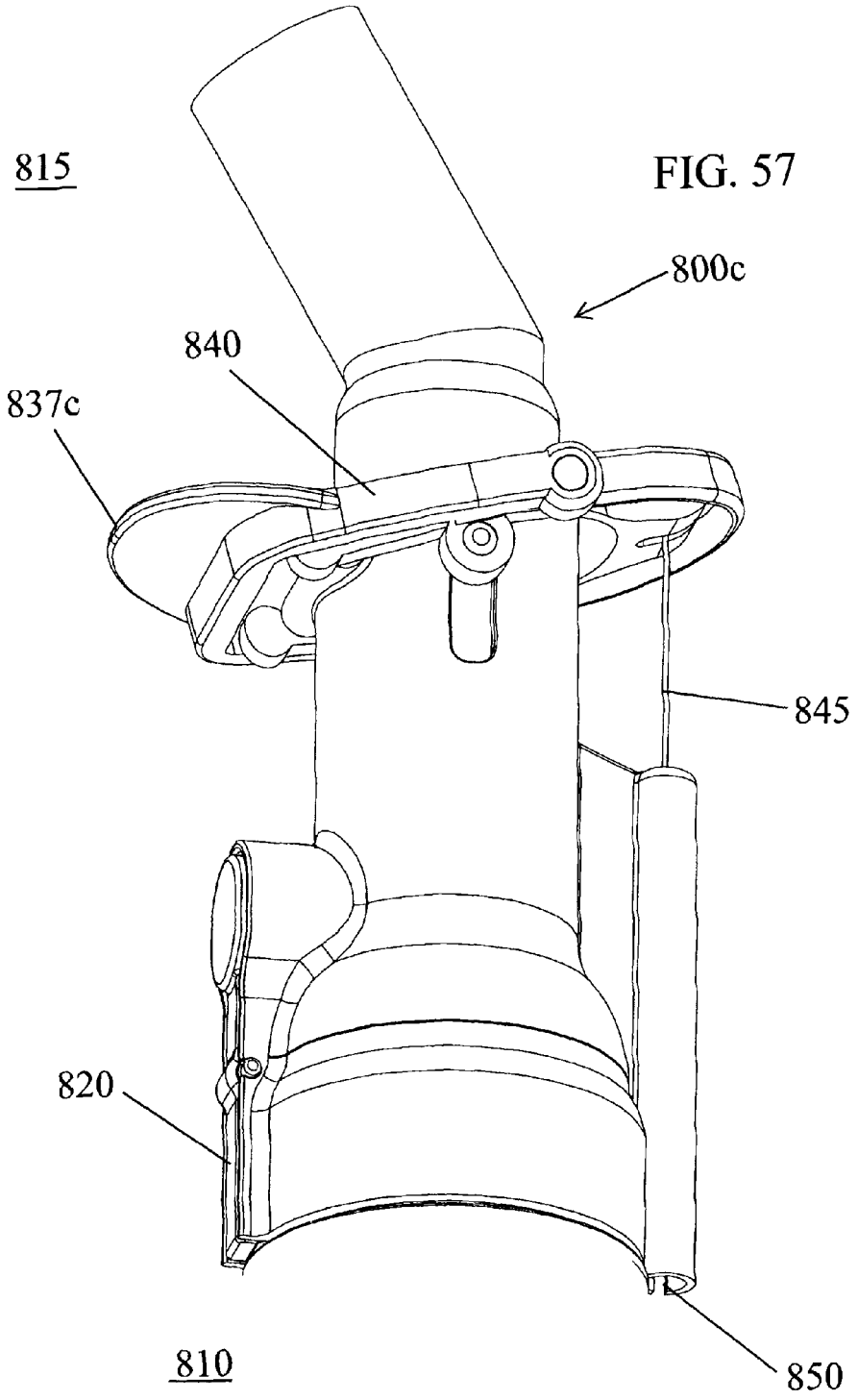
FIGS. 57-58B are isometric views of another example of the disclosed attachments.

The attachment 800, 800*b* may be used (with or without a connector 600, 700) as a dispenser for the disclosed assembly 1000, 1000*b*, 1000*c* or the container 1100. FIGS. 54-56 show an example of the attachment 800*b* cooperating with the connector 600 to be used as a dispenser for the portable fluid container assembly 1000.

Where the attachment 800*b* may be remotely actuated by a cable 845, the remote trigger 240 may be provided on the assembly 1000 as described above to remotely actuate the attachment 800*b* and dispense fluid.

FIGS. 57-61 illustrate an example attachment 800*c* having a safety feature for remote actuation. Similarly to the attachment 800*b* described above, the telescoping portions 805*a*, 805*b* may be moved relative to each other remotely through actuation by the cable 845. The attachment 800*c* may further include features to prevent movement of the telescoping portions 805*a*, 805*b* using the cable 845 when the distal end 815 of the attachment 800*c* is not fully inserted into an inlet of a fluid destination. This may help prevent unintentional fluid flow through the attachment 800*c*.

The attachment 800*c* may include a protrusion 837*c*, such as an extended surface, extending from at least a portion of the outer surface of the body 805 near the distal end 815. The protrusion 837*c* may be configured to contact or abut the outer surface of the fluid destination when the distal end 815 is fully inserted into an inlet of the fluid destination.

Figure 58A:
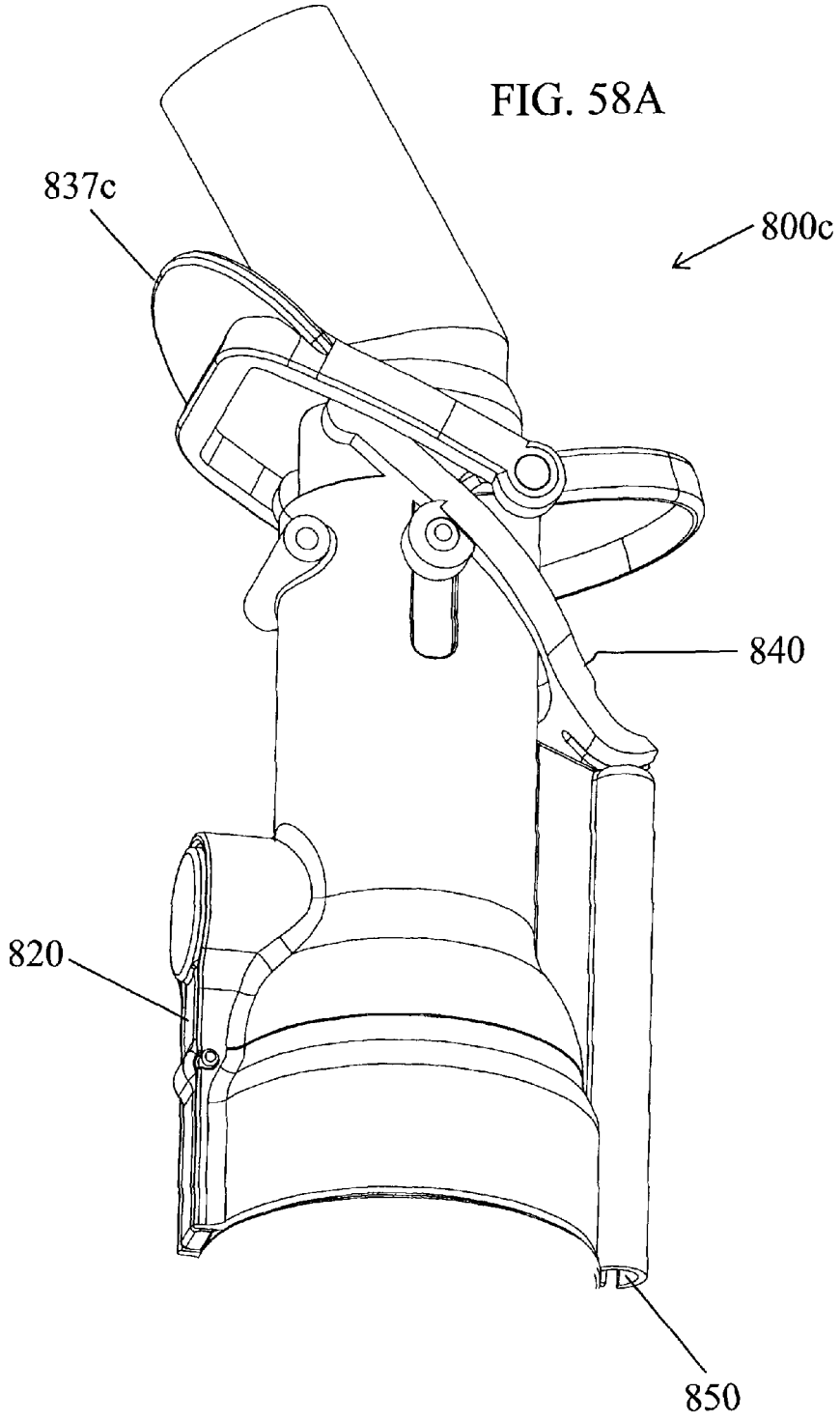
Figure 58B:
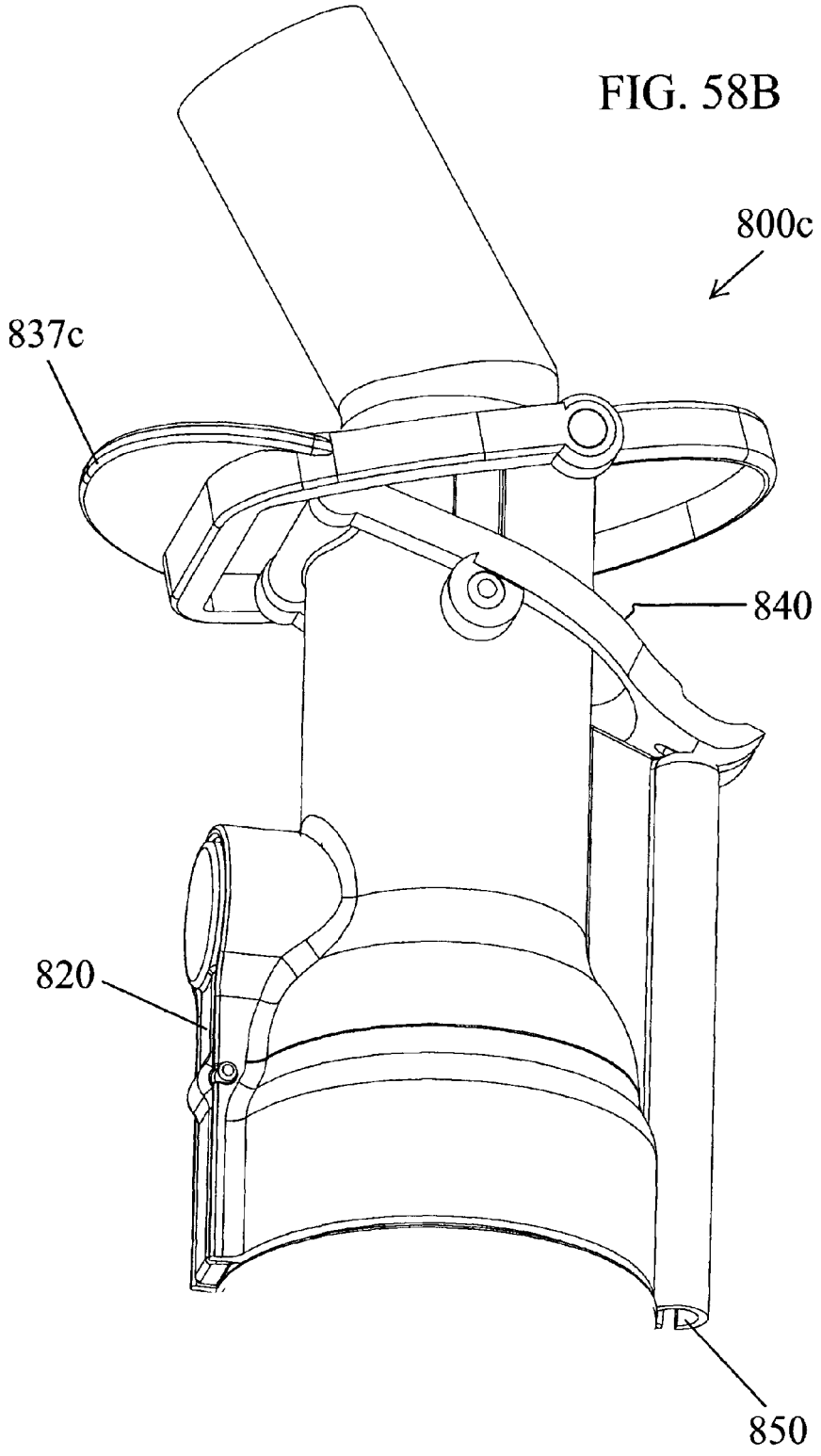

The protrusion 837*c* may have a disabling position, as shown in FIG. 58A, and an enabling position, as shown in FIG. 58B. In the enabling position, the lever mechanism 840 may push against the protrusion 837*c* to cause the telescoping portion 805*a* to move relative to the telescoping 805*b* (see FIG. 58B, for example). However, the protrusion 837*c* is free to move between the enabling position and disabling position. This means that unless the protrusion 837*c* is held in place (e.g., by contacting or abutting the protrusion 837*c* against the outer surface of the fluid destination), when the lever mechanism 840 is actuated by the cable 845, the protrusion 837*c* is moved into the disabling position. In the disabling position, the lever mechanism 840 is unable to push against the protrusion 837*c* to move the telescoping portion 805*a* (see FIG. 58A, for example).

Figure 59A:
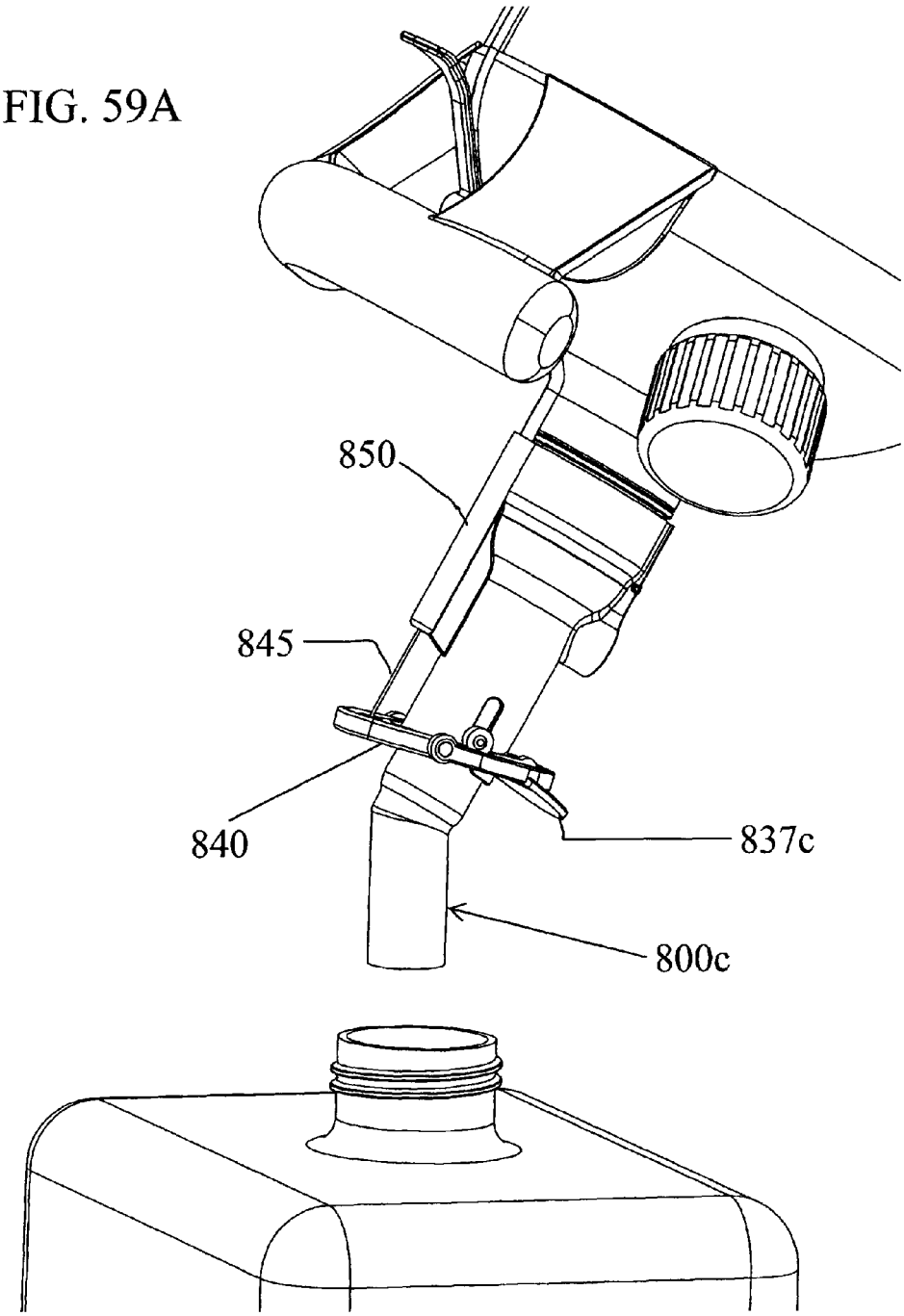
FIGS. 59A-61 illustrate an example operation of the attachment of FIG. 57.
Figure 59B:
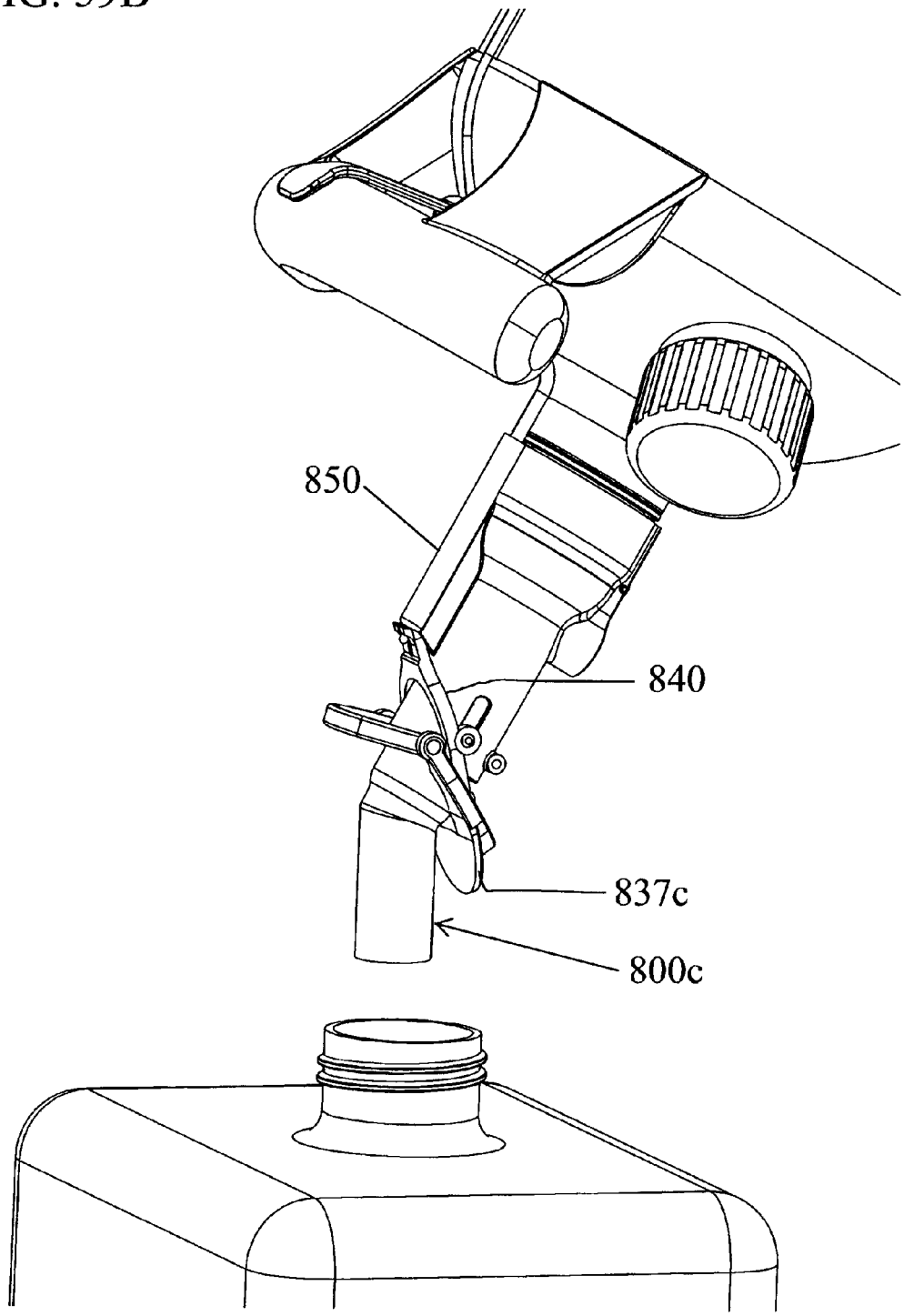

This safety feature is further illustrated in FIGS. 59A-61. In this example, the attachment 800*c* is provided over a connector 600 (not shown) on a fluid container. In FIG. 59A, the protrusion 837*c* does not contact or abut the fluid destination. Thus, in FIG. 59B, when the cable 845 actuates the lever mechanism 840, the protrusion 837*c* is moved into the disabling position and the telescoping portions 805*a*, 805*b* are not moved relative to each other. There is no fluid flow as a result, since the valves 625, 640 of the connector 600 are not opened.

Figure 60:
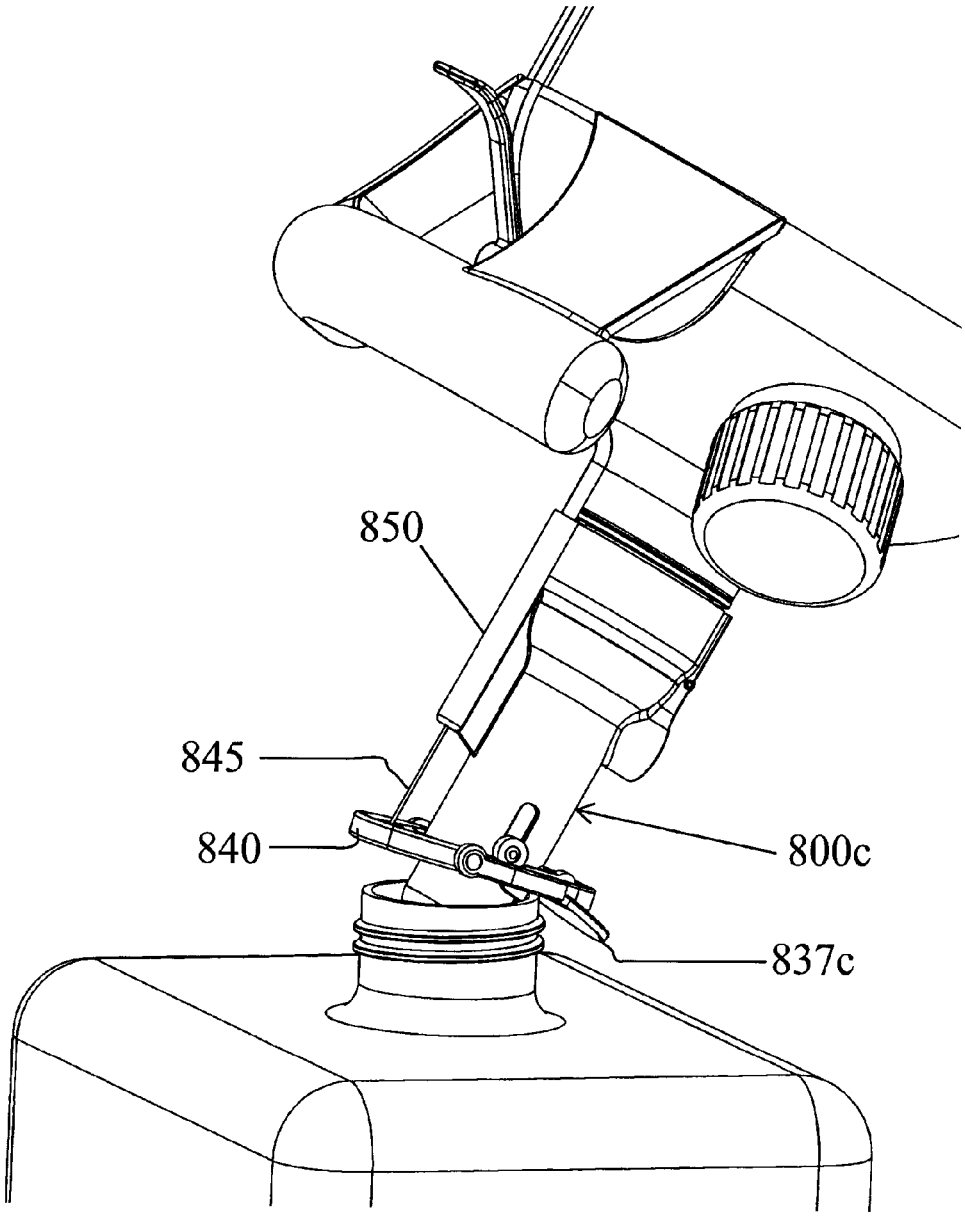
Figure 61:
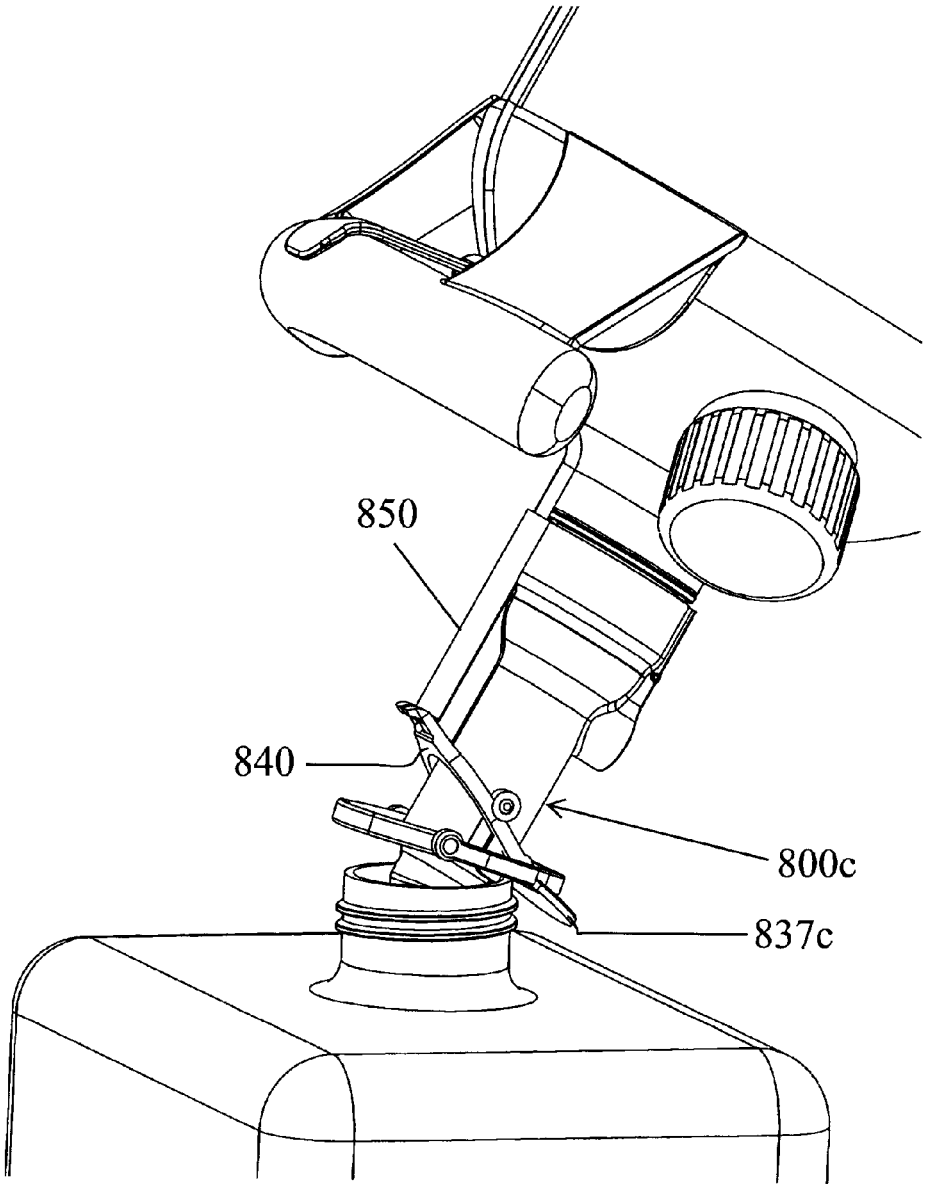
Figure 62:
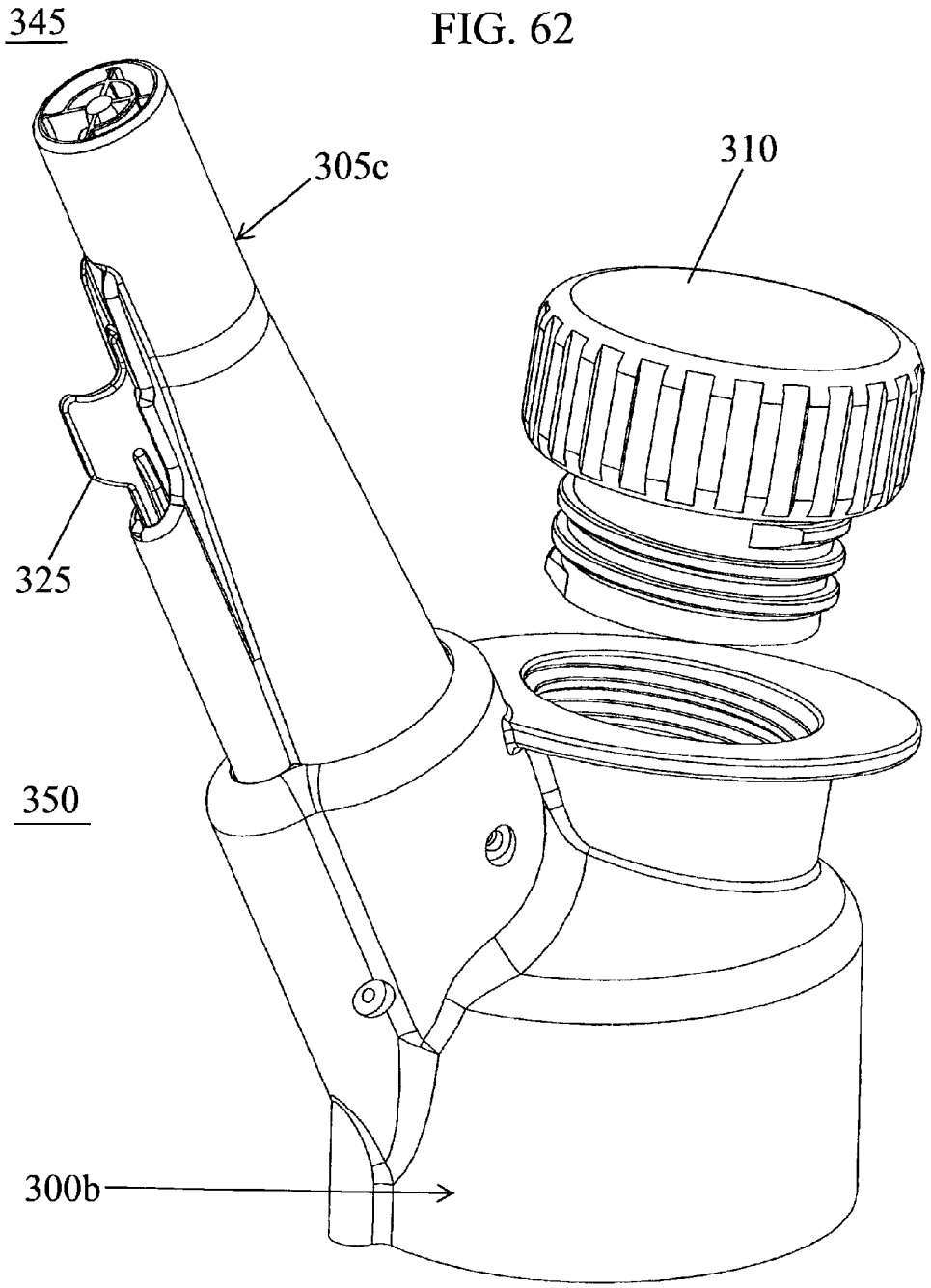
FIG. 62 is an isometric view of another example of the disclosed spouts, provided on an example cover.

In FIG. 60, the protrusion 837*c* contacts or abuts the fluid destination, resulting in the protrusion 837*c* being held in the enabling position. In FIG. 61, when the cable 845 is actuated (e.g., by actuation of the remote trigger 240), the lever mechanism 840 is able to push against the protrusion 837*c* (which is held in the enabling position) and cause the telescoping portions 805*a*, 805*b* to move relative to each other (e.g., towards each other thereby shortening the body 805). This motion opens the valves 625, 640 of the connector 600, as described above, permitting fluid to flow between the fluid container and the fluid destination. When the cable 845 is released (e.g., by releasing the remote trigger 240), the telescoping portions 805*a*, 805*b* may be allowed to return to their biased apart positions, as described above for the attachment 800*b*, thereby stopping fluid flow. Additionally, removing the distal end 815 from the inlet may free the protrusion 837*c* to move into the disabling position, such that the lever mechanism 840 is unable to push against the protrusion 837*c*, thereby freeing the telescoping portions 805*a*, 805*b* to return to their biased apart positions and resulting in the stop of fluid flow. This may provide a safety feature in which, even if the cable remains actuated, fluid flow is prevented when the distal end 815 is removed from the inlet of the fluid destination.

The attachment 800*c* may further provide some or all of the advantages of controlling fluid flow rate and/or avoiding contamination, as described above for the attachments 800, 800*b*.

In another example, as shown in FIGS. 81-85, an attachment 800*d* may attach to a fluid source in such a way as to allow the attachment to swivel and/or slide relative to the fluid source. For example, the attachment 800*d* may include a connector 820 that may allow the attachment 800*d* to swivel and/or slide relative to a connector of the fluid source, such as the connector 600. In this case, the entire attachment 800*d* may be slid towards a fluid source to open the valves of the fluid source. For example, where the connector 600 is used as a cover for a fluid source, the attachment 800*d*, when connected to the connector 600, may be used to push against and open the valves 625, 640 of the connector.

In the example shown, the attachment 800*d* may be similar to the attachments 800, 800*b*, 800*c* described above. However, the attachment 800*d* may not include telescoping portions, but rather have a body 805*d* that is substantially a single piece. This may allow for easier and/or less expensive manufacturing of the attachment 800*d*. The body 805*d* may define a receiving end 810 for receiving fluid from the fluid source and a distal end 815 for dispensing fluid from the attachment 800*d* (and optionally recovering vapor into the attachment 800*d*).

The attachment 800*d* may include first and second fluid passages 825, 830, similar to that described above. The attachment 800*d* may also include an extended surface 837*d* that may cooperate with a commercial dispenser having vapor recovery features and/or to control the depth to which the distal end 815 may be inserted into an inlet of a fluid destination, as described above. The valve engaging portion 835*d* may be the wall of the second fluid passage 830 or a projection from the wall of the second fluid passage 830, for example, to simplify manufacturing of the attachment 800*d*.

As shown in FIGS. 83-85, the attachment 800*d* may connect to a connector 600 in this example by a snap or clip connector 820. Although the connector 820 in this example may be separately molded from the body 805*d*, in other examples the connector 820 may be integrally molded with the body 805*d*. The connector 600 may include a protrusion for snapping on the connector 820. When attached to the connector 600, the valve engaging portion 835*d* may contact or abut or may be brought to contact or abut the first valve 625 of the connector 600. The connector 600 may be configured such that the attachment 800*d* may slide a distance d along the longitudinal axis of the connector 600 (e.g., when the distal end 815 of the attachment 800*d* is inserted into an inlet of a fluid destination and the extended surface 837*d* is pressed against the outer surface of the fluid destination), thereby bringing the attachment 800*d* closer towards the connector 600 and causing the valve engaging portion 835*d* to push against the first valve 625, thereby opening the valves 625, 640 of the connector 600. Thus, rather than telescoping motion between two telescoping portions 805*a*, 805*b*, as described above for the attachments 800, 800*b*, 800*c*, the attachment 800*d* may be used to open the valves 625, 640 of the connector 600 by telescoping motion between the attachment 800*d* and the connector 600.

When the distal end 815 of the attachment 800*d* is no longer pressed into the inlet of the fluid destination, the release of force may allow the valves 625, 640 to be biased back towards their closed positions, stopping fluid flow and pushing the attachment 800*d* away from the connector 600.

Although the valve engaging portion 835*d* is shown as being the wall of the second fluid passage 830, it should be understood that the valve engaging portion 835*d* may be any suitable configuration including, for example, extensions from the wall of the first fluid passage 825 or flanges extending from the wall of the second fluid passage 830, among others.

Although the attachment 800*d* is shown as having the valve engaging portion 835*d* contacting or abutting the closed first valve 625 when the attachment 800*d* is mated with the connector 600, in some examples the valve engaging portion 835*d* may be configured such that when the attachment 800*d* is mated with the connector 600, the valve engaging portion 835*d* already pushes against and opens the first valve 625, without having to further slide the attachment 800*d* towards the connector 600. In such a configuration, the valves 625, 640 of the connector 600 may be opened whenever the attachment 800*d* is mated to the connector 600 and the valves 625, 640 may be closed when the attachment 800*d* is removed from the connector 600. In such a configuration, the attachment 800*d* may include one or more valves for controlling fluid flow, for example as described in the other examples above.

Although the examples show the attachments 800, 800*b*, 800*c*, 800*d* cooperating with the connector 600, it should be understood that the attachments 800, 800*b*, 800*c*, 800*d* may also be used to effect opening of other valves, including valves of a dry-break connector such as the connector 700, or any other suitable valve configurations, including other quick-disconnect connectors, dry-break connectors, single-valves, dual-valves and valves that are integral to a fluid source/destination, among others.

In some examples, the attachments 800, 800*b*, 800*c*, 800*d* may include one half of a dry-break connector, for example the connector 600, or any other suitable valve configurations.

The attachment 800, 800*b*, 800*c*, 800*d* may also serve as a cover 300, 300*b*, 350 or cap 310 for the disclosed assemblies 1000, 1000*b*, 1000*c* or the container 1100. For example, the cover 300 shown in FIG. 1A may be the attachment 800*b*.

The attachment 800, 800*b*, 800*c*, 800*d* may be provided with a removable dispenser member removably connected to the distal end 815 of the attachment 800, 800*b*, 800*c*, 800*d* to suit various fluid dispensing purposes. For example, the removable dispenser member may be in the form shown in FIG. 30, and described elsewhere in the present disclosure, to adapt the attachment 800, 800*b*, 800*c*, 800*d* for larger or smaller inlets, higher or lower flow rates, straight or angled dispensing tip or any other suitable adaptation. In some examples, the removable dispenser member may be the telescoping portion 805*a* of the body 805, while in other examples the removable dispenser member may be removably attached to the distal end 815 of the telescoping portion 805*a*.

Although the attachments 800, 800*b*, 800*c*, 800*d* have been described as having first and second fluid passages 825, 830, in other examples the attachments 800, 800*b*, 800*c*, 800*d* may have more or less fluid passages. For example, where the attachments 800, 800*b*, 800*c*, 800*d* are intended for attaching to a fluid source having a single fluid passage (e.g., a liquid-only fluid source or a fluid source without vapor-recovery features), the attachments 800, 800*b*, 800*c*, 800*d* may include only one fluid passage. Similarly, the connectors 600, 700 may have more or less fluid passages than as shown in the present examples, as appropriate.

In some examples, such as where a trigger 240 is used to control fluid flow through the attachment 800, 800*b*, 800*c*, 800*d*, the attachment 800, 800*b*, 800*c*, 800*d* may provide an unconventional safety feature. Conventionally, fluid may be made to flow from dispenser spouts simply by inserting the spout into the inlet of a fluid destination, and optionally by applying a force on the spout against an inlet to open a valve in the spout. Dispensing fluid using a conventional non-valved spout may require the single step of inserting the open spout into a fluid destination to being the dispensing of fuel. Although this process may be simply, this may lead to unintentional fluid flow and/or spillage, such as when such a container is accidentally tilted or is mishandled when being maneuvered into a filling position (e.g., when the container is full the container may be awkward to handle and such mishandling may occur). Dispensing of fluid using a conventional valved spout which is already in place in the inlet of the fluid destination and ready to use may involve the single step of tilting the container and in the same movement applying a force on the spout to open a valve in the spout. However, this single step process may also lead to unintentional fluid flow, such as where the container is accidentally tilted and/or pushed against some other surface. In some examples, the present disclosure provides a safety feature by involving a two step process for dispensing liquid. In some examples of the disclosed attachment 800, 800*b*, 800*c*, 800*d*, in addition to tipping the container and inserting the distal end 815 into the inlet of the fluid destination, the trigger 240 may be required to be actuated before fluid flow occurs. Thus, an additional safety step may be required to enable fluid flow. This additional step may help to avoid unintentional fluid flow.

In some aspects, the present disclosure may provide a method for dispensing fluid into a fluid destination, the method including: placing an outlet of a fluid dispenser into fluid communication with an inlet of the fluid destination; and actuating a trigger of the fluid dispenser to enable fluid flow from the outlet of the fluid dispenser.

Although the assemblies 1000, 1000*b*, 1000*c*, the container 1100, connectors 600, 700 and attachments 800, 800*b*, 800*c*, 800*d* have been separately described, it should be understood that various combinations of these may be provided assembled together or as a kit of parts. As well, some or all of these components may be sold as separate interchangeable parts of a fluid dispensing system (e.g., a fluid pumping system).

Although the attachments 800, 800*b*, 800*c*, 800*d* and the connectors 600, 700 have been described in conjunction with the assemblies 1000, 1000*b*, 1000*c* and the container 1100, it should be understood that any of the attachments 800, 800*b*, 800*c*, 800*d* and the connectors 600, 700 may be used with any suitable fluid source/destination, any pouring device, any dispensing device and any receiving device, as appropriate. The attachments 800, 800*b*, 800*c*, 800*d* and the connectors 600, 700 may be integral with, permanently attached to or removably attached to any suitable fluid source/destination, any pouring device, any dispensing device and any receiving device, as appropriate.

It should be understood that features and variations described for certain embodiments of the assemblies 1000, 1000*b*, 1000*c* and the container 1100 may be applied to the other embodiments even if not explicitly stated.

Features and variations described for certain embodiments of the connectors 600, 700 may be applied to the other embodiments even if not explicitly stated. Where appropriate, variations in the configuration of a connector 600, 700 forming one half of a dry-break connection may be matched by similar variations in the configuration of the connector 600, 700 forming the other half of the dry-break connection.

Similarly, features and variations described for certain embodiments of the attachments 800, 800*b*, 800*c*, 800*d* may be applied to the other embodiments even if not explicitly stated.

Figure 71:
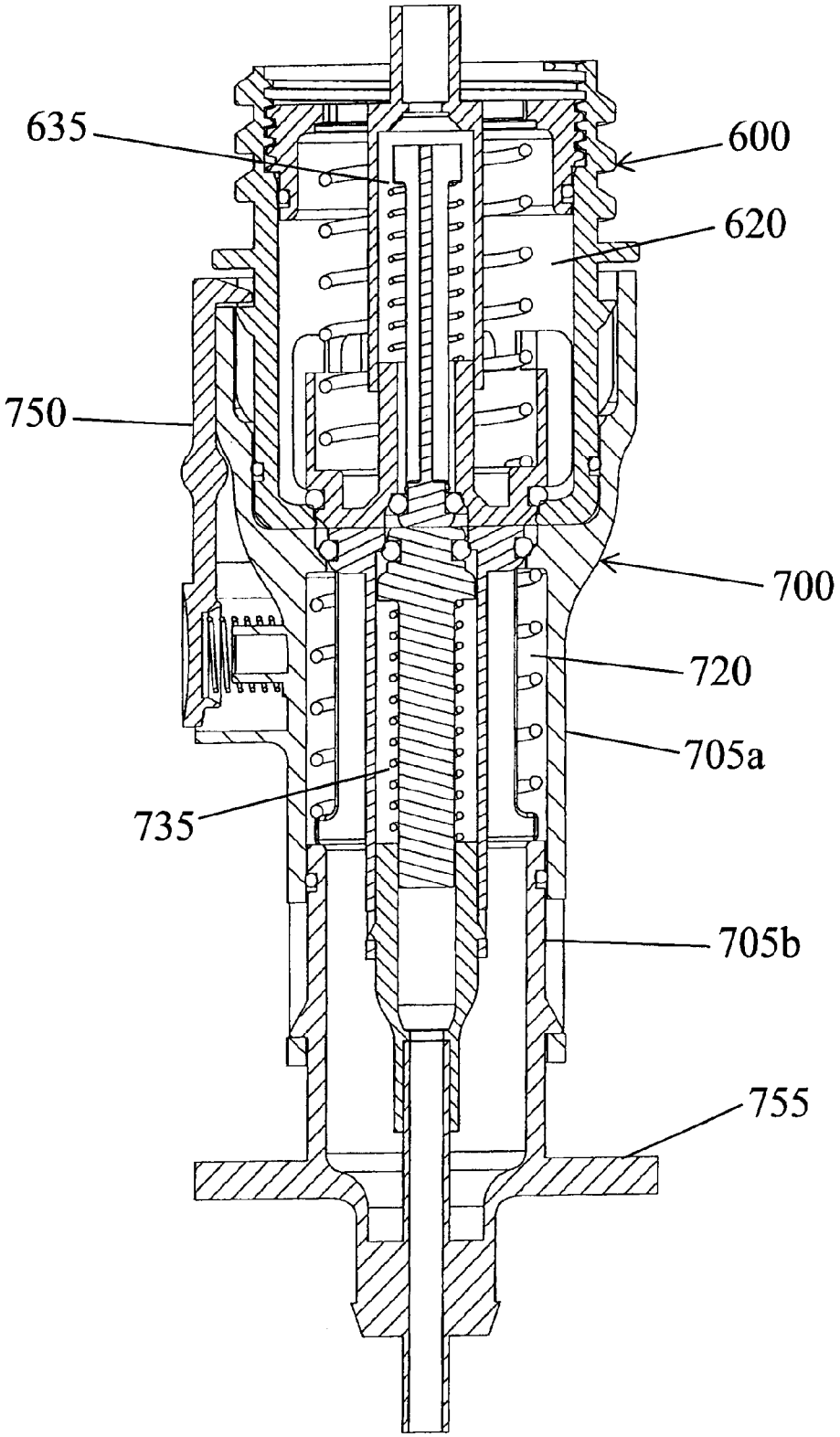
Figure 72:
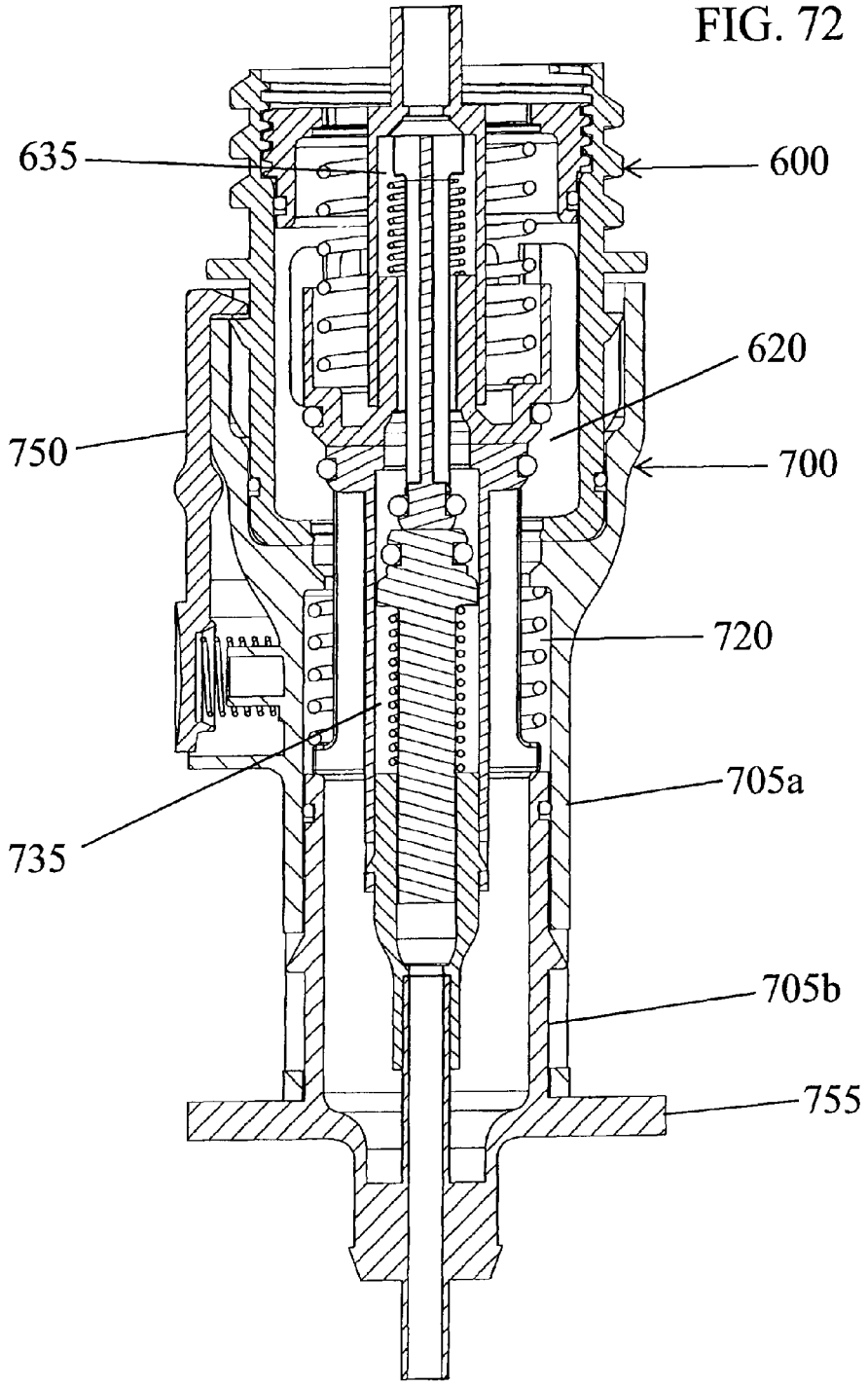
Figure 73:
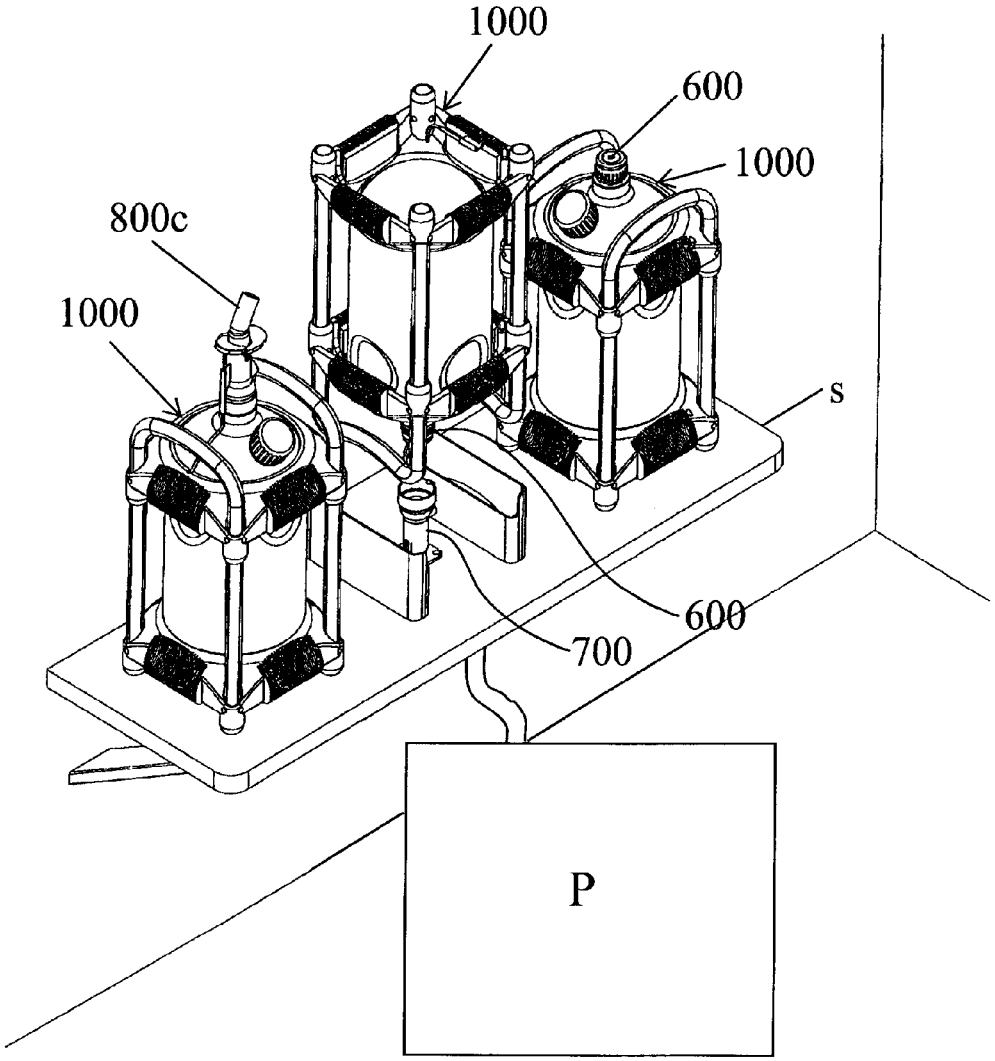
FIGS. 73 and 74 illustrate how the connectors of FIG. 68 may be used on a shelf system.
Figure 74:
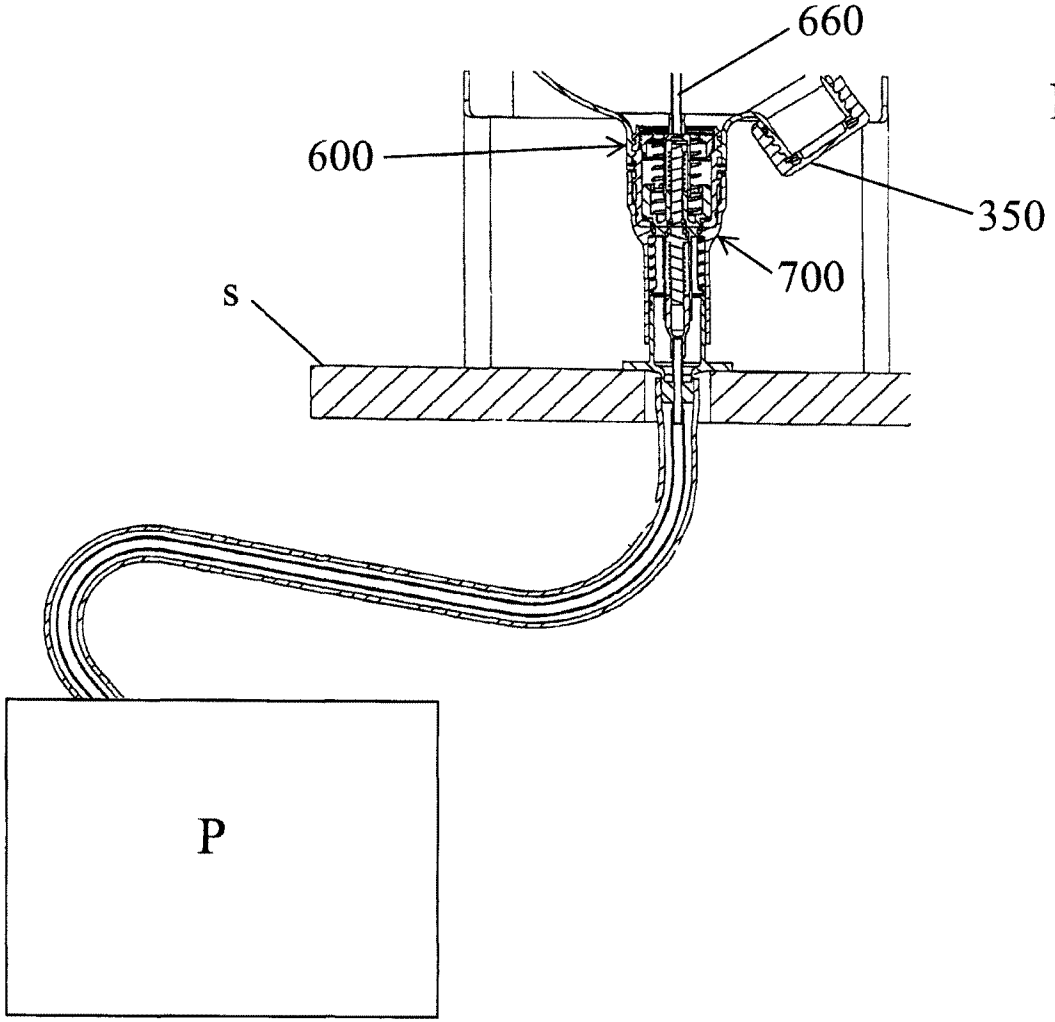

For example, FIGS. 68-72 illustrate an example of the connectors 600, 700 adapted for a mounted system for dispensing fluid (e.g., as shown in FIGS. 73 and 74). In this example, the connector 700 may be intended to be mounted to a support surface, such as a shelf, and may be connected to a fluid destination (e.g., a pump located beneath the shelf). The connector 600 may be provided on a fluid container to allow the fluid container to be connected to the fluid destination via a dry-break connection formed by the connectors 600, 700.

In the example shown, the connectors 600, 700 may be similar to those described above. The connector 700 may include a connecting member 750 having features (e.g., grooves, protrusions, snap-fitting or threads) to maintain a connection with the connector 600 when the connectors 600, 700 are mated together. In this example, the connecting member 750 may include a clip or snap attachment with a release button for releasing the attachment. The connecting member 750 may snap onto the connector 600 when the connectors 600, 700 are mated, while still allowing the connector 600 to rotate within the connector 700. The connector 700 may include a mounting surface 755 to facilitate mounting of the connector 700 to the support surface. For example, the mounting surface 755 may include mounting features (e.g., adhesives, clamps, hook-and-loop members, screws, nails, threads, protrusions, grooves, snap-fittings or nail/screw-receiving apertures). In the example shown, the mounting surface 755 includes apertures by which nails/screws may be used to mount the connector 700 to the support surface. In this example, the fluid passages 720, 735 of the connector 700 may extend through the mounting surface 755 to enable connection (e.g., via a dual-conduit hose) to the fluid destination.

As shown in FIGS. 70-72, in this configuration the connectors 600, 700 may mate with each other and may operate in conjunction with each other in a manner similar to that described above.

As shown in FIGS. 73 and 74, the connector 700 may be mounted on a support surface, in this case a shelf S, beneath which may be located a fluid destination, in this case a fluid pump P. In the example shown, a dual-conduit hose may be used to direct fluid between the connector 700 and the pump P. In other examples, the pump P may be directly connected to the connector 700. In other examples, other fluid destinations may connect with the connector 700 by holding the inlet of the fluid destination up to the extended fluid passages 720, 735 beneath the shelf S. This configuration may allow for easy and convenient storage of fluid containers while also providing a simple way to transfer fluid from the fluid container to the fluid destination.

In some examples, the configuration of FIGS. 69-72 may be used without mounting the connector 700 on a support surface. For example, the connector 700 may be used on any conventional fluid destination by inserting the fluid passages 720, 735 into the inlet of the fluid destination and the mounting surface 755 may serve to keep the connector 700 in place over the inlet and to cover up the inlet (e.g., to prevent unwanted escape of vapors). The configuration of FIGS. 69-72 may be used similarly to attachments 800, 800*b*, 800*c*, 800*d*, where the mounting surface 755 may function similarly to the extended surface 837 shown in FIGS. 45A and 45B. The connector 700 may thus allow any fluid destination to form a dry-break connection with the connector 600.

FIGS. 75-78 show other examples of how the connectors 600, 700 may be used to connect a fluid container (e.g., the assembly 1000, 1000*b*, 1000*c* or the container 1100) to a fluid destination (e.g., a fluid pump P).

Figure 75:
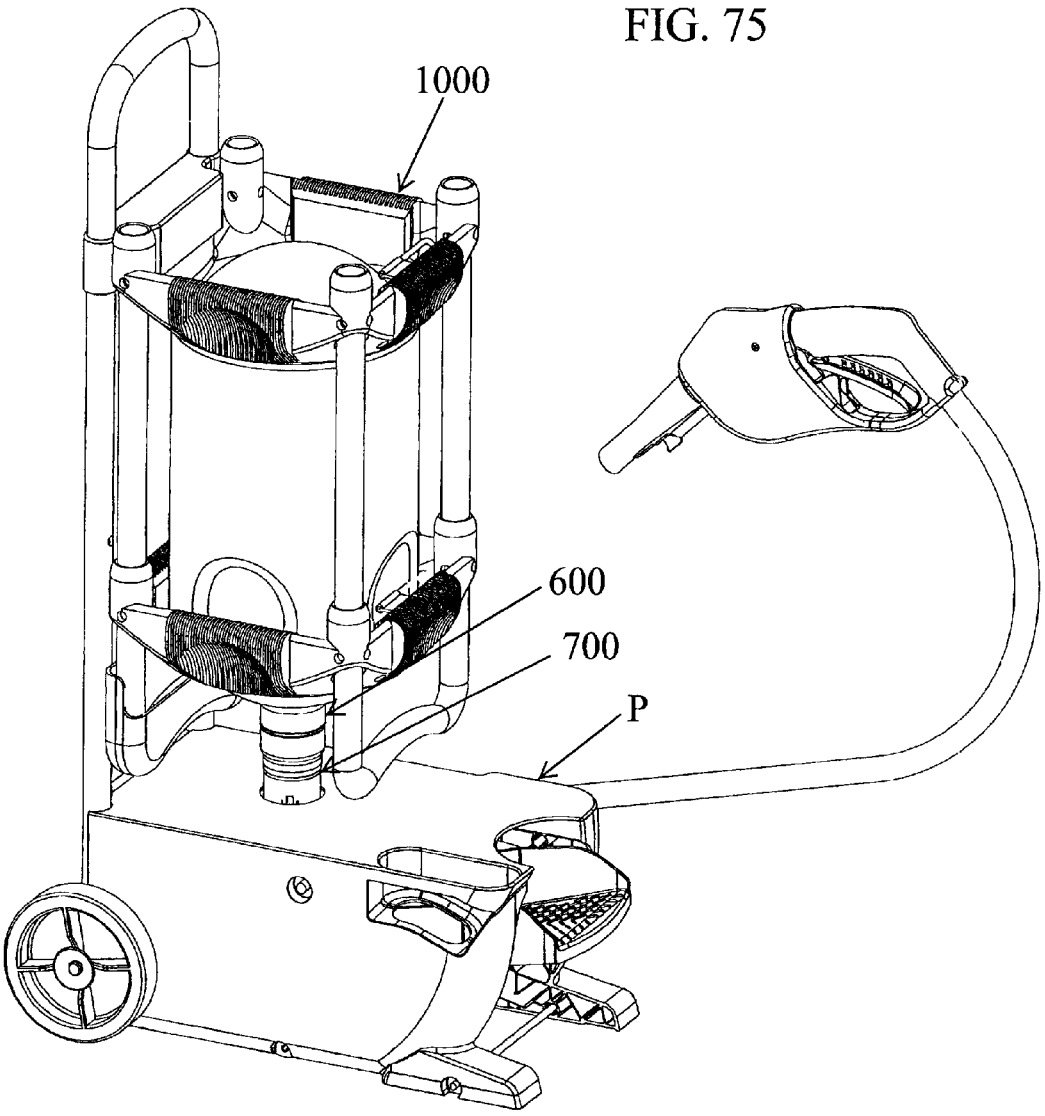
FIGS. 75-78 illustrate how the connectors of FIGS. 31 and 36 may be used on a mobile pump system.

In FIG. 75, the pump P may be a mobile manually-operated pump over which a fluid container (e.g., the assembly 1000, 1000*b*, 1000*c* or the container 1100, or any other fluid container) may be supported. In this example, the assembly 1000 may be connected to the pump P by the connectors 600, 700 to allow fluid communication between the assembly 1000 and the pump P, for example to refill the pump, or to allow the pump to pump the liquid from assembly 1000.

Figure 76:
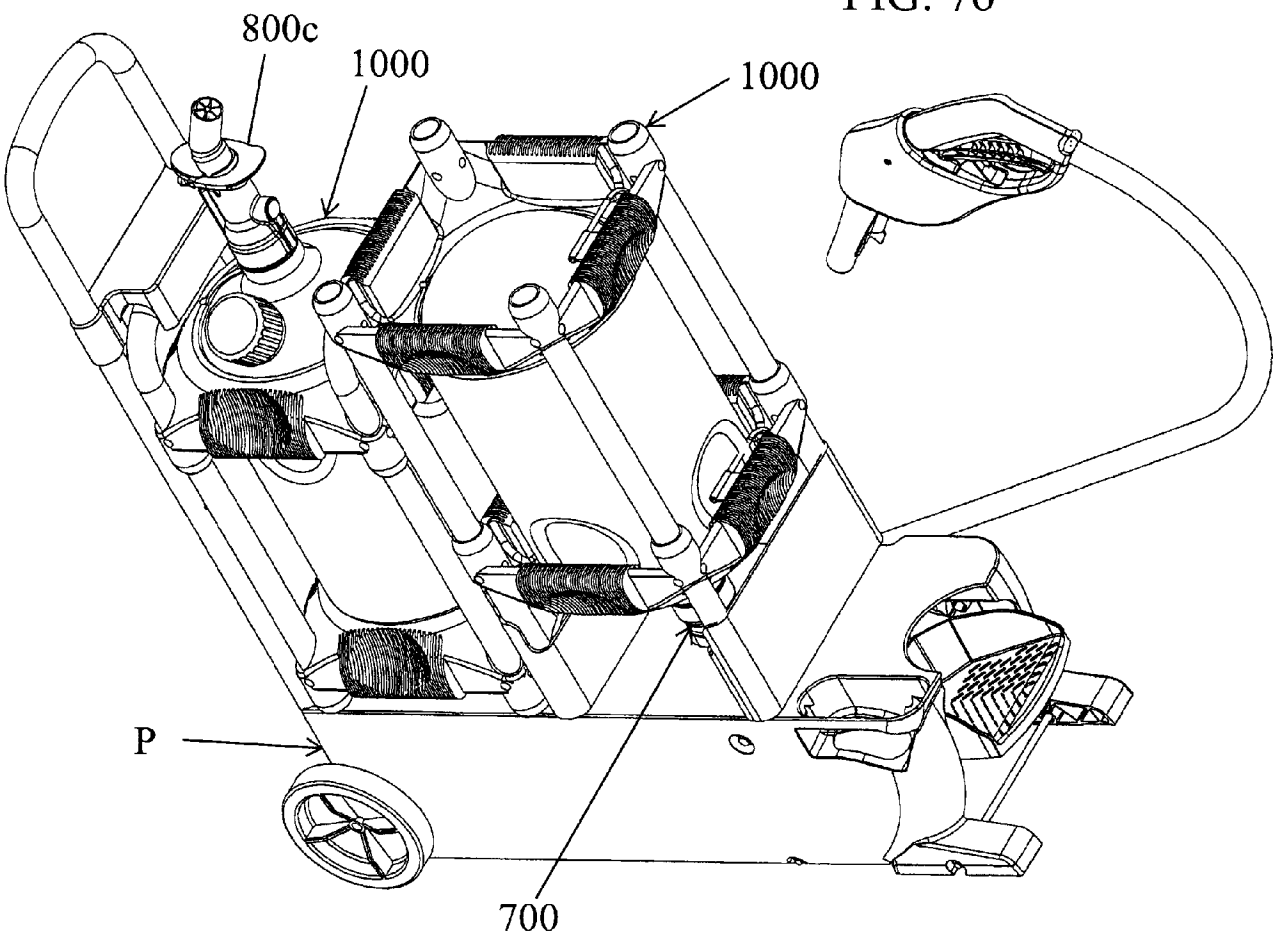

In FIG. 76, the pump P may be similar to that of FIG. 75, but may be configured to support multiple fluid containers (e.g., two assemblies 1000, 1000*b*, 1000*c* or the container 1100, or any other fluid container). Again, in this example, the connectors 600, 700 may be used to allow fluid communication between one of the assemblies 1000 and the pump P, for example to refill the pump. Additional assemblies 1000 may be carried on the pump P for additional refilling as required.

Figure 77:
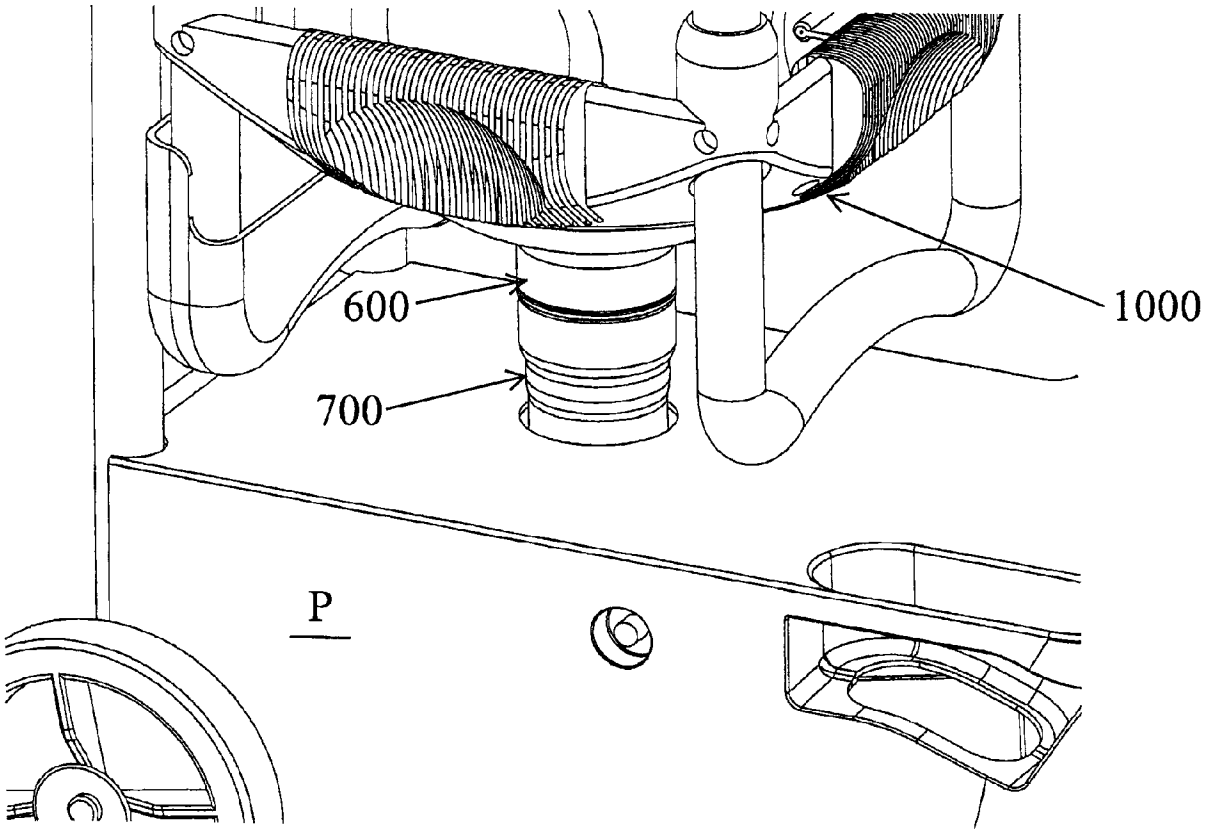
Figure 78:
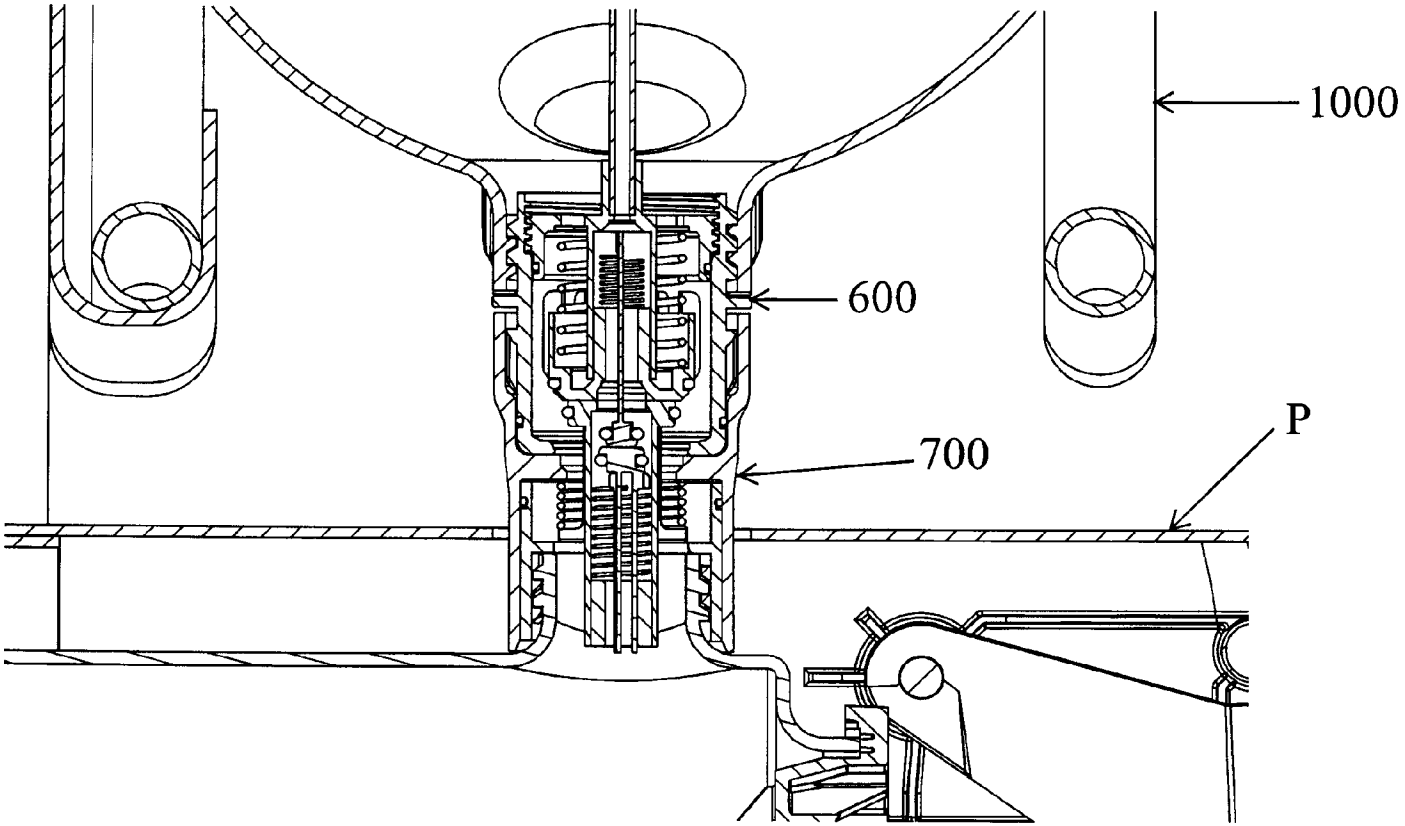

FIGS. 77 and 78 show details of how the connectors 600, 700 may be used to provide fluid communication between a fluid container and a pump P.

The dry-break connectors 600, 700 and attachments 800, 800*b*, 800*c*, 800*d* and their use described herein may be unconventional in that one half of a dry-break connection may be left open to the atmosphere a majority of the time. Conventionally, dry-break connections are typically used to contain and control fluid within a closed system, not an open system. Typically, a conventional dry-break connection may be designed to minimize any and all losses, so having one half open to the atmosphere or to attach a spout, with an open distal end, to a dry-break connector would be contrary to the conventional approach.

As would be understood by a person of ordinary skill in the art, the connector 600, 700 and attachment 800, 800, 800*c*, 800*d* disclosed herein may be made of any suitable material. For example, some or all of the connector 600, 700 and 800, 800*b*, 800*c*, 800*d* may be made of a plastic material.

While the present disclosure refers to fuel as an example fluid, the disclosed assembly 1000, 1000*b*, 1000*c*, the container 1100, connector 600, 700 and attachment 800, 800*b*, 800*c*, 800*d* may be used for receiving, dispensing and/or transporting any suitable fluid, for example, water, air, compressed gasses, or any other suitable fluid.

The embodiments of the present disclosure described above are intended to be examples only. Alterations, modifications and variations to the disclosure may be made without departing from the intended scope of the present disclosure. In particular, selected features from one or more of the above-described embodiments may be combined to create alternative embodiments not explicitly described. All values and sub-ranges within disclosed ranges are also disclosed. The subject matter described herein intends to cover and embrace all suitable changes in technology. All references mentioned are hereby incorporated by reference in their entirety.

The invention claimed is:

1. An attachment for communication of fluid from a fluid source, via a source connector comprising at least one valve, the attachment being attachable to and removable from the source connector, the attachment comprising:

a body defining a receiving end for receiving fluid from the source connector and a distal end for dispensing fluid from the attachment;

a first fluid passage defined in the body permitting fluid flow through the body at least to the distal end;

at least one valve engaging portion configured to engage the at least one valve of the source connector, wherein motion of the at least one valve engaging portion relative to the source connector causes the at least one valve of the source connector to open further comprising a second fluid passage defined in the body permitting fluid flow through the body at least from the distal end.

2. The attachment of claim 1, wherein the attachment is free of valves.

3. The attachment of claim 1, wherein the source connector comprises:

a body defining an attachment end for attaching the source connector to a fluid source, and a connection end;

a first fluid passage defined within the body permitting fluid flow at least between the attachment end and the connection end; and a first valve for controlling flow of the fluid through the first fluid passage, the first valve being biased towards a valve closed configuration in which fluid flow through the first fluid passage is inhibited; and wherein the receiving end of the attachment and the connection end of the source connector are configured to mate with each other;

wherein, when the attachment and the source connector are mated, the at least one valve engaging portion of the attachment is configured to engage the first valve of the source connector; and wherein motion of the at least one valve engaging portion relative to the attachment end causes the first valve to be reconfigured in a valve opened configuration, thereby permitting fluid communication between the first fluid passage of the attachment and the first fluid passage of the source connector.

4. The attachment of claim 1, further comprising trigger mechanism operatively connected to the at least one valve engaging portion wherein actuation of the trigger mechanism causes motion of the at least one valve engaging portion relative to the receiving end.

5. The attachment of claim 4, wherein the trigger mechanism is remotely located from the attachment.

6. The attachment of claim 5, wherein the trigger mechanism comprises a trigger operatively mountable to the fluid source wherein the trigger is operatively connected to the at least one valve engaging portion via a cable.

7. The attachment of claim 1, further comprising a protrusion extending from at least a portion of an outer surface of the body near the distal end, the protrusion being configured to come into close contact with an outer surface of a fluid destination when the distal end is inserted into an inlet of the fluid destination.

8. The attachment of claim 7, wherein the motion of the at least one valve engaging portion relative to the source connector is effected by engagement of the protrusion with an inlet opening of the fluid destination.

9. The attachment of claim 7, further comprising a trigger mechanism operatively connected to the at least one valve engaging portion wherein actuation of the trigger mechanism causes motion of the at least one valve engaging portion relative to the source connector, and wherein the protrusion is movable between an enabling position and a disabling position, and motion of the at least one valve engaging portion is enabled when the protrusion is in the enabling position and disabled when the protrusion is in the disabling position.

10. The attachment of claim 9, wherein, when the protrusion comes into close contact with the outer surface of the fluid destination, the protrusion is held in the enabling position.

11. The attachment of claim 1, wherein the source connector comprises:

a body defining an attachment end for attaching the source connector to a fluid source, and a connection end;

a first fluid passage defined within the body permitting fluid flow at least between the attachment end and the connection end; and a first valve for controlling flow of the fluid through the first fluid passage, the first valve being biased towards a valve closed configuration in which fluid flow through the first fluid passage is inhibited; and wherein the receiving end of the attachment and the connection end of the source connector are configured to mate with each other;

wherein, when the attachment and the source connector are mated, the at least one valve engaging portion of the attachment is configured to engage the first valve of the source connector; and wherein motion of the at least one valve engaging portion relative to the attachment end causes the first valve to be reconfigured in a valve opened configuration, thereby permitting fluid communication between the first fluid passage of the attachment and the first fluid passage of the source connector;

a second fluid passage defined within the body permitting fluid flow at least between the connection end and the attachment end; and a second valve for controlling flow of the fluid through the second fluid passage, the second valve being biased towards a valve closed configuration in which fluid flow through the second fluid passage is inhibited; and wherein the attachment further comprises:

a second fluid passage defined in the body permitting fluid flow through the body at least from the distal end;

wherein motion of the at least one valve engaging portion relative to the attachment end causes the second valve to be reconfigured to a valve opened configuration, thereby permitting fluid communication between the second fluid passage of the attachment and the second fluid passage of the source connector.

12. The attachment of claim 11, wherein the first valve is biased towards the connection end to define the valve closed configuration and wherein motion of the at least one valve engaging portion towards the source connector causes the first valve to open.

13. The attachment of claim 11, wherein the source connector is configured as a container cap.

14. The attachment of claim 11, further comprising:

a fluid container as the fluid source.

15. The attachment of claim 14, wherein the fluid container is a manually portable fluid container.

16. The attachment of claim 15, further comprising an enclosure attachable to the fluid container.

17. The attachment of claim 14, further comprising trigger mechanism operatively connected to the at least one valve of the source connector wherein actuation of the trigger mechanism causes motion of the at least one valve for controlling flow of the fluid through the first fluid passage of the source connector.

18. The attachment of claim 17, wherein the trigger mechanism is remotely located from the attachment.

19. The attachment of claim 17, wherein the trigger mechanism comprises a trigger operatively mounted to the fluid source wherein the trigger is operatively connected to the at least one valve via a cable.

* * * * *